US012290176B1

(12) United States Patent
Garland

(10) Patent No.: US 12,290,176 B1
(45) Date of Patent: May 6, 2025

(54) EASILY OPERATED SOFA BED

(71) Applicant: Thomas A. Garland, Bradenton, FL (US)

(72) Inventor: Thomas A. Garland, Bradenton, FL (US)

(73) Assignee: Thomas A. Garland, LLC, Bradenton, FL (US)

( * ) Notice: Subject to any disclaimer, the term of this patent is extended or adjusted under 35 U.S.C. 154(b) by 0 days.

(21) Appl. No.: 18/356,924

(22) Filed: Jul. 21, 2023

Related U.S. Application Data

(63) Continuation of application No. 16/299,701, filed on Mar. 12, 2019, now Pat. No. 11,812,855.

(60) Provisional application No. 62/643,486, filed on Mar. 15, 2018.

(51) Int. Cl.
*A47C 17/16* (2006.01)
*A47C 17/175* (2006.01)
*A47C 17/86* (2006.01)

(52) U.S. Cl.
CPC ..... *A47C 17/163* (2013.01); *A47C 17/1756* (2013.01); *A47C 17/86* (2013.01)

(58) Field of Classification Search
CPC ... A47C 17/163; A47C 17/1756; A47C 17/86; A47C 17/207; A47C 17/16; A47C 17/2076; A47C 17/165; A47C 17/04; A47C 17/134
See application file for complete search history.

(56) References Cited

U.S. PATENT DOCUMENTS

| | | | |
|---|---|---|---|
| 1,945,186 | A | 1/1934 | Frank |
| 2,664,145 | A | 12/1953 | Creveling et al. |
| 3,056,973 | A | 10/1962 | Keller et al. |
| 4,074,371 | A | 2/1978 | Lindbloom |
| 4,563,784 | A | 1/1986 | Shrock et al. |
| 4,616,798 | A | 10/1986 | Smeenge et al. |
| 4,694,514 | A | 9/1987 | Crossett |
| 4,737,996 | A | 4/1988 | Tiffany |
| 4,828,323 | A | 5/1989 | Brodersen et al. |
| 5,308,158 | A | 5/1994 | Vogelgesang et al. |
| 5,645,313 | A | 7/1997 | Best et al. |

(Continued)

FOREIGN PATENT DOCUMENTS

| | | | |
|---|---|---|---|
| EP | 1208772 A2 * | 5/2002 | ..... A47C 17/165 |
| EP | 2850973 B1 | 3/2015 | |

OTHER PUBLICATIONS

EP-1208772-A2—translation (Year: 2002).*

(Continued)

*Primary Examiner* — Justin C Mikowski
*Assistant Examiner* — Amanda L Bailey
(74) *Attorney, Agent, or Firm* — Sunstein LLP

(57) ABSTRACT

A folding bed, such as a sofa bed, with an assembly configured to counteract the gravitational forces acting on both a rotation of the main panel in relation to the frame and a rotation of the foot panel in relation to the main panel. A transmission may be used in the assembly to connect the first pivotal connection, where the main panel pivots with respect to the frame, to the second pivotal connection, where the foot panel pivots with respect to the main panel. The transmission transmits torque from the first pivotal connection to the second pivotal connection, so as to counteract gravitational forces acting on the foot edge of the foot panel.

11 Claims, 48 Drawing Sheets

(56) References Cited

U.S. PATENT DOCUMENTS

| | | | | |
|---|---|---|---|---|
| 5,904,401 | A * | 5/1999 | Alberda | A47C 17/2076 297/65 |
| 6,176,456 | B1 | 1/2001 | Wisniewski | |
| 6,502,261 | B1 | 1/2003 | Harwood | |
| 6,588,837 | B1 | 7/2003 | Schultz et al. | |
| 6,904,628 | B2 | 6/2005 | Murphy et al. | |
| 7,549,182 | B2 | 6/2009 | Murphy | |
| 8,011,034 | B2 | 9/2011 | Hoffman et al. | |
| 8,225,438 | B2 | 7/2012 | Murphy | |
| 8,438,676 | B2 | 5/2013 | Murphy | |
| 8,739,330 | B2 | 6/2014 | Smith et al. | |
| 8,893,323 | B2 * | 11/2014 | Garland | A47C 17/17 5/42 |
| 8,997,273 | B2 | 4/2015 | Murphy et al. | |
| 9,113,703 | B2 | 8/2015 | Flaherty | |
| 9,144,319 | B2 | 9/2015 | Murphy et al. | |
| 9,468,303 | B2 | 10/2016 | Garland | |
| 9,591,928 | B2 | 3/2017 | Martinez | |
| 9,668,585 | B2 | 6/2017 | Garland | |
| 9,814,321 | B2 * | 11/2017 | Garland | A47C 17/04 |
| 2003/0070225 | A1 | 4/2003 | Murphy et al. | |
| 2009/0235452 | A1 | 9/2009 | Hoffman et al. | |
| 2011/0010846 | A1 | 1/2011 | Murphy | |
| 2011/0010847 | A1 | 1/2011 | Murphy | |
| 2011/0018331 | A1 | 1/2011 | Murphy et al. | |
| 2013/0025049 | A1 * | 1/2013 | McCoy | A47C 17/48 5/133 |
| 2013/0097774 | A1 * | 4/2013 | Garland | A47C 17/17 5/29 |
| 2014/0101846 | A1 | 4/2014 | Garland | |
| 2015/0135432 | A1 | 5/2015 | Murphy et al. | |
| 2016/0324326 | A1 * | 11/2016 | McCoy | A47C 17/52 |
| 2018/0064258 | A1 | 3/2018 | Murphy | |

OTHER PUBLICATIONS

Lazar, The Lazar Somerset II Paragon Power Queen Sleeper website, 4 pages, retrieved from the Internet on Jan. 18, 2018 [http://www.lazarind.com/product/somerset-ii-paragon-power-sleeper/

* cited by examiner

EASILY OPERATED SOFA BED

This application is a continuation of U.S. patent application Ser. No. 16/299,701, filed Mar. 12, 2019, which claims priority from U.S. Provisional Application No. 62/643,486, filed Mar. 15, 2018. Each of these applications, in its entirety, is hereby incorporated herein by reference.

TECHNICAL FIELD

The present invention relates to furniture, and more particularly to furniture that may unfold to become a bed, such as sofa bed.

BACKGROUND ART

A sofa bed can be converted from a sofa configuration to a bed configuration, and vice versa. One type of sofa bed has three sections with bed cushions incorporated into each section, such that in bed configuration the three sections with bed cushions collectively form the sleeping surface. A mechanism connects to the sections to facilitate their movement from sofa to bed configuration. Examples of such sofa beds are described in U.S. Pat. No. 4,737,996 to Tiffany, U.S. Pat. No. 6,904,628 to Murphy et al., U.S. Pat. No. 8,011,034 to Hoffman, U.S. Pat. No. 8,893,323 to Garland U.S. Pat. No. 9,468,303 to Garland. The invention described below may be used with the sofa beds disclosed in these patents. The disclosures of these patents are incorporated herein by reference. Alternatively, the invention described below may be with sofa beds and other types of furniture that are different from those disclosed in these patents.

Prior art sofa beds of the type described above typically include springs or other means to offset some of the opening and closing forces required to be generated by a user in order to open and close the sofa bed. U.S. Pat. No. 9,468,303 to Garland describes an additional torsion spring assembly disposed along the axis of rotation between the mid and foot sections in order to reduce some of the force necessary to lift the foot section from sofa to bed mode. Such a torsion spring assembly only reduces lifting forces required during the initial portion of the movement from sofa to bed position. Accordingly, it is desirable to continue to improve the ease of opening of sofa beds.

SUMMARY OF THE EMBODIMENTS

In accordance with one embodiment of the invention, a folding bed is provided with a frame with opposed sides, and an assembly, located between the sides. In a two-panel version of the folding bed, a main panel and a foot panel are provided. In a three-panel version, such as a sofa bed, a head panel is also provided (and the main panel may be considered a mid panel). The panels preferably support mattress sections thereon.

The main panel pivots with respect to the frame about a fixed axis. The main panel has a first edge located closer to the fixed axis and a second edge located further away from the fixed axis. The foot panel also has two edges: a main edge that is kept close to the second edge of the main panel, and a foot edge that is spaced further away from the second edge.

The assembly includes two pivotal connections. A first pivotal connection is located about the fixed axis and connects the main panel and the frame, such that the first pivotal connection is located nearer to the first edge than to the second edge. A second pivotal connection connects the foot panel and the main panel, such that the foot edge can be swung away from the first edge while the main edge is kept near the second edge.

The panels are preferably arranged such that, (i) when the assembly is in a folded position, the main panel is oriented in a generally horizontal position and faces downward, and the foot panel is stacked above the middle panel in a generally horizontal orientation and faces upward, and (ii) when the assembly is in an unfolded position, the main panel and the foot panel are adjacent each other and both are oriented in a generally horizontal orientation and face upward.

A folding bed of the present invention is preferably configured so that gravitational forces acting on the assembly are counteracted so as to reduce forces required by a user to effectuate the transition between folded and unfolded positions. In particular, the folding bed is configured so that the gravitational forces acting on both (a) a rotation of the main panel in relation to the frame and (b) a rotation of the foot panel in relation to the main panel are counteracted.

In a preferred embodiment, a transmission is used in the assembly to connect the first pivotal connection to the second pivotal connection and is configured to transmit torque from the first pivotal connection to the second pivotal connection. The transmission preferably transmits torque from the first pivotal connection to the second pivotal connection so as to counteract gravitational forces acting on the foot edge of the foot panel.

In another embodiment, means are provided in the assembly for constraining an angular orientation of the foot panel in relation to the main section over the course of transitioning from a folded position to an unfolded position. In a preferred embodiment, this means for constraining the angular orientation of the foot panel constrains the angular orientation of the foot panel in such a manner that the angular orientation of the foot section at all times is generally horizontal. In an alternative embodiment, this means for constraining the angular orientation of the foot panel constrains the angular orientation of the foot panel in such a manner that the angular orientation of the foot panel is a function of and angular orientation of the main panel in relation to the frame. This means for constraining the angular orientation of the foot panel preferably transmits torque from the first pivotal connection to the second pivotal connection.

Preferably, the transmission and/or the means for constraining the foot panel's angular orientation have a relatively slender profile. In other words, their depth—the vertical dimension when the folding bed is in a fully open position or a fully closed position—is relatively small. This depth, measured at a point between the first edge and the second edge (and preferably away from the first edge), is preferably less than the depth of the main panel and the main mattress section combined. More preferably, this depth is less than half of a depth of the main panel and the main mattress section combined. Preferably, this depth is less than 2.5 inches.

In one embodiment, the transmission includes a chain and a sprocket. In another embodiment includes a belt. In yet another embodiment, the transmission includes a plurality of linkages. In a further embodiment, the transmission includes a connecting shaft with a first gear at a first end of the connecting shaft and a second gear at a second end of the connecting shaft. These four alternative structures may also be used in the means for constraining the foot panel's angular orientation.

In another embodiment, the assembly is provided with a control apparatus that has a relatively slender profile, connects the first pivotal connection and the second pivotal connection, has a main-panel portion which directly controls the foot panel's angular orientation, and is configured to constrain an angular orientation of the foot panel in relation to the main panel over the course of transitioning from a folded position to an unfolded position. In particular, the main-panel portion preferably has a depth that is less than the depth of the main panel and the main mattress section combined. More preferably, this depth measured at this point is less than half of a depth of the main panel and the main mattress section combined. Preferably, this depth measured at this point is less than 2.5 inches.

In another embodiment, the assembly is provided with a control apparatus with four portions: an arm portion including the first pivotal connection and preferably disposed within an arm, a main-panel portion directly attached to the main panel and including the second pivotal connection, a foot panel portion directly attached to the foot panel, and a connecting portion connecting the arm portion and the main-panel portion. Preferably the main-panel portion and foot panel portion are located substantially within the lateral sides of the main panel and foot panel, while the arm portion is located outside the lateral sides of main panel and foot panel. This control apparatus constrains an angular orientation of the foot panel in relation to the main panel over the course of transitioning from a folded position to an unfolded position. The entire main panel portion and the foot panel portion preferably have a relatively slender profile. In particular, the main panel portion and the foot panel portion preferably have a depth that is less than the depth of the main panel and the main mattress section combined. More preferably, this depth is less than half of a depth of the main panel and the main mattress section combined. Preferably, this depth measured is less than 2.5 inches.

In some embodiments, these control apparatuses are configured to constrain the angular orientation of the foot panel in relation to the main panel over the course of transitioning from a folded position to an unfolded position in such a manner that the angular orientation of the foot section at all times is generally horizontal. In alternative embodiments, these control apparatuses are configured to constrain the angular orientation of the foot panel in relation to the main panel over the course of transitioning from a folded position to an unfolded position in such a manner that the angular orientation of the foot panel is a function of an angular orientation of the main panel in relation to the frame.

The control apparatus preferably includes a transmission connecting the first pivotal connection to the second pivotal connection to transmit torque from the first pivotal connection to the second pivotal connection.

The folding bed also preferably includes means for applying a torque about the first pivotal connection. This means for applying torque may include a spring, alternatively it may include a gas cylinder, and alternatively it may include a motor.

The assembly preferably includes two traverse members that are sufficiently connected (directly or indirectly) to the main panel so as to move with the main panel. These traverse members extend in opposite directions from each other and traverse to the main panel. The first traverse member provides the first pivotal connection to the frame, and the means for applying torque applies a force to the second traverse member.

In a sofa bed version of the invention, the assembly further includes a back. The back may be fixed, or it may be moveable. A moveable back may include a head panel supporting thereon a head mattress section defining a face of the head panel. The head panel is preferably arranged with respect to the main and foot panels such that, (i) when the assembly is in a folded position, the head panel faces forward and is oriented in a generally vertical position adjacent the main edge of the foot panel and adjacent the back of the frame, and (ii) when the assembly is in an unfolded position, the head panel and the main panel are adjacent each other and the head panel is oriented in a generally horizontal orientation and faces upward. Preferably, the gravitational forces acting on the head panel as it transitions between a sofa position and a bed position—as well the gravitational forces acting on the main panel and foot panel as they transition—are counteracted.

Methods of operating a folding bed are also provided. Preferred methods are practiced, over a course of transition between an open position and a closed position, on an assembly that includes a foot panel and a main panel, wherein the folding bed includes a frame supporting each of two sides of the assembly, and wherein the transition between an open position and a closed position is effected by the application of a force by the user.

A preferred method includes (a) constraining the angular orientation of the foot panel in relation to the main panel over the course of the transition in such a manner that (i) the angular orientation of the foot panel at all times is generally horizontal, (ii) the entire foot panel and the main panel are lifted in the course of the transition, and (iii) the angular orientation of the main panel changes in the course of the transition; and (b) counteracting gravitational forces acting on the assembly to reduce forces required by a user to effectuate the transition. In a preferred embodiment, the angular orientation of the main panel changes approximately 180 degrees during the course of the transition, such that the angular orientation of the main panel is generally horizontal when the assembly is in the open position and when the assembly is in the closed position, but the angular orientation of the main panel in the closed position is upside-down compared to the main panel's angular orientation in the open position.

An alternative preferred method includes (a) constraining the angular orientation of the foot panel in relation to the main panel over the course of the transition in such a manner that (i) the angular orientation of the foot panel is a function of the angular orientation of the main panel in relation to the frame, (ii) the entire foot panel and the main panel are lifted during the transition, and (iii) the angular orientation of the main panel changes approximately 180 degrees during the course of the transition, such that the angular orientation of the main panel is generally horizontal when the assembly is in the open position and when the assembly is in the closed position, but the angular orientation of the main panel in the closed position is upside-down compared to the main panel's angular orientation in the open position; and (b) counteracting gravitational forces acting on the assembly to reduce forces required by a user to effectuate the transition. In a preferred embodiment, the angular orientation of the foot panel is generally horizontal when the assembly is in the open position and when the assembly is in the closed position.

Preferably, a portion of the assembly is attached to each side of the frame where the fixed axis, about which the main panel pivots, passes through each of the two sides of the frame, and causing the entire foot panel and the main panel are caused to be lifted over the fixed axis in the course of the transition. In a preferred embodiment, at least a portion of each of the foot panel and the main panel is lower than the fixed axis when the assembly is in the closed position, and at least a portion of each of the foot panel and the main panel is higher than the fixed axis when the assembly is in the open position. Preferably, the foot panel is pivotally attached to the main panel so that the foot edge can be swung away from the first edge while the main edge is kept near the second edge.

In one embodiment, the main panel has attached thereto (directly or indirectly) a first traverse member and a second traverse member, the first and second traverse members extending in opposite directions from each other and traverse to the main panel, wherein the first traverse member is pivotally attached to a side of the frame where the fixed axis passes through the frame, and wherein counteracting gravitational forces includes applying a force to the second traverse member.

A preferred embodiment of the method includes providing the assembly with means for controlling the foot-panel angular orientation so that the angular orientation of the foot panel depends on the angular orientation of the main panel. This means of controlling the foot-panel angular orientation preferably has a slender profile. For example, this means for controlling the foot-panel angular orientation has a depth, between the first edge and the second edge, that is less than a main-panel depth, wherein the main-panel depth is measured from an exposed surface of a cushion attached to and extending from the main panel, to an under surface of the main panel. (The cushion surface and the under surface face in opposite directions, and the under surface is considered to be a flat surface not including any protuberances thereon.) More preferably, the means for controlling the foot-panel angular orientation has a depth, between the first edge and the second edge, that is less than half of the main-panel depth. In a preferred embodiment, the means for controlling the foot-panel angular orientation has a depth, between the first edge and the second edge, that is less than 3 inches. In further preferred embodiment, the means for controlling the foot-panel angular orientation has a depth, between the first edge and the second edge, that is less than 2.5 inches. In a preferred embodiment, the means for controlling the foot-panel angular orientation has a depth, between the first edge and the second edge, that is less than 7 centimeters.

A preferred embodiment of the method includes providing a force about a single axis of rotation that creates torque that assists in both (i) rotating the main panel in relation to the frame and (ii) rotating the foot panel in relation to the main panel.

BRIEF DESCRIPTION OF THE DRAWINGS

The foregoing features of embodiments will be more readily understood by reference to the following detailed description, taken with reference to the accompanying drawings, in which:

FIGS. 24(A) and 24(B) show side views of the sofa bed of FIG. 1 showing only the opening control mechanism mounted to an arm panel, wherein FIG. 24(A) shows the opening control mechanism in the folded configuration, and FIG. 24(B) shows the opening control mechanism in the unfolded position.

FIGS. 33A-36A show partially cut-away views corresponding to the views of FIGS. 33-36.

DETAILED DESCRIPTION OF SPECIFIC EMBODIMENTS

Figure 1:
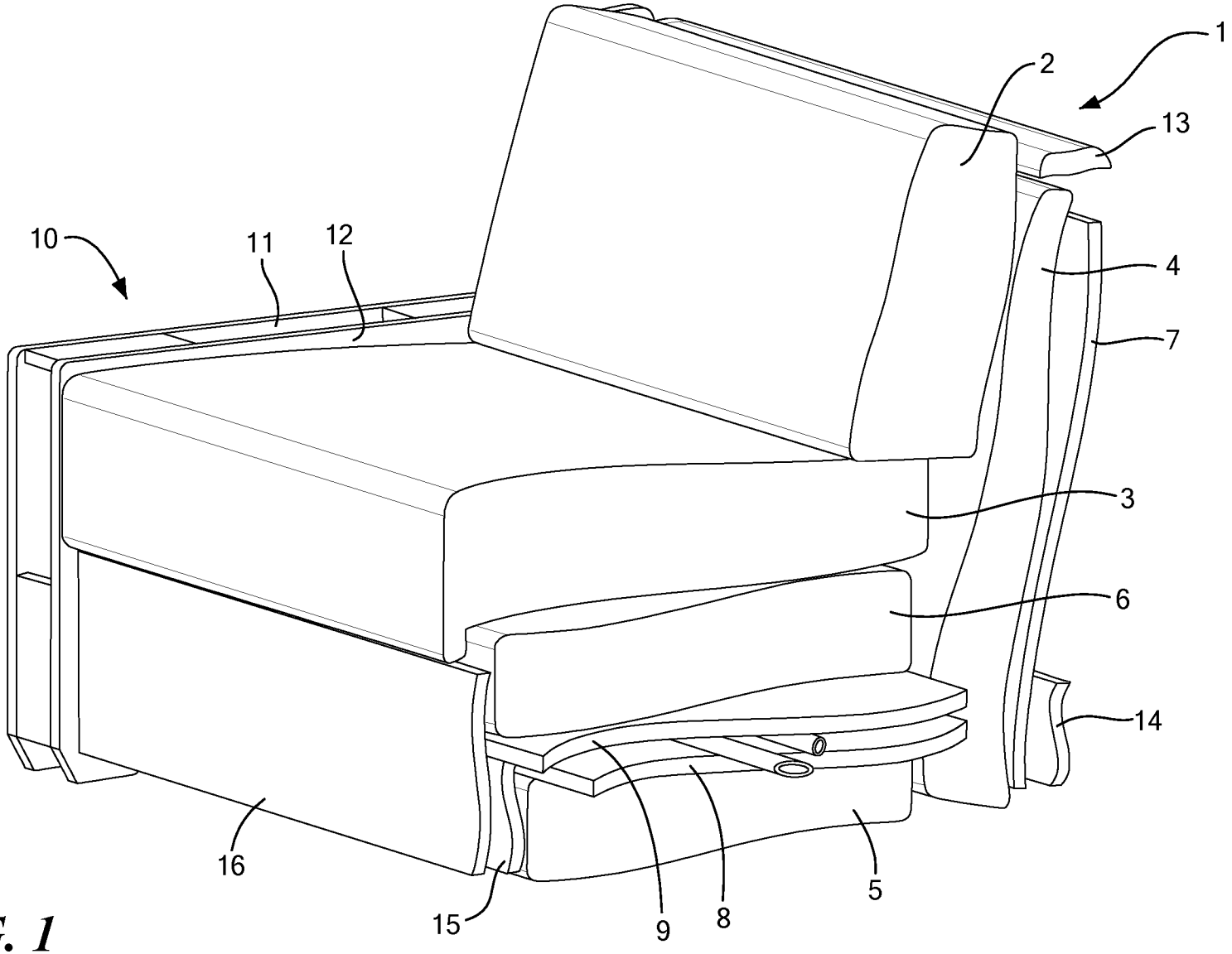
FIG. 1 shows a cutaway view of a sofa bed in closed sofa mode in accordance with an embodiment of the invention. The sofa bed is shown with some upholstery removed.
Figure 2:
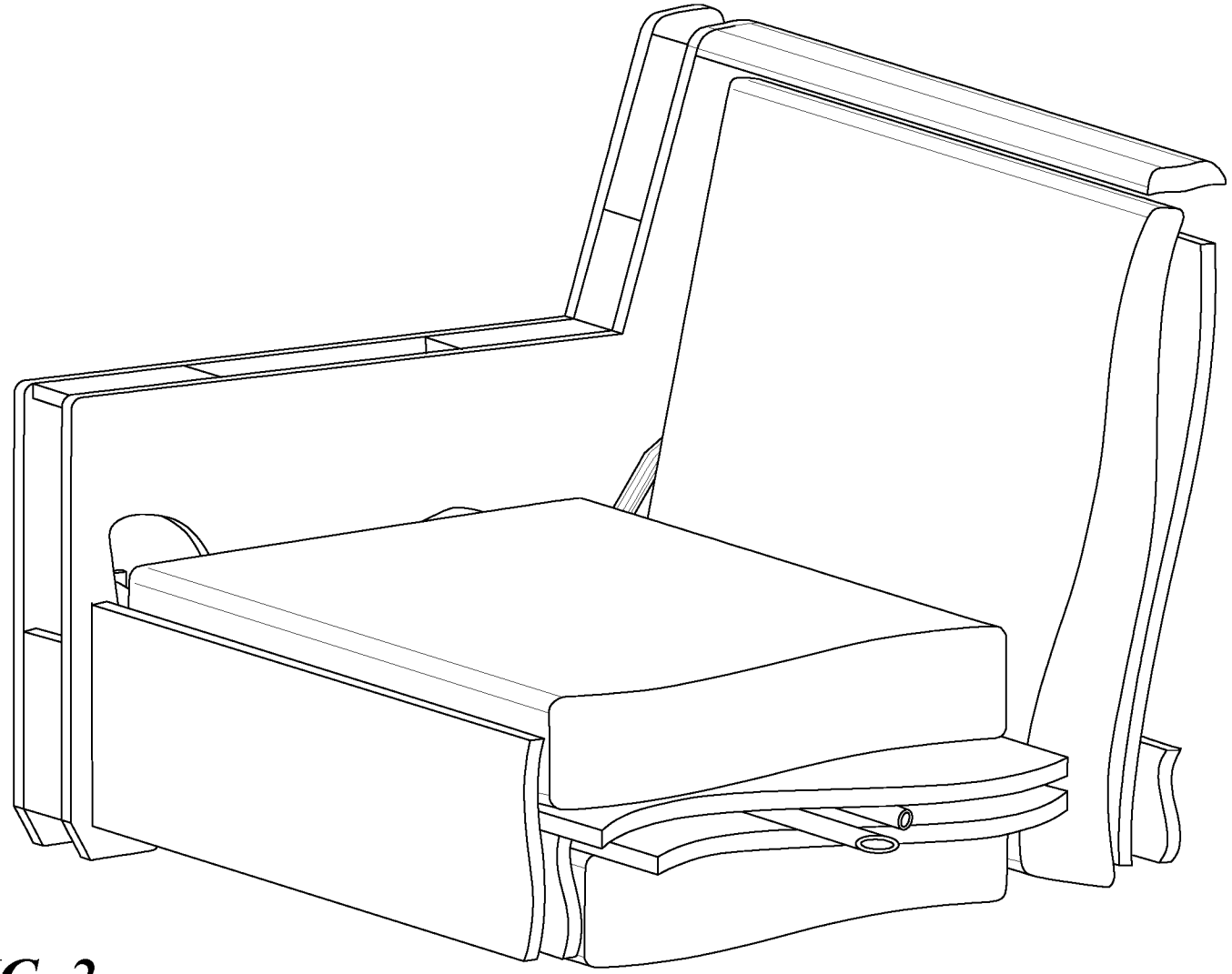
FIGS. 2-5 show the sofa bed of FIG. 1 without sofa seat and back cushions as it is folded from sofa to bed mode

Definitions. As used in this description and the accompanying claims, the following terms shall have the meanings indicated, unless the context otherwise requires:

"Generally horizontal" includes exactly horizontal. Preferably, "generally horizontal" is an angular orientation within 25 degrees of exactly horizontal. More preferably, "generally horizontal" is an angular orientation within 17 degrees of exactly horizontal. Still more preferably, "generally horizontal" is an angular orientation within 13 degrees of exactly horizontal.

In embodiments of the convertible sofa bed described herein, an opening control mechanism is used that substantially reduces the force required to open and close the sofa bed compared to a sofa bed that does not incorporate such a mechanism. A preferred embodiment of the sofa bed has three sections: a head section, mid-section (which may also be called a main section), and a foot section. In a bed (unfolded or open) configuration, such sections are adjacent each other in the order described to comprise a sleeping surface. A head panel mechanism is connected between a side (e.g., an arm) of the sofa to the head section to allow that section to move from its sofa (folded or closed) position to its bed (open) position. The mid-section is pivotally connected to the side near the transverse edge of the mid-section which is adjacent the head section when seen in bed position. The foot section is pivotally connected to the mid-section at a transverse axis between the adjacent edges of the foot and mid panels when seen in bed position.

An opening control mechanism is connected between the side and the mid and foot sections. A leg assembly may be connected to the mid and foot sections such that legs to support the mid and foot sections move from a horizontal to a vertical position as the sofa bed moves from sofa to bed position. The head panel mechanism is connected to the opening control mechanism such that the angle and position of each of the three sections are coordinated and controlled during movement from sofa to bed position. In preferred embodiments, a mechanism connects and controls the angle and position of all three sections, and thus, all opening and closing forces are likewise connected and can be counteracted and reduced to the extent desired to facilitate opening and closing of the sofa bed.

In an alternative embodiment, a moveable head section is unnecessary, and only the main and foot sections unfold to form the horizontal top of the bed portion, while the sofa back does not move to form part of the bed. In another alternative embodiment, no sofa back is provided at all; in other words, a back-less piece of furniture (e.g., an ottoman sleeper) is provided and may be unfolded to become a bed. In such an embodiment, only the main and foot sections unfold to form the horizontal top of the bed portion.

In yet another alternative embodiment, the sofa has a width normally associated with a chair, and this piece of furniture unfolds to become a single bed, as opposed to a double bed, a queen-sized bed, a king-sized bed, or the like.

The embodiment depicted in FIGS. 1-28 is based on a three-panel convertible sofa bed where, in sofa position, the head bed cushion is in a substantially vertical position (preferably behind a removable back cushion). In sofa mode, the top of head bed cushion faces forward, the top of mid bed cushion faces downward, and the top of foot bed cushion faces up (preferably below a removable seat cushion). In sofa mode, the foot bed cushion is above and substantially parallel to the mid bed cushion. In bed mode, the cushioned tops of head bed cushion, mid bed cushion, and foot bed cushion all become substantially horizontal and coplanar (after removal of the removable back and seat cushions, in a preferred embodiment). In this embodiment, a 4-bar head panel mechanism is attached between the arm (or side) of the sofa bed, and the head panel, This 4-bar head panel mechanism moves the head bed cushion from a substantially vertical position in sofa mode to a substantially horizontal position in bed mode.

In this embodiment, the mid bed panel is pivotally attached to the arm so that during rotation of approximately 180 degrees and movement from sofa to bed mode, the mid bed panel rises relative to the floor, and is displaced forward of its location in sofa mode. When seen in bed mode, the rear edge of the foot panel is pivotally attached to the adjacent forward edge of the mid panel.

While transitioning from bed mode to sofa mode, this pivotally attached edge moves to a position further rearward and lower that its bed mode position, while the top of the foot panel in bed mode remains facing upward in sofa mode. Legs are provided to support the mid and foot panel in sofa mode and incorporated into a leg assembly which is attached to the foot and mid panels and is configured to move the legs from a horizontal position parallel to the mid and foot panels in sofa mode to a vertical position in bed mode. All three bed panels are attached such that by moving the foot panel from bed to sofa position, all three panels move simultaneously to sofa position.

FIG. 1 shows a cutaway view of a sofa bed 1 in closed sofa mode. (Although only the right side of the sofa bed is shown, it will be appreciated that the left side may be—and in most embodiments preferably is—a symmetrical mirror image of the right side.) The sofa bed 1 is shown without upholstery on the arm 10 and on other frame members. A removable sofa back cushion 2 is supported by head bed cushion 4. A removable sofa seat cushion 3 is supported by a foot bed cushion 6. A head bed cushion 4 is fixed to and supported by a head panel 7. A mid bed cushion 5 is fixed to and supported by a mid panel 8. A foot bed cushion 6 is fixed to and supported by a foot panel 9. The panels—head panel 7, mid panel 8, and foot panel 9—may be made of a constantly constant thickness material like plywood (as shown in FIGS. 1-9), or the panels may be made by using a perimeter frame or a ladder frame with webbing or elastic or rigid material covering the frame or extending between such framing to provide a support surface.

An arm 10 includes an outer arm panel 11 and an inner arm panel 12. A front cross member 15 connects a right arm assembly 10 to a mirror image left arm assembly (not shown). An upper rear cross member 13 connects the arm assembly 10 to a mirror image left arm assembly (not shown). A lower rear cross member 14 connects the arm assembly 10 to a mirror image left arm assembly (not shown). A vertical cross member 16 is attached to the foot panel 9.

Figure 3:
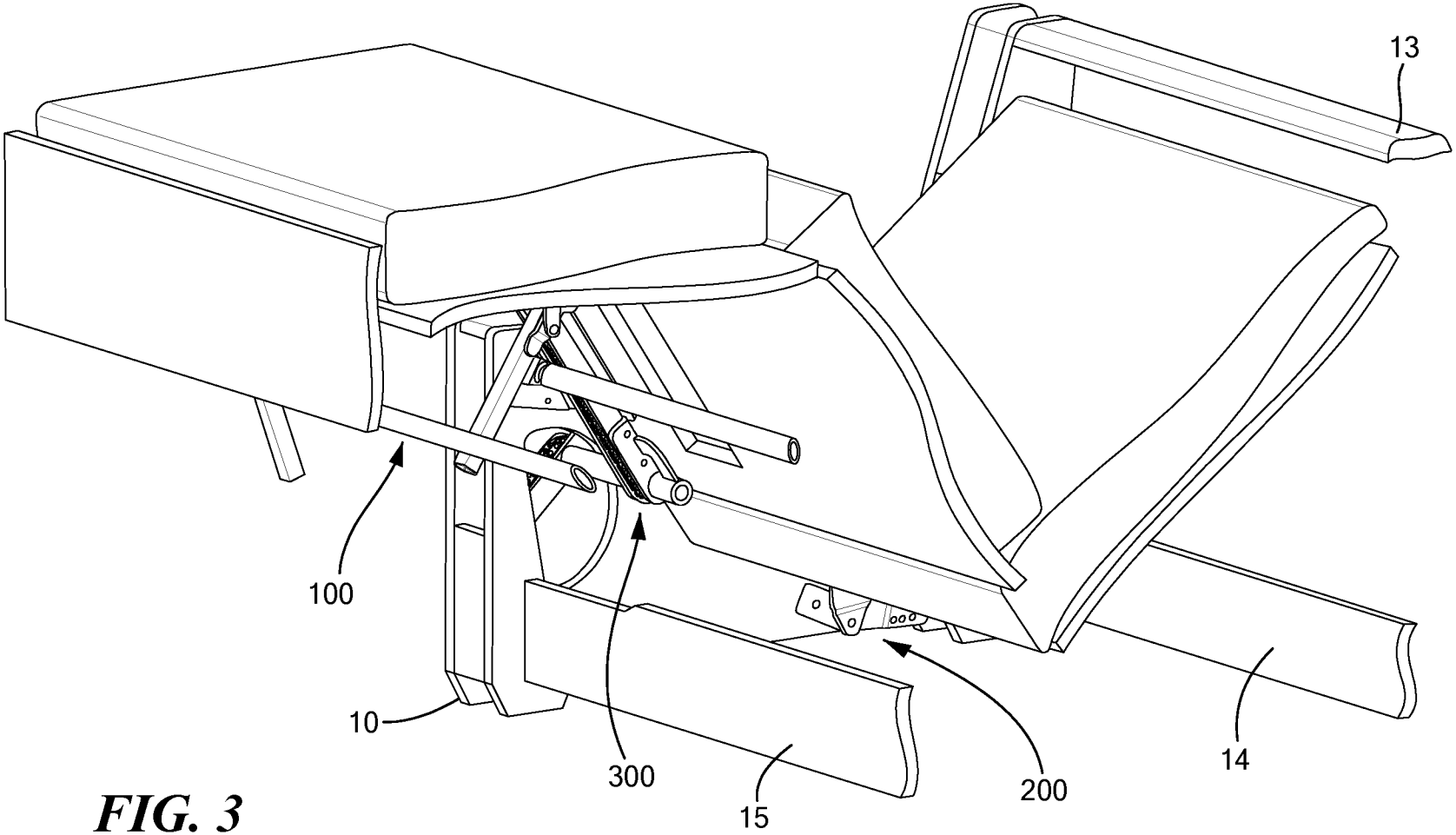
Figure 4:
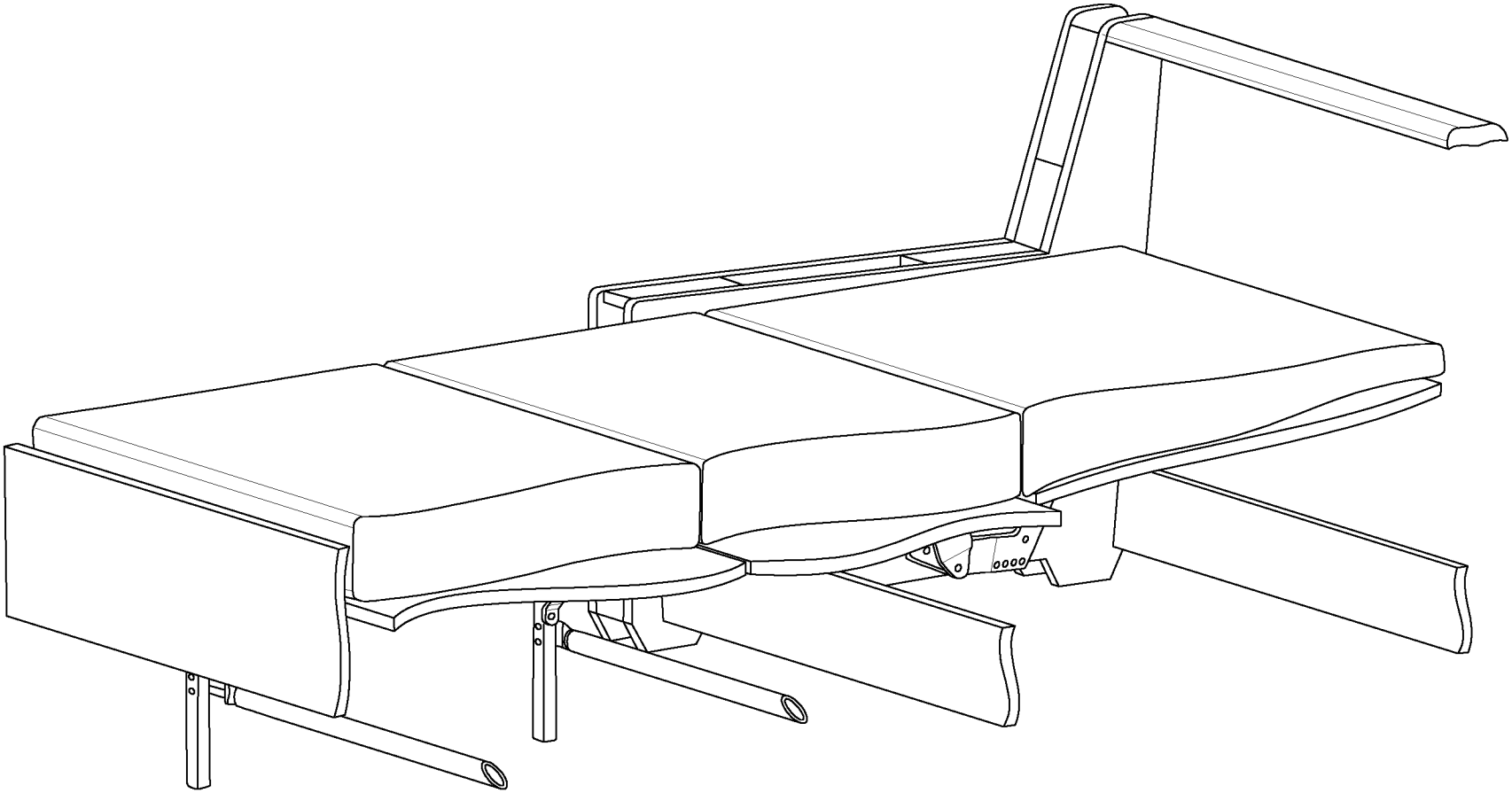
Figure 5:
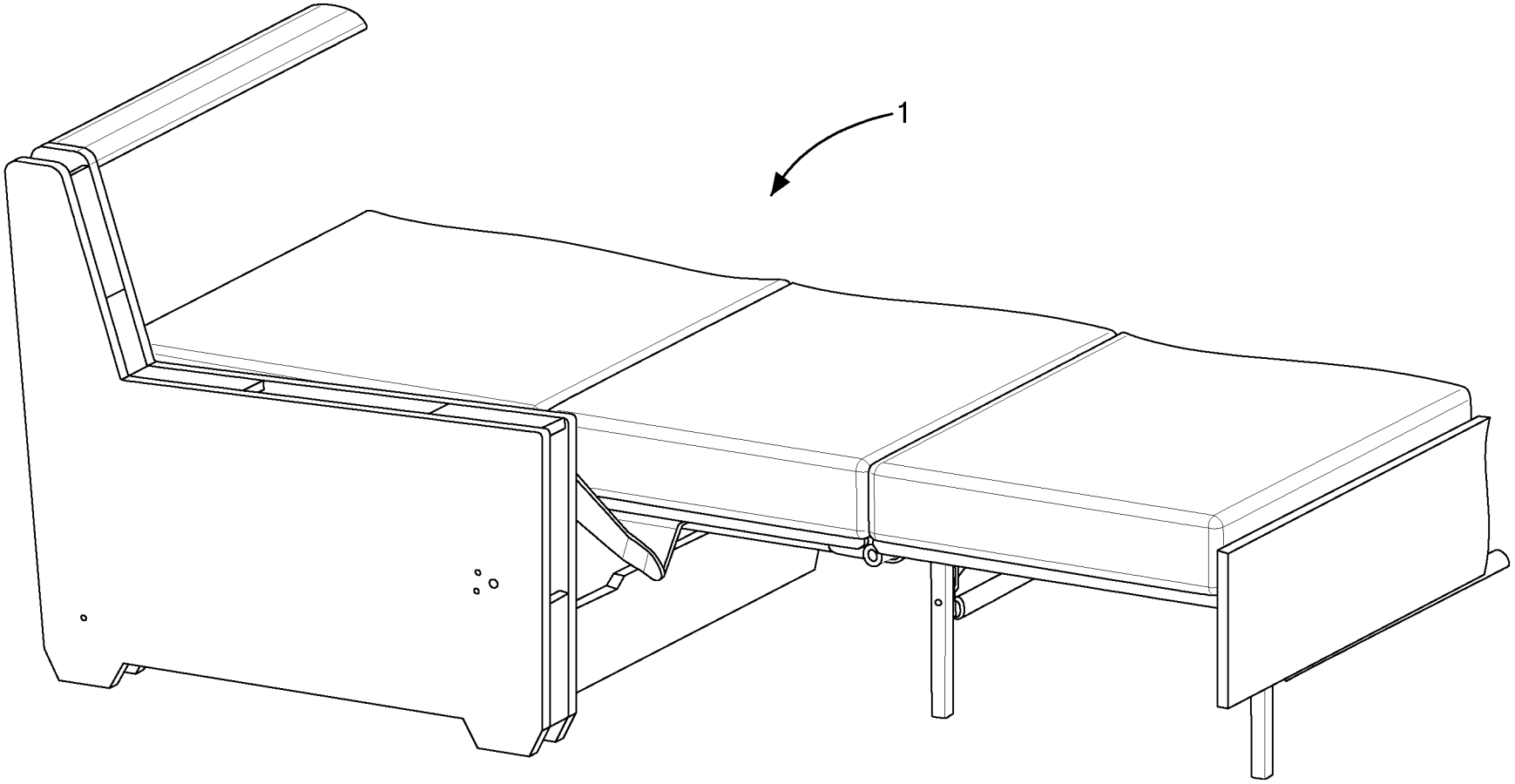

FIGS. 2-5 show various views of the sofa bed 1, with the back cushion 2 and the seat cushion 3 both removed, as the sofa bed 1 moves from sofa mode to bed mode. In the sofa position, the head bed cushion 4 and the head panel 7 are in a substantially vertical position behind the removable back cushion 2. Likewise, in sofa mode, the foot bed cushion 6 and the foot panel 9 are in a substantially horizontal position above and parallel to the mid bed cushion 5 and the mid panel 8. In sofa mode, the top of head bed cushion 4 faces forward, the top of mid bed cushion 5 faces downward, and the top of foot bed cushion 6 faces up. As can be seen in FIG. 3, as well as in FIGS. 7-9, 17 and 20, a portion of an opening control mechanism 300 (which is discussed in greater detail below) may be located inside—and may rotate within—the arm assembly 10.

Figure 6:
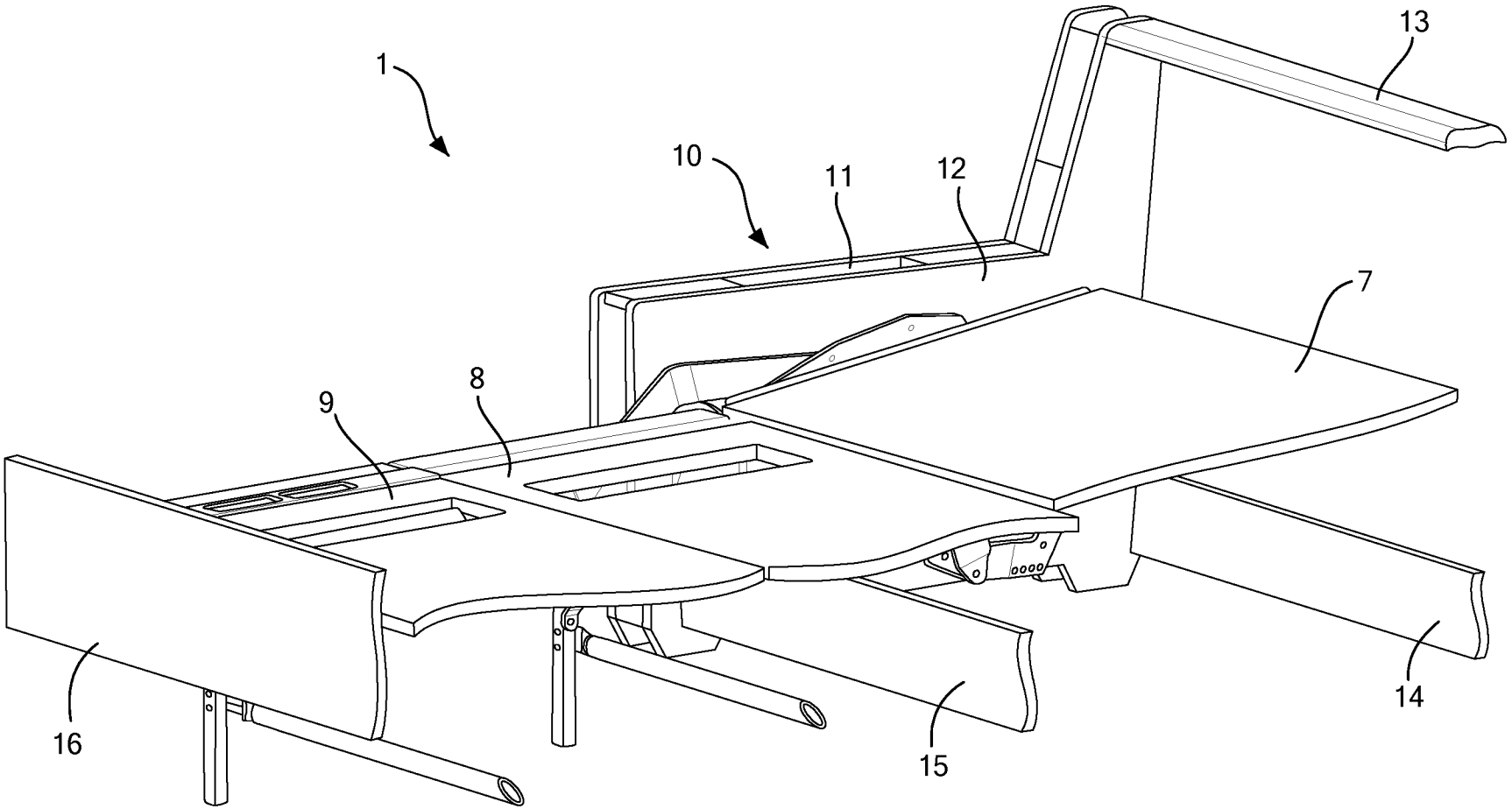
FIG. 6 shows an inside perspective view of the sofa bed of FIG. 1 in a fully open position without removable sofa seat and back cushions and without head, mid, and foot bed cushions.

FIG. 6 shows an inside perspective view of the sofa bed of FIG. 1 in a fully open bed position without the removable sofa seat cushion 3 and the back cushion 2 and without the head bed cushion 4, the mid bed cushion 5, and the foot bed cushion 6.

Figure 7:
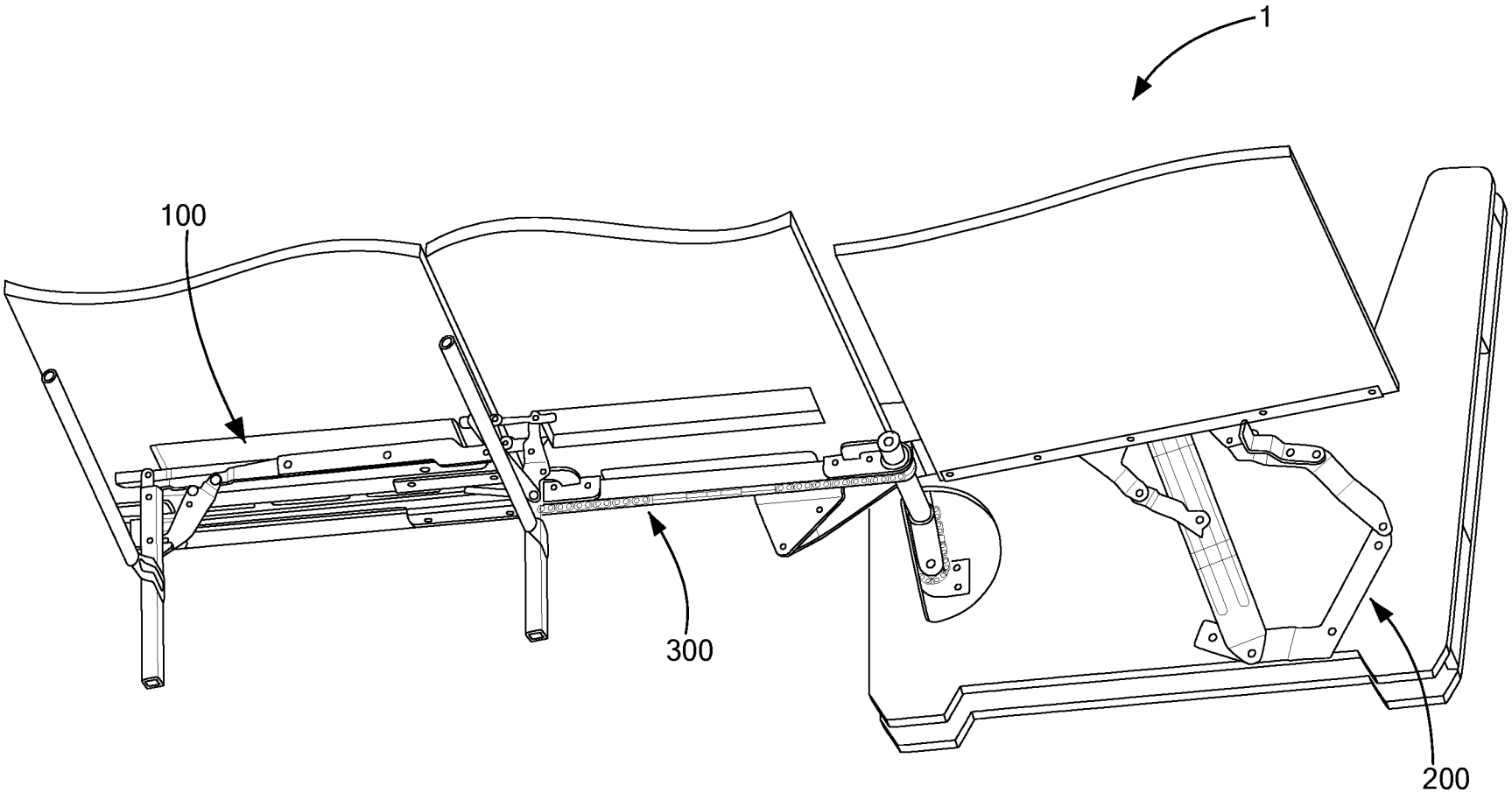
FIGS. 7-9 show inside perspective views of the sofa bed of FIG. 1 without sofa seat and back cushions and without head, mid, and foot bed cushions as it is folded from fully open bed mode to fully closed sofa mode.
Figure 8:
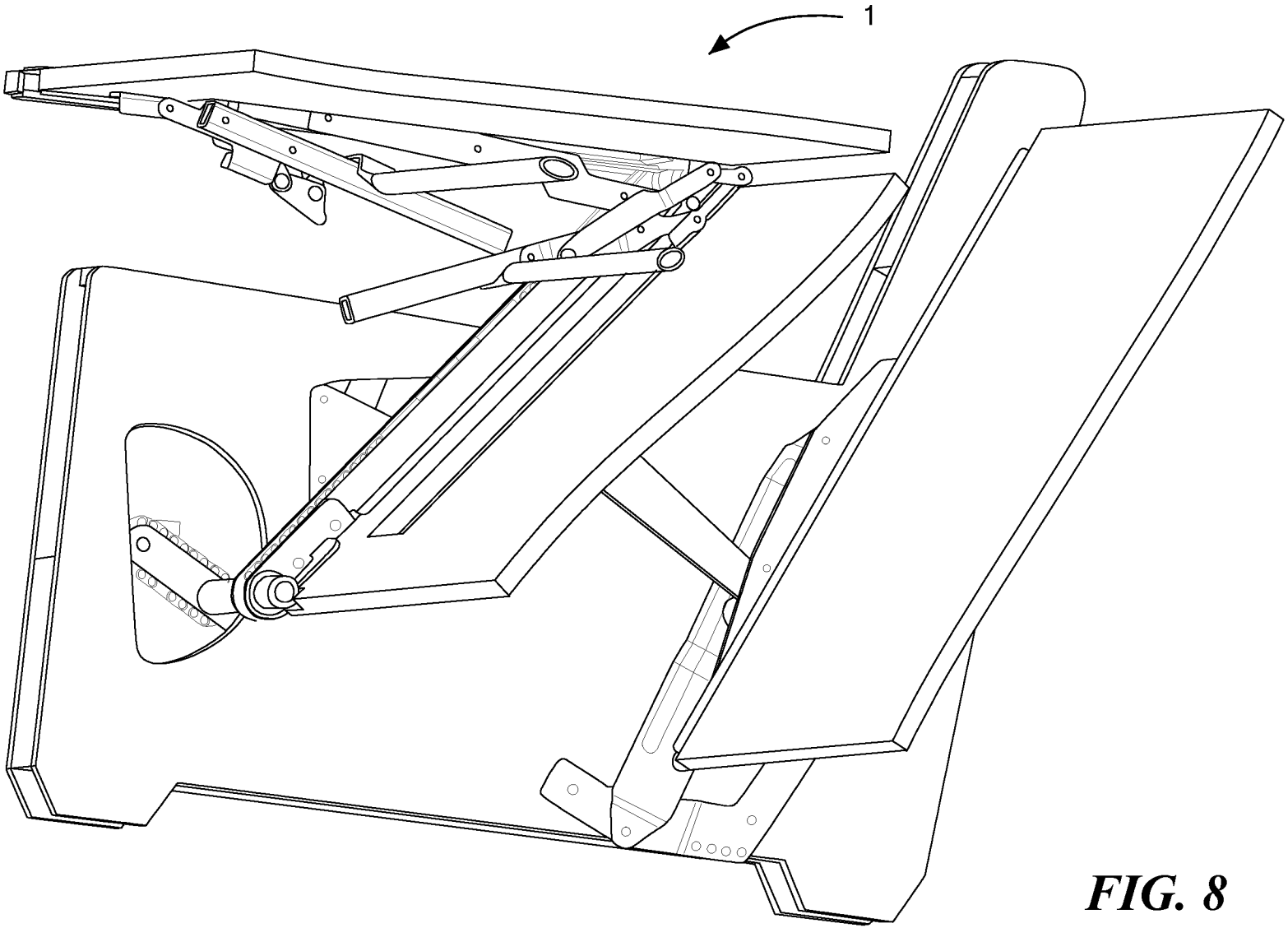
Figure 9:
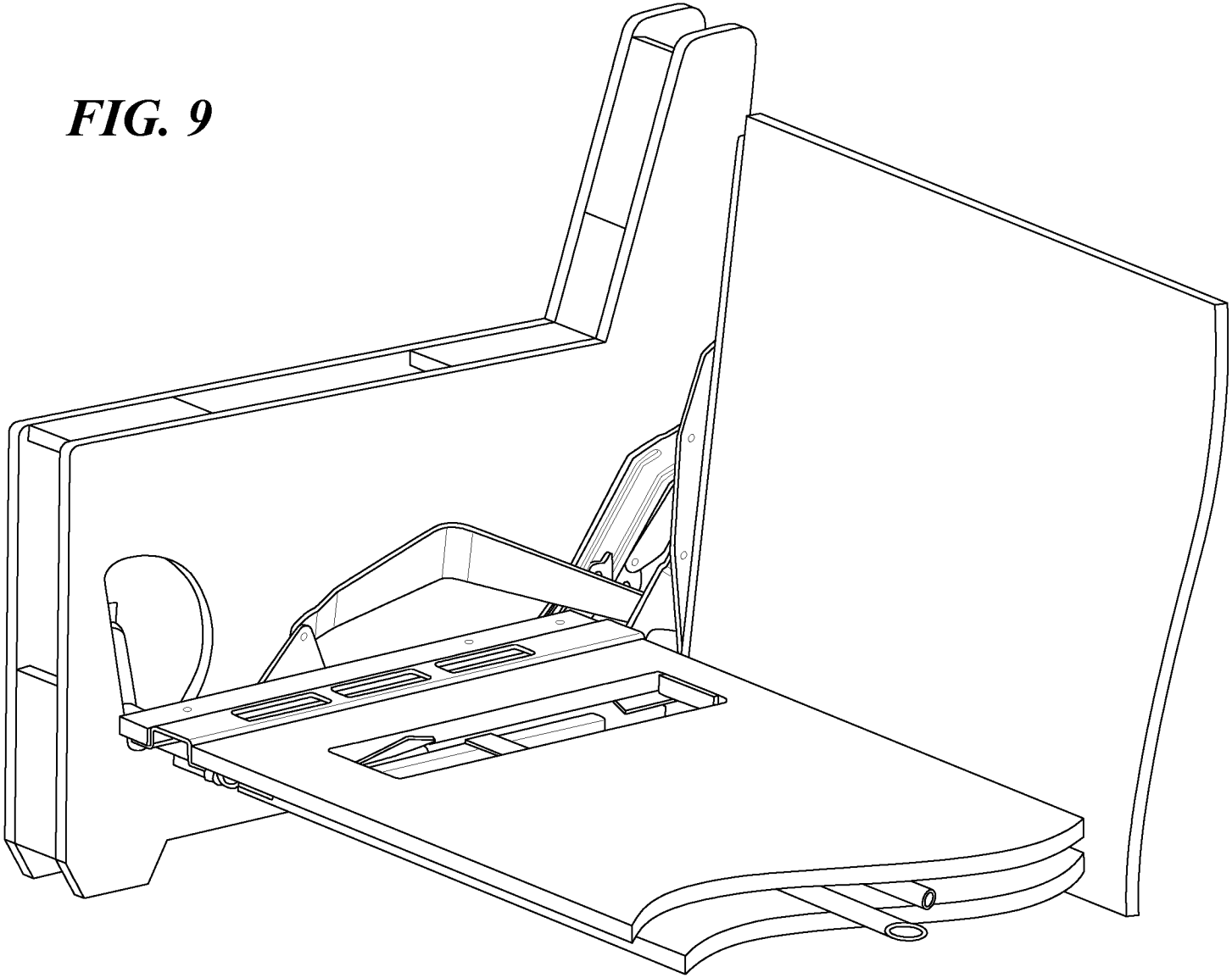

FIGS. 7-9 shows an inside perspective views of the sofa bed 1 (with the head, mid, and foot bed cushions 4, 5, 6 removed, and with the cross members 13, 14, 15, 16 removed), as it moves from bed to sofa mode. A leg assembly 100 is attached to and supports the mid panel 8 and the foot panel 9. The head panel mechanism assembly 200 is attached to and between the arm 10 and the head panel 7. An opening control mechanism 300 is attached to the foot panel 9, the mid panel 8, and to the arm 10.

Figure 10:
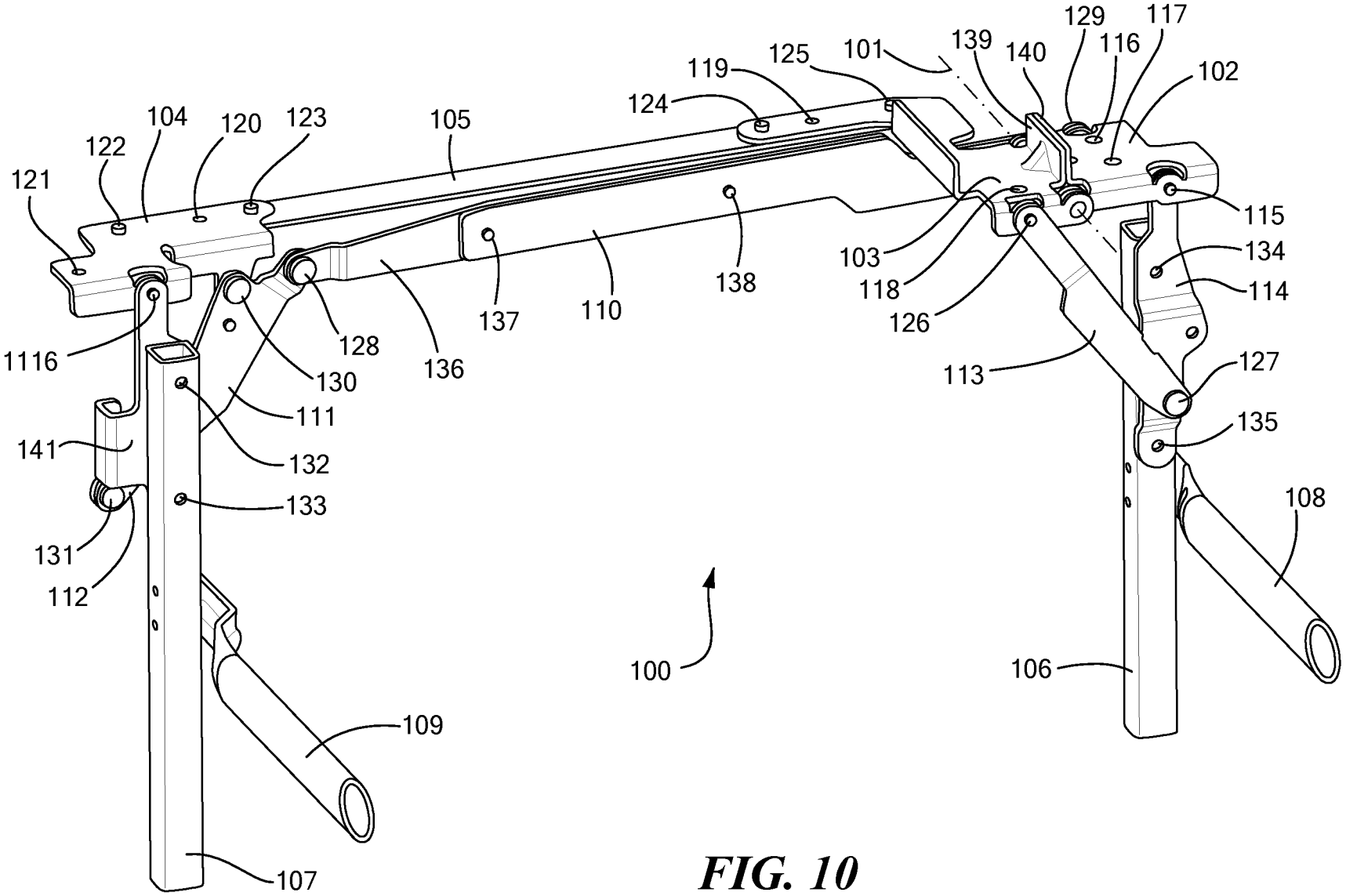
FIGS. 10-12 show the left side leg assembly of the sofa bed of FIG. 1.
Figure 11:
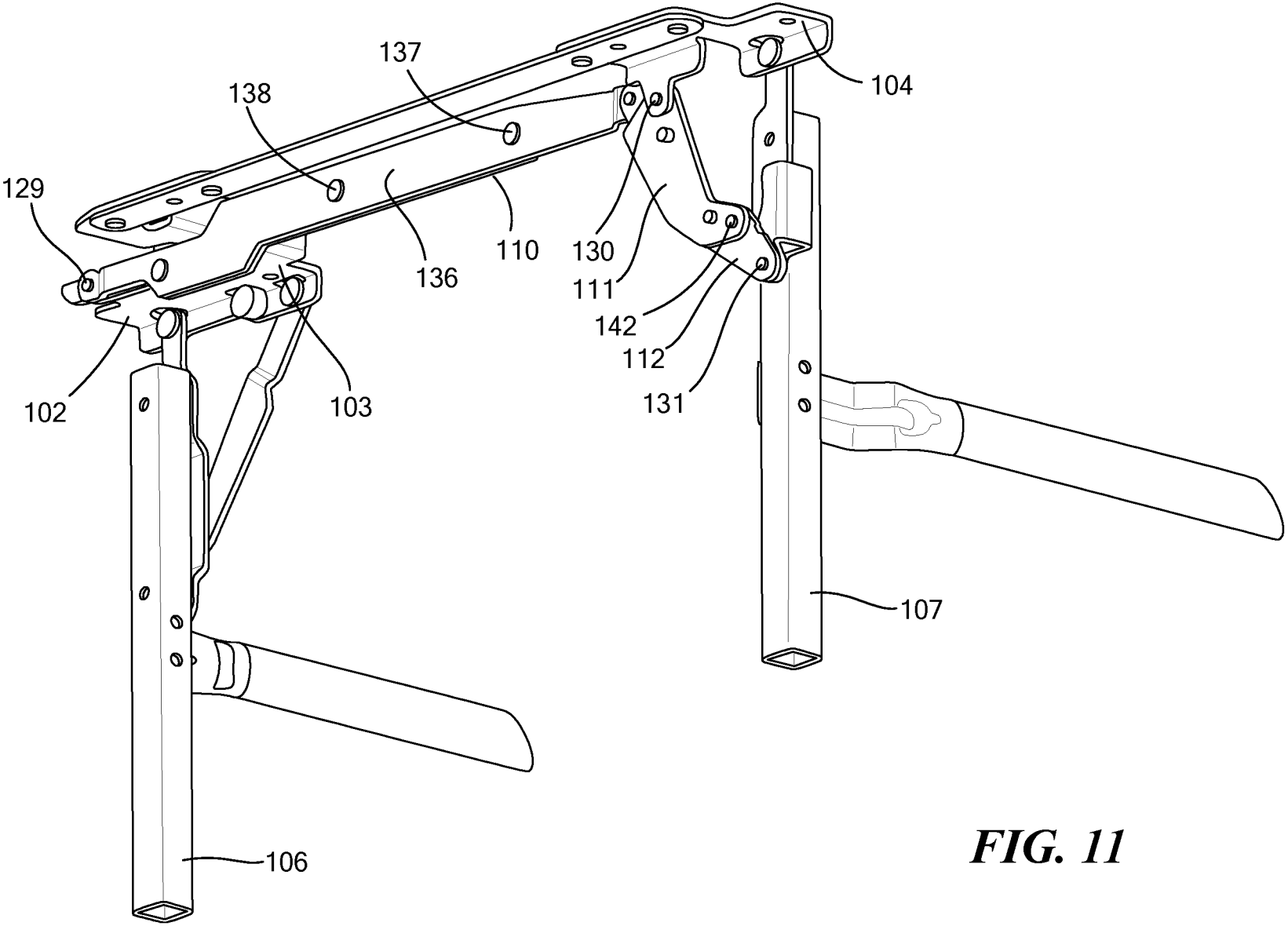
Figure 12:
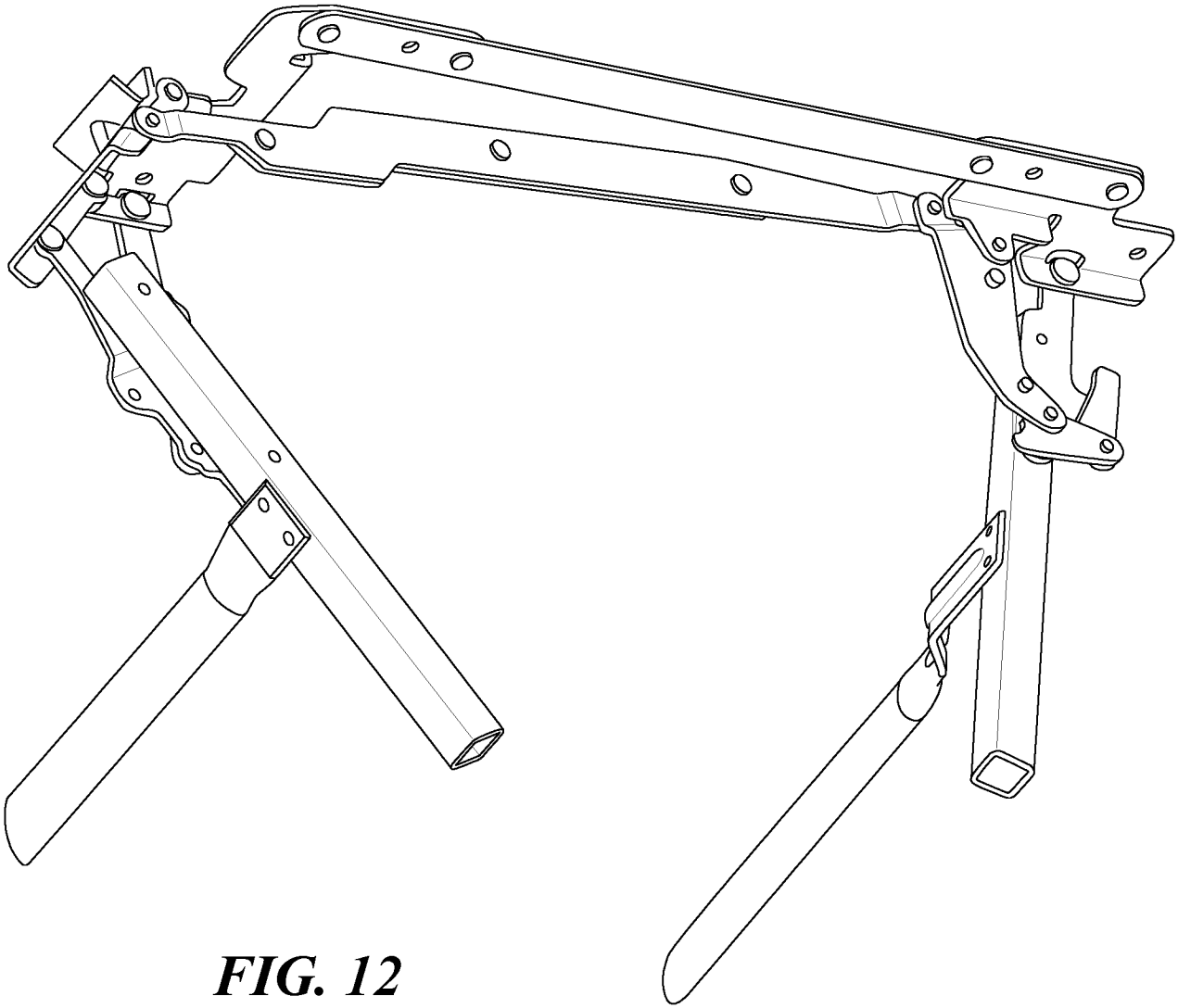

FIGS. 10-12 show perspective views of a right side leg assembly 100 that may be used in an embodiment of the invention. (Not shown is a mirror image left side leg assembly.) A mid panel pivot plate 102 with a stop flange 140 is bolted to the mid panel 8 at points 116, 117. A foot panel pivot plate 103 with a stop flange 139 is bolted to the foot panel 9 at points 118, 119. A foot panel plate 104 is bolted to the foot panel 9 at points 120, 121. A stretcher plate 105 is fixed to the foot panel plate 104 at points 122, 123 and to the foot panel pivot plate 103 at points 124, 125. The foot panel pivot plate 103 is pivotally attached to the mid panel pivot plate 102 at axis 101. A mid leg 106 is bolted to a mid leg plate 114 at points 134,135. The mid leg plate 114 is pivotally attached to the mid panel pivot plate 102 at point 115. A mid leg drive link 113 is pivotally attached to the foot panel pivot plate 103 at point 126 and to the mid leg plate 114 at point 127. The mid leg drive link causes the mid leg 106 to rotate from a substantially vertical position to a substantially horizontal position. In bed mode, the mid panel 8 and the foot panel 9 are substantially parallel and in the same plane as are the mid panel pivot plate 102 and the foot panel pivot plate 103 with the stop flanges 139, 140 substantially vertical and in contact.

During the folding of the sofa bed 1 from bed mode to sofa mode, the foot panel pivot plate 103 may remain substantially horizontal while the mid panel pivot plate 102 rotates approximately 180 degrees. A mid connector tube 108 is fixed to the mid leg 106 and connects the right side mid leg 106 to a similar leg on the left side of sofa bed 1. A foot leg plate 141 is pivotally attached to the foot panel pivot plate 104 at point 1116. The foot leg plate 141 is bolted to the foot leg 107 at points 132, 133. The foot leg plate 141 is pivotally attached to a drive link 112 at point 131. The drive link 112 is pivotally attached to a large drive link 111 at point 142, as shown in FIG. 11. The large drive link 111 is pivotally attached to the foot panel pivot plate 104 at point 130. A horizontal drive link 136 is fixed to a drive link doubler 110 at points 137, 138. One end of the horizontal drive link 136 is pivotally attached to the foot panel pivot plate 104 at point 128 and the opposite end of the horizontal drive link 136 is pivotally attached to mid panel pivot plate 102 at point 129.

During the transition from bed mode to sofa mode, the rotation of mid panel pivot plate 102 relative to foot panel pivot plate 103 and about axis 101 causes rotation of large drive link 111 about point 130 which in turn causes foot leg 107 to rotate about point 116 toward a folded and horizontal position. Likewise, during movement from bed to sofa position, the rotation of mid panel pivot plate 102 about axis 101 and relative to foot panel pivot plate 103 causes mid leg 106 to rotate about point 115 to a folded and horizontal position. The alignment of points 130, 142, and 131 in bed mode are arranged such that point 142 is over-center of a line between points 130 and 131 such that foot leg 107 cannot be closed to a folded position without first elevating foot panel 9 and rotating foot panel 9 relative to mid panel 8.

Figure 13:
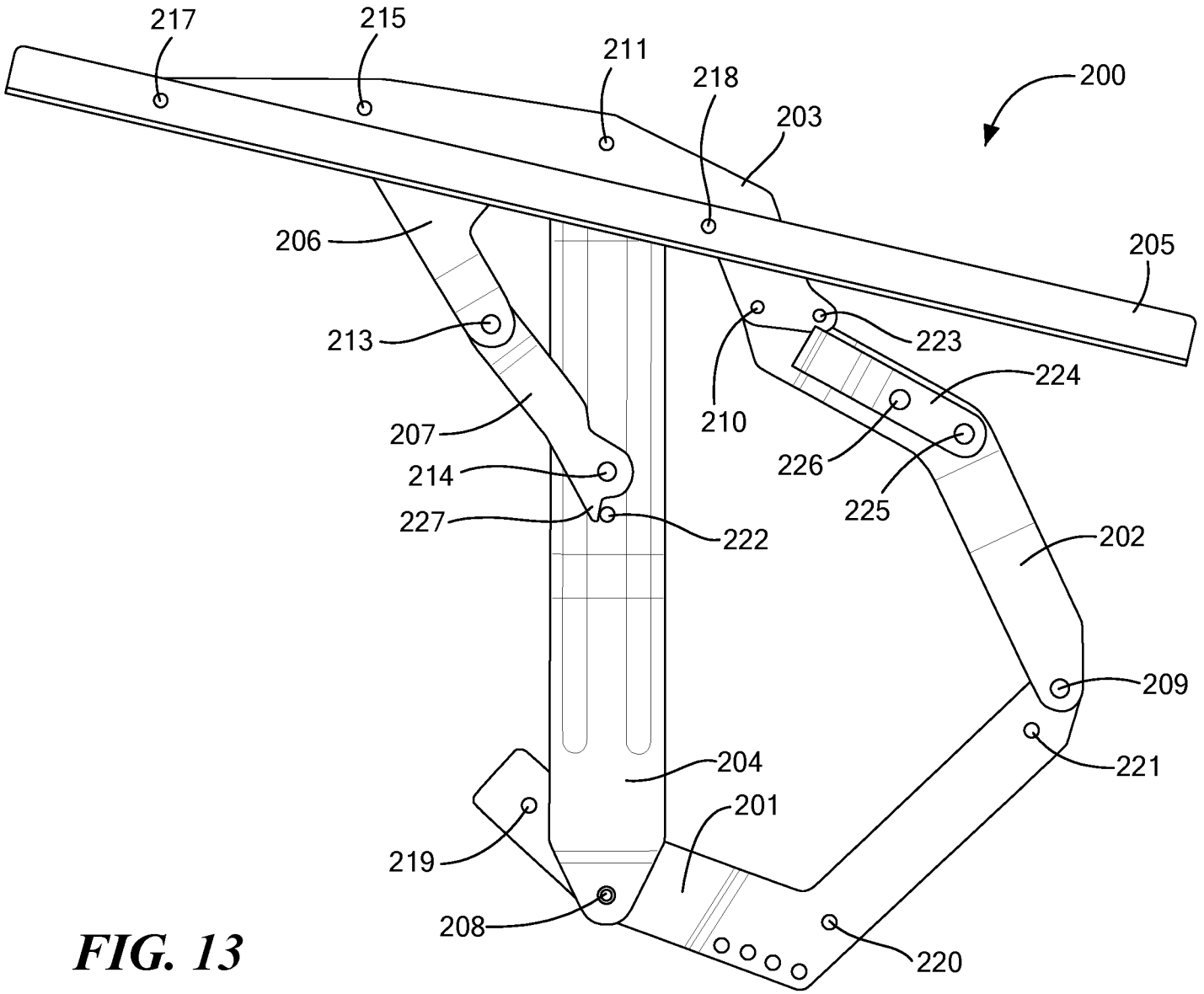
FIGS. 13-16 show the head panel mechanism of the sofa bed in FIG. 1.
Figure 14:
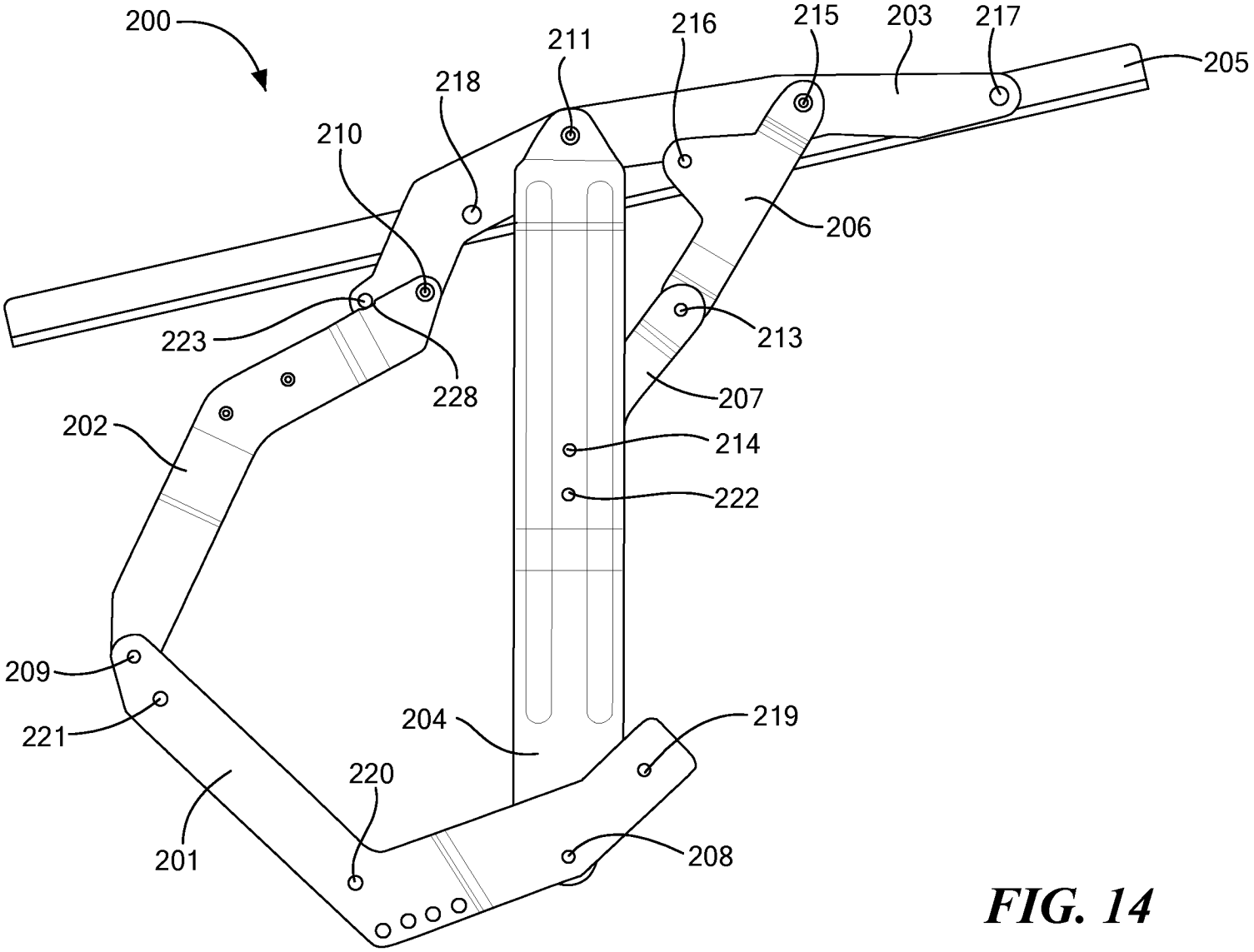
Figure 15:
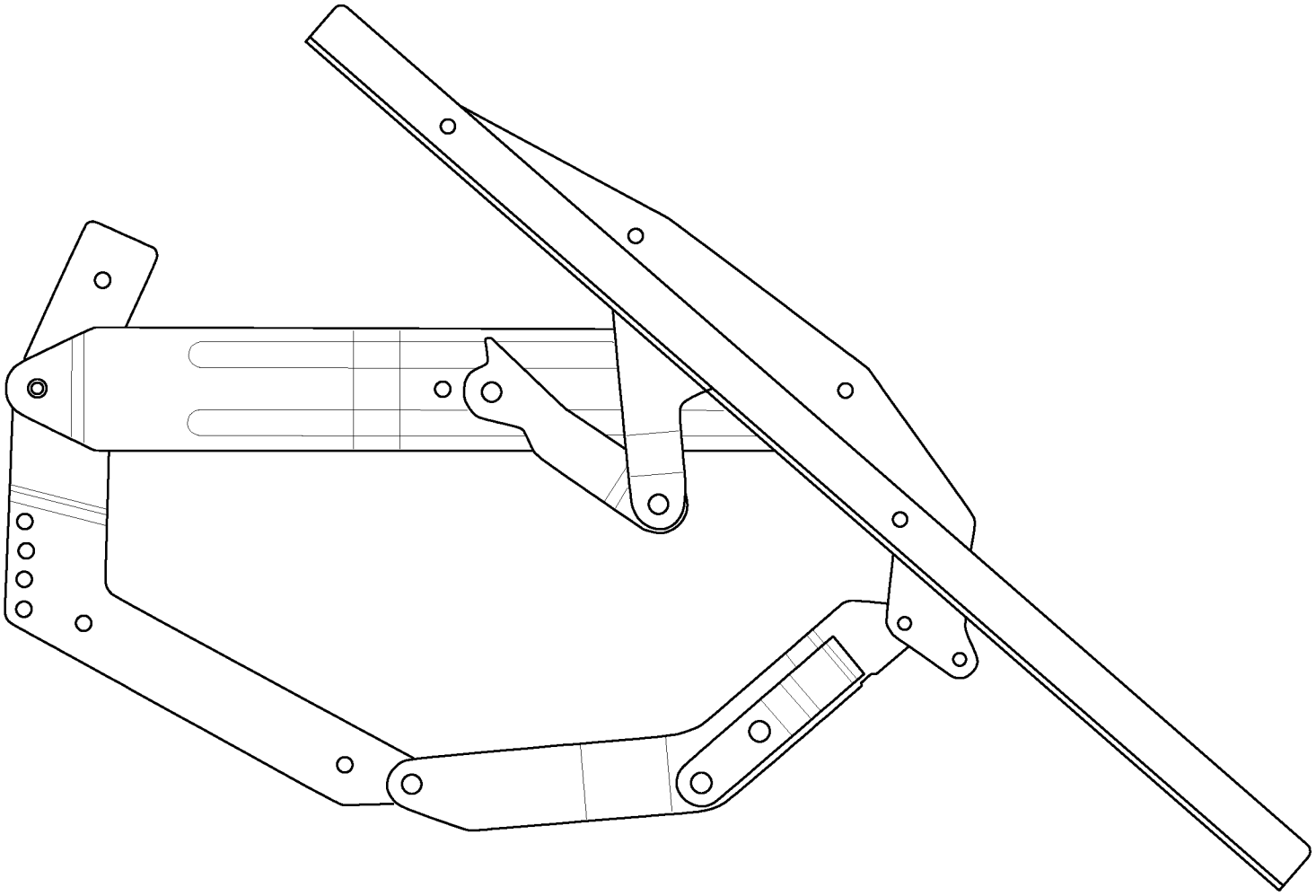
Figure 16:
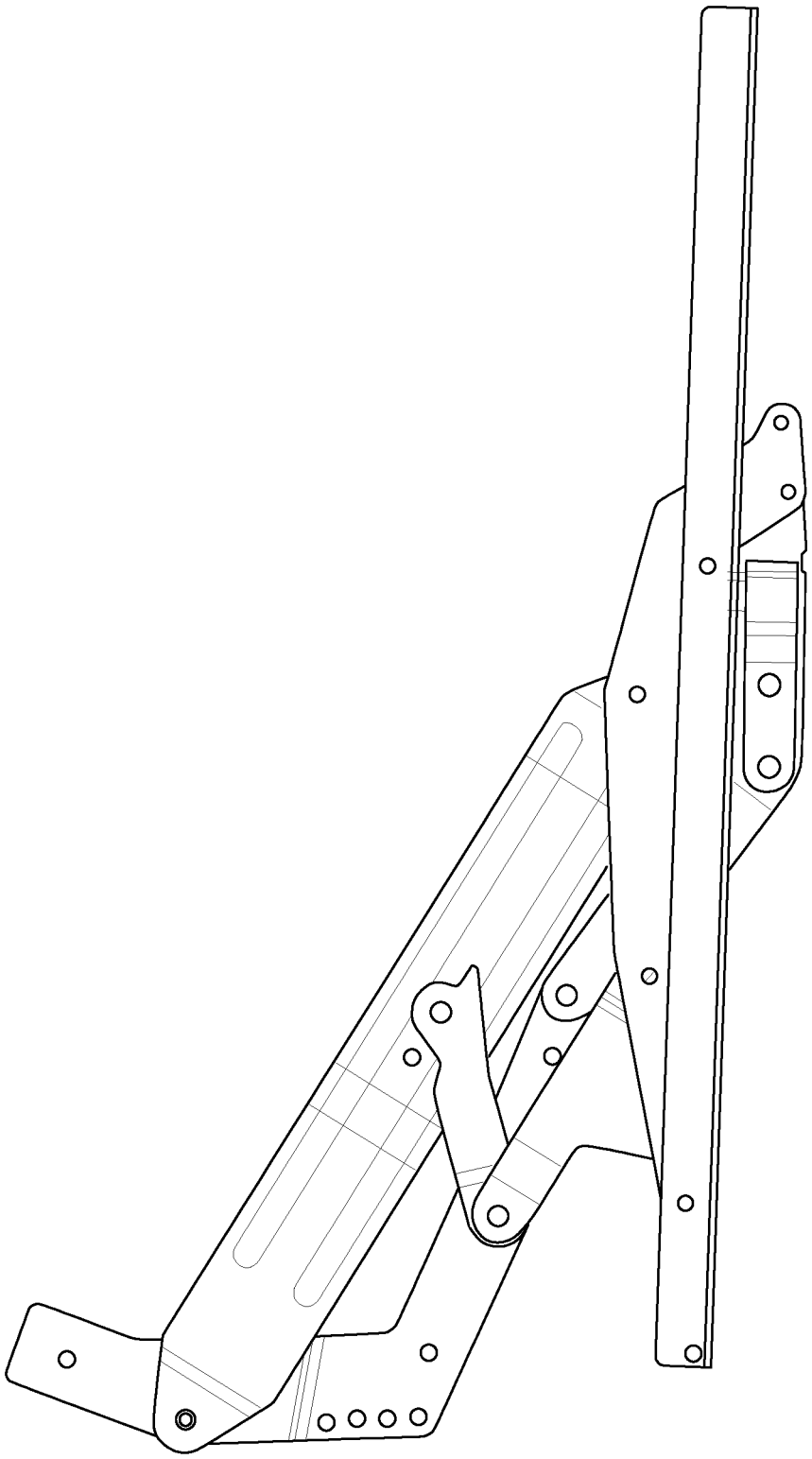

FIGS. 13-16 show views of a head panel mechanism assembly 200 that may be used in an embodiment of the invention. FIGS. 13 and 14 show opposite sides of the head panel mechanism assembly when the sofa bed is in the bed position. FIGS. 15 and 16 show the head panel mechanism assembly in different positions as the sofa bed moves from bed position to sofa position. A head panel support 205 is attached to the head panel 7 at points 229, 230, 231, 232, and 233. A top support 203 is fixed to the head panel support 205 at points 217 and 218. A lower support 201 is attached to the inner arm panel 12 at holes 219, 220, and 221. A rear pivot member 202 is pivotally attached to the lower support 201 at point 209 and to the top support 203 at point 210. A main pivot member 204 is pivotally attached to the lower support 201 at point 208 and to the top support 203 at point 211.

A stop pin 223 in the top support 203 contacts a stop surface 228 in the rear pivot member 202 to prevent further forward rotation of the main pivot member 204 when the sofa bed 1 is in the bed position. An upper lock member 206 is pivotally attached to the top support 203 at point 215 and to a lower lock member 207 at point 213. The lower lock member 207 is pivotally attached to the main pivot member 204 at point 214. Point 213 is over-center of a line between points 214 and 215 such that, when the sofa bed 1 is in the bed position, a stop surface 227 of the lower lock member 207 is in contact with a stop pin 222 in the main pivot member 204 so as to prevent further rotation of the lower lock member 207 and likewise prevent downward movement of the portion of the head panel 7 adjacent the mid panel 8 and ensuring the stability of the head panel 7 in the bed position. Likewise, in the bed position, the stop pin 223 in top support 203 will contact the stop surface 228 in the rear pivot member 202 to prevent the downward movement of the portion of the head panel 7 above the lower support 201.

Figure 17:
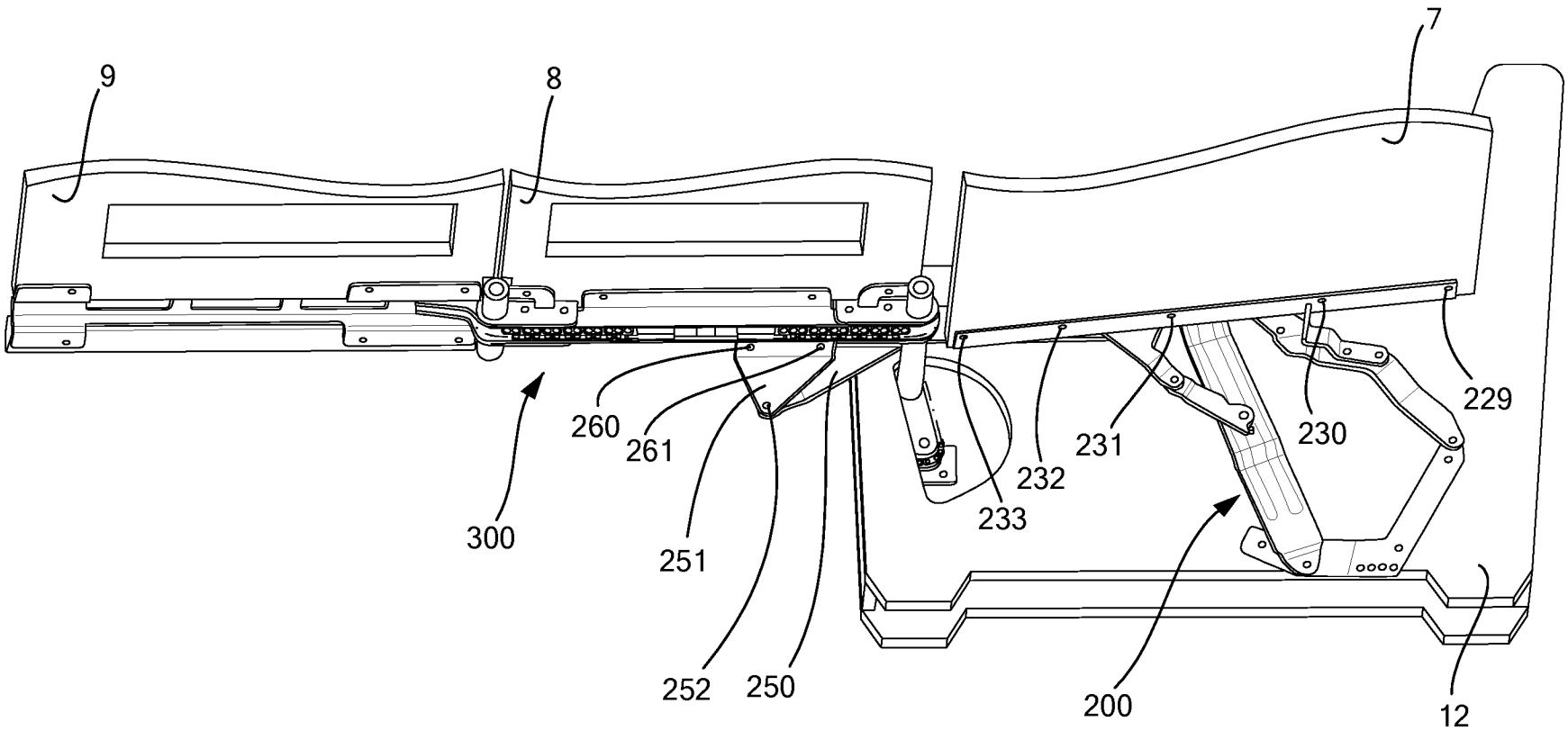
FIG. 17 shows an inside perspective view of the underside of the sofa bed in FIG. 1 with the leg assembly removed, but showing the opening control mechanism and the head panel mechanism.

FIG. 17 shows an underside perspective view of the arm 10, the head panel 7, the mid panel 8, the foot panel 9, the head panel mechanism assembly 200, and the opening control mechanism 300 of the sofa bed 1 in the bed position. A connecting link 250 connects the mid panel 8 and the opening control mechanism to the head panel 7 and the head panel mechanism assembly 200 such that the rotation of the mid panel 8 causes a rotation of the head panel 7. The connecting link 250 is pivotally connected to a mid panel drive flange 251 at point 252. The mid panel drive flange 251 is fixed to the mid panel 8 at points 260, 261. The opposite end of the connecting link 250 is pivotally connected to point 216 in the upper lock member 206. (See FIG. 14.)

Figure 18:
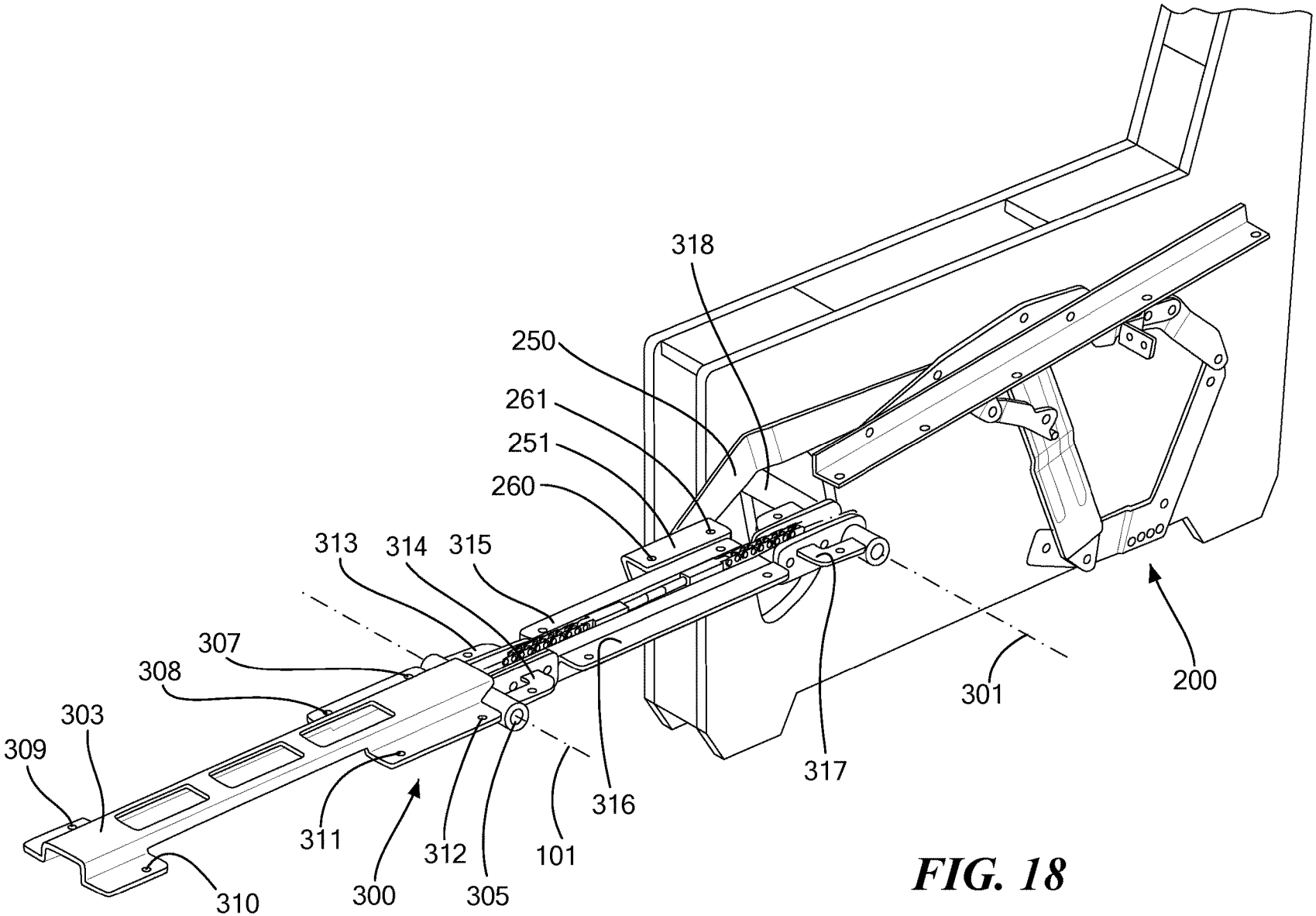
FIG. 18 shows an inside perspective view of the sofa bed of FIG. 1 in the fully open bed position with the leg assembly removed and all sofa cushions, bed cushions, and support panels removed.
Figure 19:
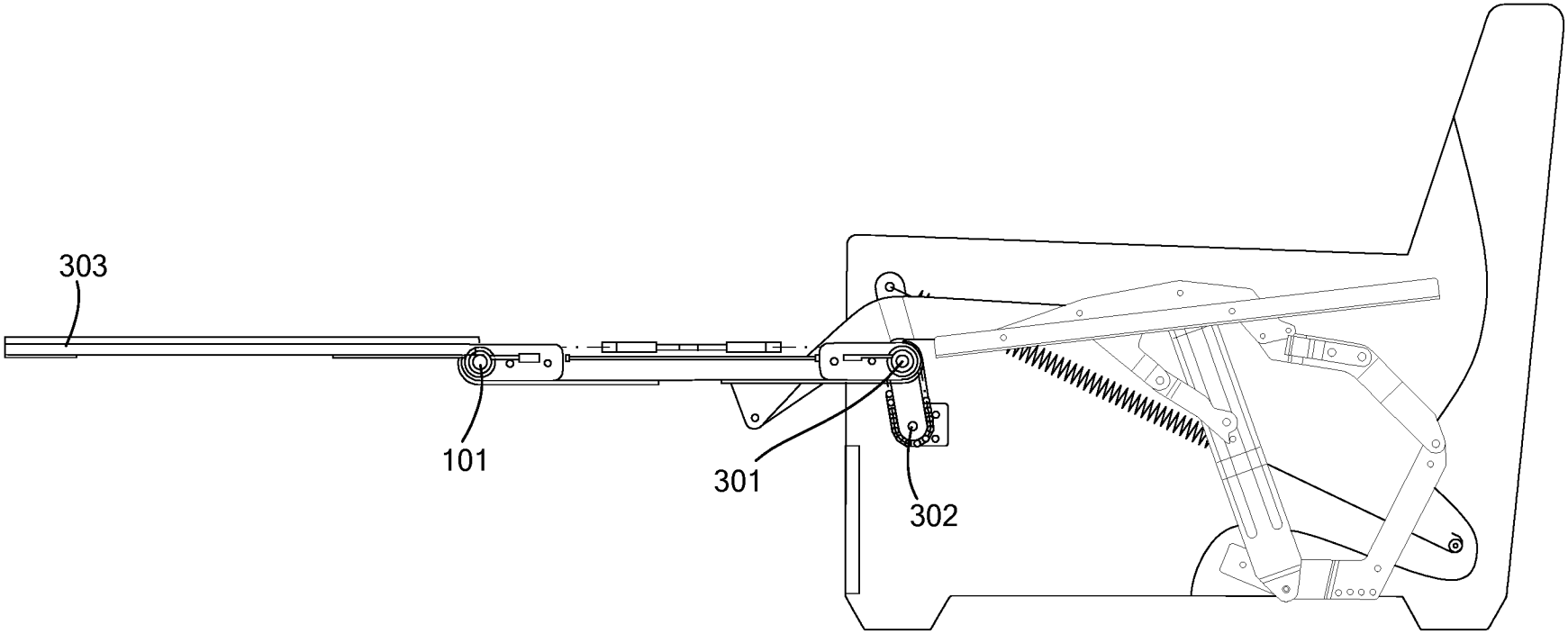
FIG. 19 shows a side view of the sofa bed of FIG. 1 in bed mode with the leg assembly removed and all cushions, bed cushions, and support panels removed, with an inner arm panel cut away.
Figure 20:
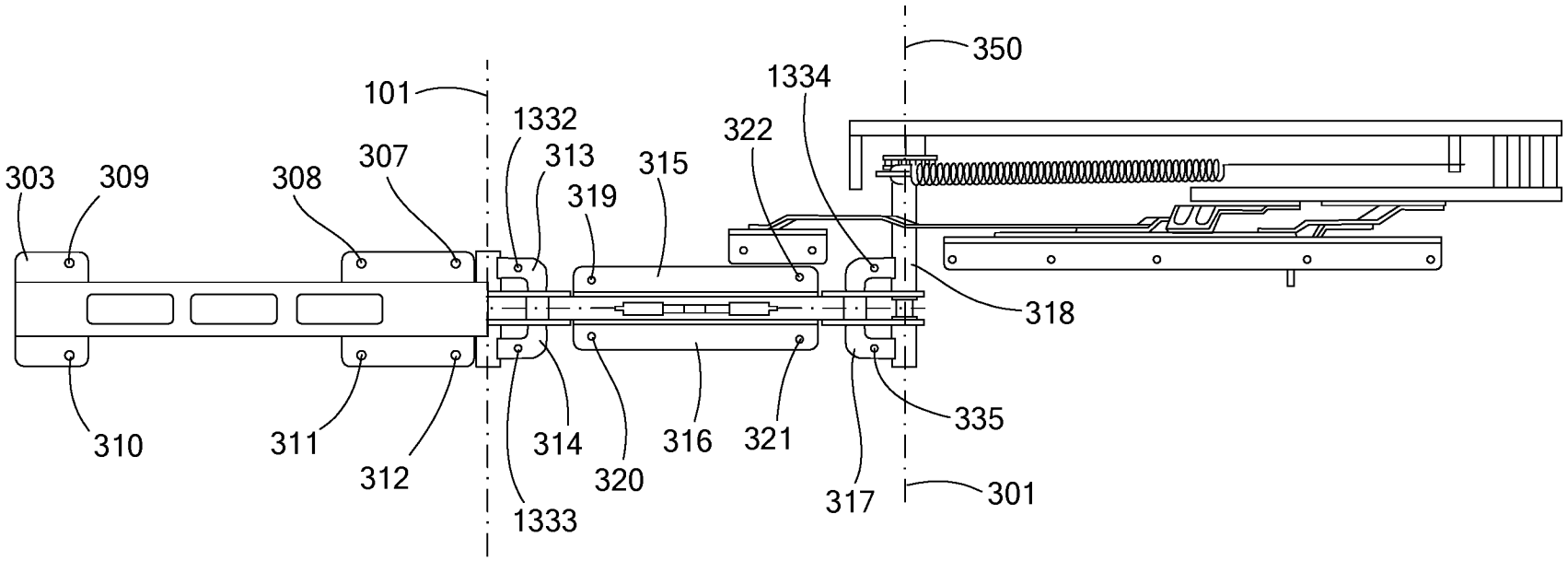
FIG. 20 shows a top view of the sofa bed of FIG. 1 in bed mode with the leg assembly removed and all cushions, bed cushions, and support panels removed, with an inner arm panel cut away.
Figure 21:
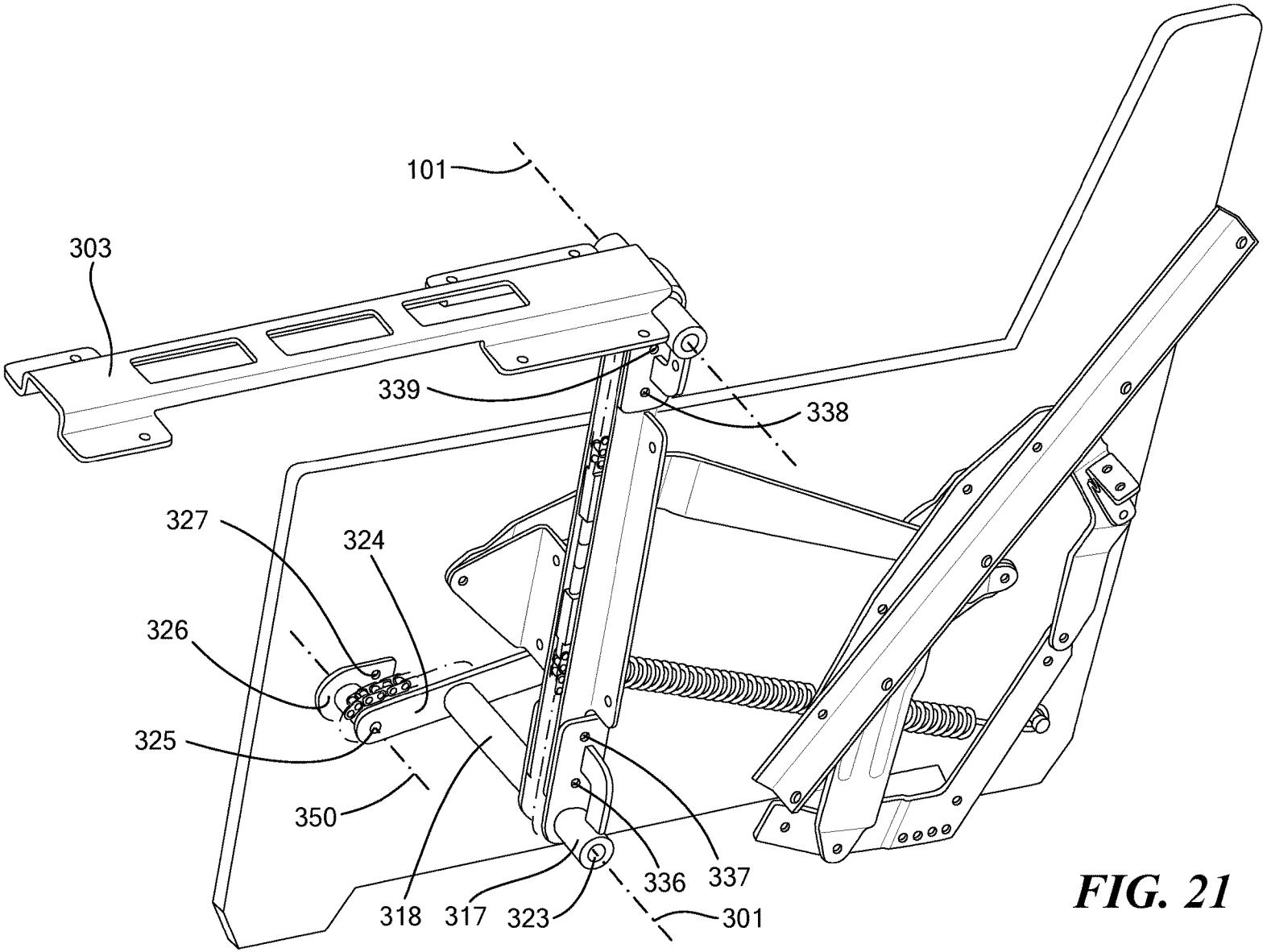
FIGS. 21-22 show views of the sofa bed of FIG. 1 with the leg assembly removed and all cushions, bed cushions, and support panels removed, with an inner arm panel removed.
Figure 22:
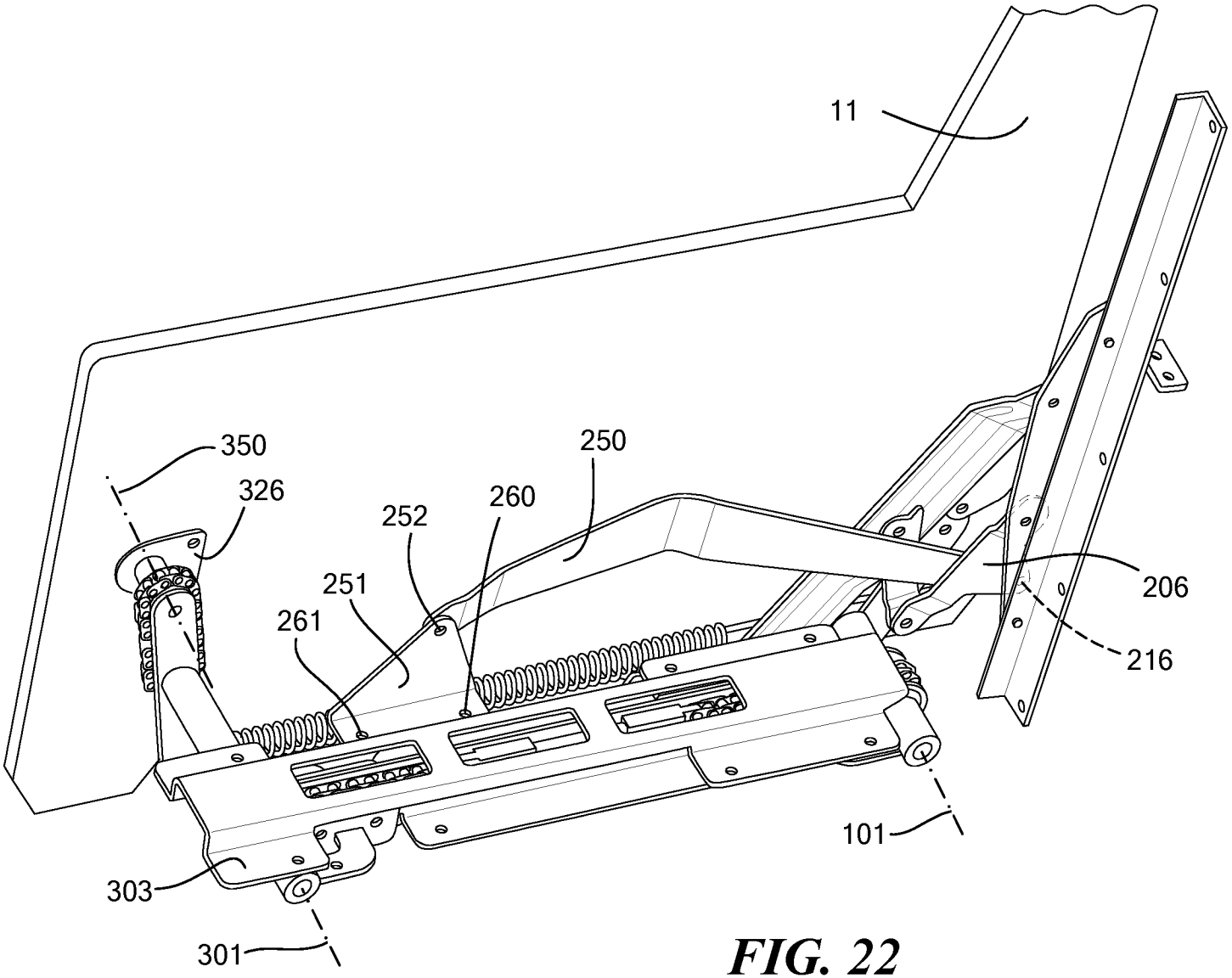
Figure 23:
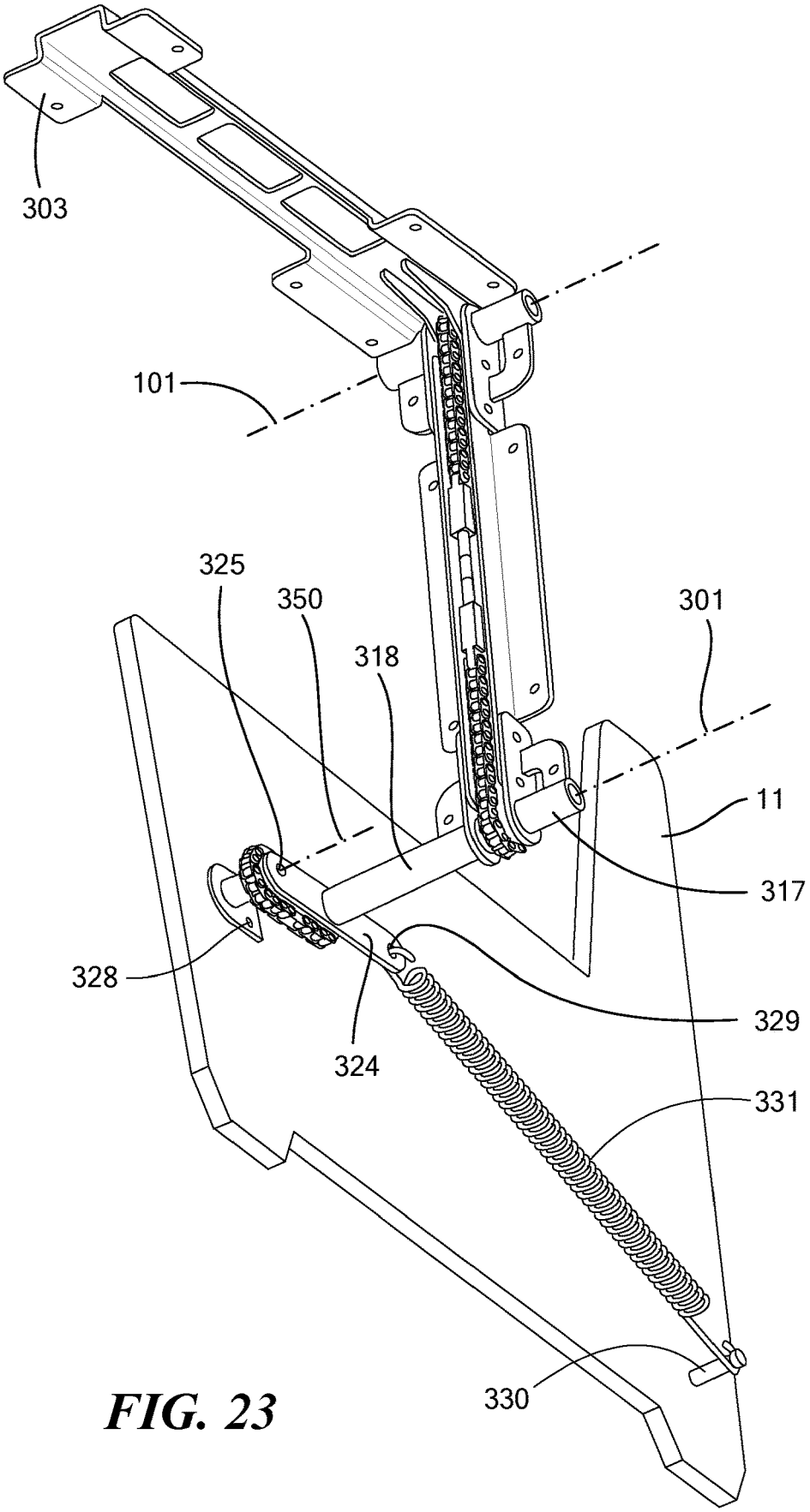
FIGS. 23-24 show perspective views of the sofa bed of FIG. 1 in a partially open position and showing only the opening control mechanism mounted to an arm panel.
Figure 25:
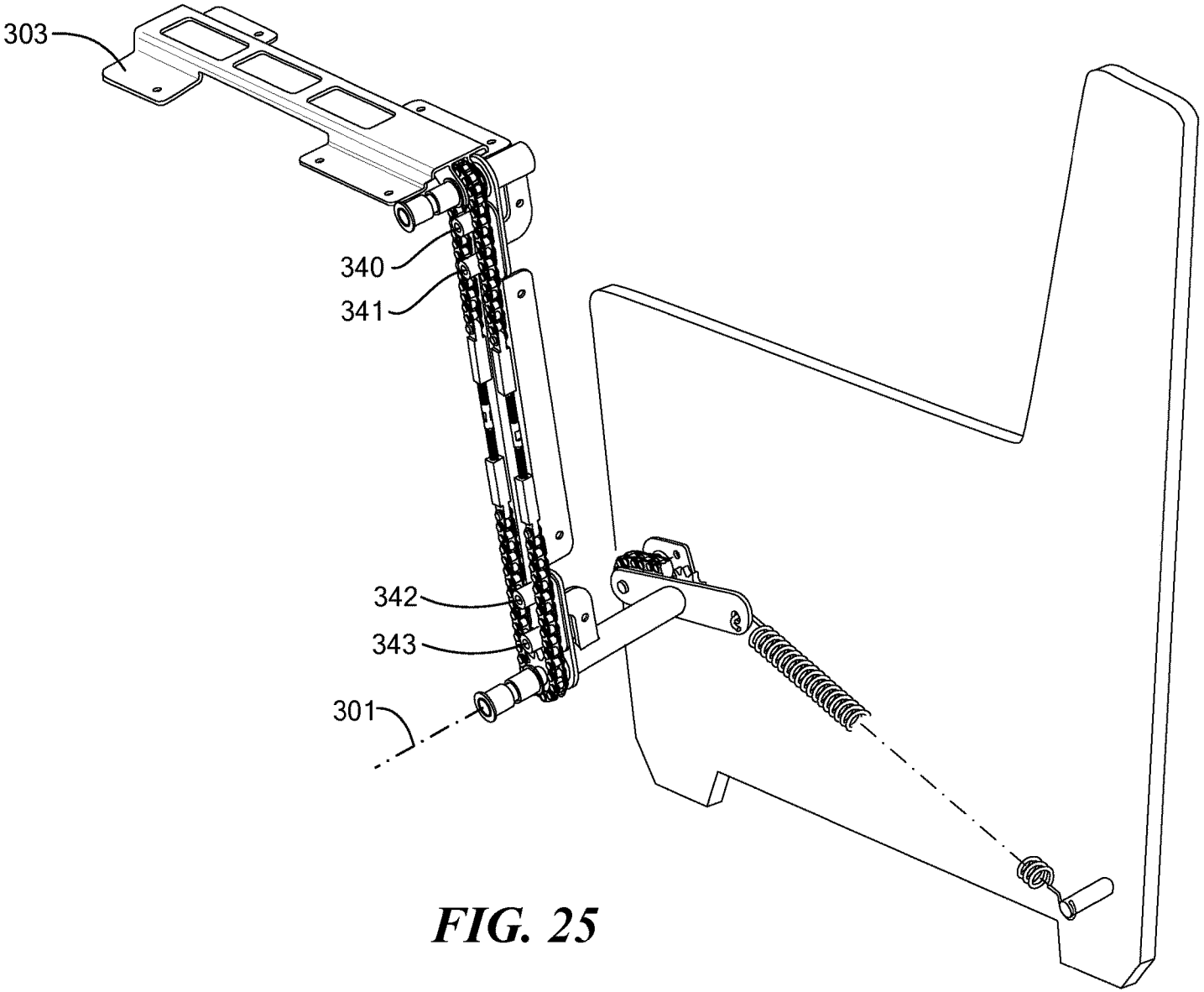
FIG. 25 shows a perspective view of the sofa bed of FIG. 1 with the leg assembly removed and all cushions, bed cushions, and support panels removed, with an inner arm panel removed, and with portions of the opening control mechanism removed.
Figure 26:
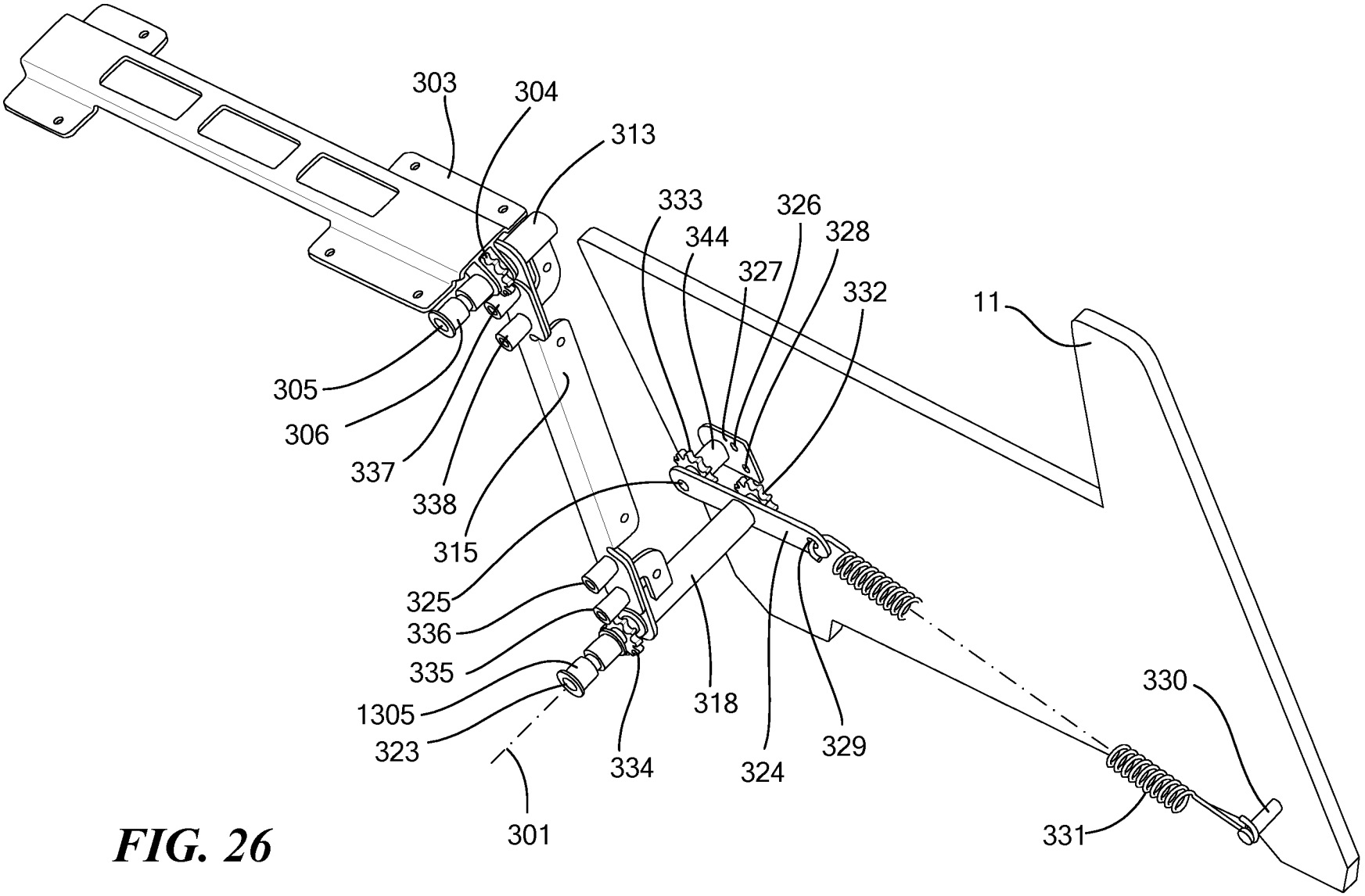
FIG. 26 shows a perspective view of the sofa bed of FIG. 1 with the leg assembly removed and all cushions, bed cushions, and support panels removed, with an inner arm panel removed, and with further portions of the opening control mechanism removed.
Figure 27:
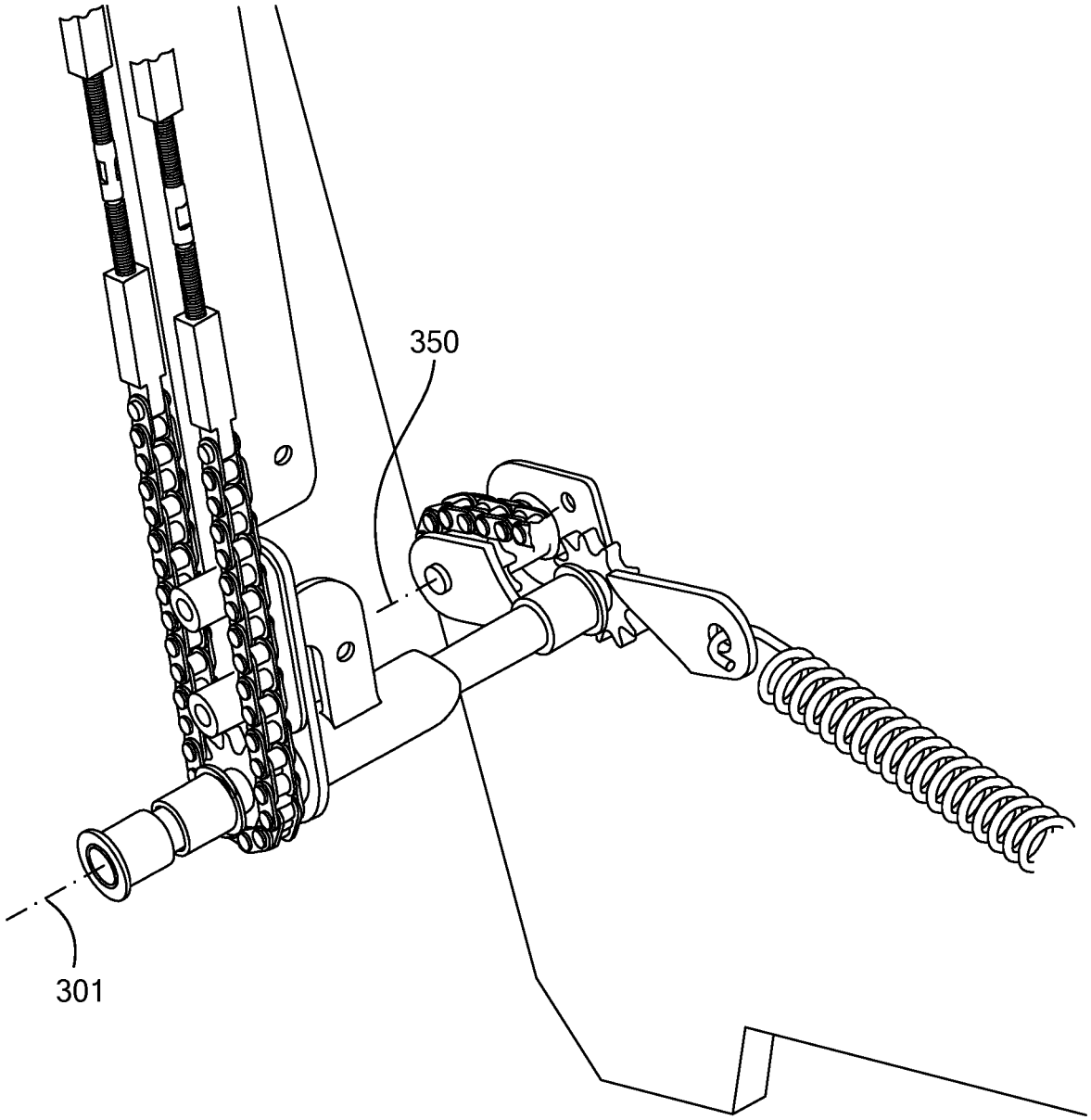
FIGS. 27-28 show enlarged perspective views of the opening control mechanism removed of the sofa bed of FIG. 1 with certain portions of the opening control mechanism removed and cut away.
Figure 28:
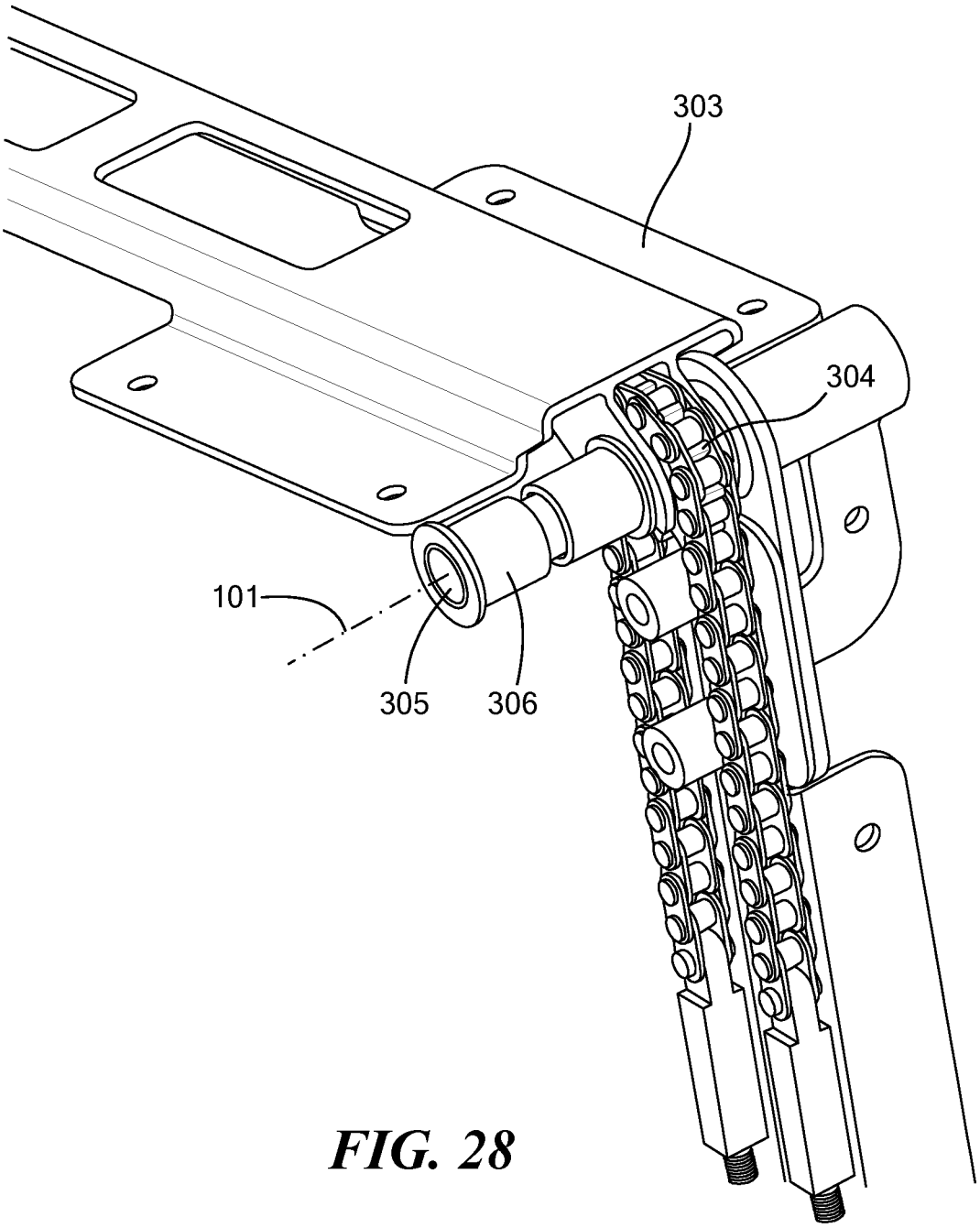

FIGS. 18-22 show the head panel mechanism assembly 200, the opening control mechanism 300, and the arm 10 of the sofa bed 1 in various positions from the bed position in FIG. 18 to the sofa position in FIG. 22. (FIGS. 18, 21 and 22 show perspective views, while FIG. 19 shows a lateral view and FIG. 20 shows a top view.) FIGS. 23-28 show the opening control mechanism 300 and the outer arm panel 11. FIGS. 18 and 20 show a foot panel mount 303 attached to the foot panel at points 307, 308, 309, 310, 311, and 312. The end of the foot panel mount 303 rotates about axis 101 and includes a shaft 305 along such axis 101 and a sprocket 304 fixed to the shaft 305 at the mid-point of the shaft 305 (as shown in FIG. 26), such that the shaft 305 and the sprocket 304 are both coaxial to axis 101 and fixed to the foot panel mount 303. Sleeve members 313 and 314 are fixed to the mid panel 8 at points 1332 and 1333 and are co-axial with axis 101 and the shaft 305.

Sleeve members 317 and 318 are fixed to the mid panel 8 at points 335 and 1334 and are co-axial with axis 301 and a shaft 323. Sleeve spacer flanges 315 and 316 are fixed to mid panel 8 at holes 319, 322 and 320, 321. The sleeve flanges 315 and 316 are also fixed to the sleeve members 313 and 314 at points 338 and 339. The sleeve members 317 and 318 are fixed to an opposite end of the sleeve spacer flanges 315 and 316 at points 336 and 337. Bushings 340, 341, 342, and 343 (as shown in FIG. 25) are located at points 339, 338, 337, and 336 respectively. The sleeve members are fixed to the sleeve spacer flanges and to the bushings at points 339, 338, 337, and 336.

The shaft 323 is coaxial with axis 301 and extends through the sleeve member 317 and the sleeve member 318, and has a sprocket 334 fixed to it coaxial to the shaft 323 between sleeve members 317 and 318. The shaft 323 has a sprocket 332 fixed to and coaxial with the shaft 323 at an opposite end adjacent the outer arm 11. The shaft 305 has bushings 306 concentrically mounted to allow free rotation of sleeve members 313 and 314 about shaft 305. Likewise, shaft 323 has bushings 1305 concentrically mounted to allow free rotation of sleeve members 317 and 318 about the shaft 323, as shown in FIG. 26.

The sleeve member 318 includes a flange 324 perpendicular to shaft 323 and at an end adjacent sprocket 323. The flange 324 pivots at one end about point 325 and has a hole 329 at an opposite end. (This flange 324 may be comprised of two separate traverse members extending in opposite directions from each other and traverse to the main panel unit.) A spring or a gas cylinder is attached between the hole 329 and a post 330 to apply a torque about point 325 to minimize opening and closing forces for sofa bed 1. The post 330, in turn, is fixedly attached to the arm (or side or other frame member) of the sofa bed. As shown in FIG. 26, a mounting plate 326 is fixed to the outer arm 11 at points 327 and 328 and includes a cylindrical portion 344 perpendicular to, and fixed to, the mounting plate 326.

A sprocket 333 is co-axial with, and fixed to, the cylindrical portion 344. Point 325 in the flange 324 is concentric with the cylindrical portion 344 of the mounting plate 326, and accordingly the flange rotates about the cylindrical portion 344 of the mounting plate 326. The sprockets 333 and 332 are co-planar and on parallel spaced-apart axes. A roller chain 345, shown in FIG. 24, connects the sprocket 333 to the sprocket 332. Likewise, a roller chain 346 connects the sprockets 334 and 304.

The roller chain 346 may include a tensioner, which in the depicted embodiment includes couplings 347 and 349 as well as a threaded member 348. The threaded member 348 has opposite threads on each end such that rotating threaded member 348 can cause roller chain 346 to tighten or loosen.

During opening and closing of the sofa bed 1, the sprocket 333 remains fixed and does not rotate relative to outer arm panel 11. The sprockets 332 and 334 are fixed to the shaft 323 and rotate on an axis parallel to, and spaced apart from, an axis through the cylindrical portion 344 of the mounting plate 326. The chain 345 connects the sprockets 333 and 332 and causes sprocket 334 to rotate relative to the mid panel 8 as the mid panel 8 rotates.

With the sprockets 332 and 334 fixed to the shaft 323, and with the chain 345 connecting the sprockets 333 and 332, a line marked on, and fixed to, the surface of the sprocket 334 and extending from the centerline of the sprocket 334 and extending upward vertically to the upper edge of the sprocket 334 will remain vertical as the sofa bed 1 moves from the bed position to the sofa position.

The sprocket 334 is co-planar with the sprocket 304, and the sprocket 334 is connected to the sprocket 304 with the roller chain 346. The sprocket 304 does not rotate relative to the foot panel 9. In a preferred embodiment, the foot panel 9 stays substantially horizontal as the sofa bed 1 moves from the bed position to the sofa position. In an alternative embodiment, the foot panel 9 varies from a horizontal orientation during the transition from the bed position to the sofa position, but the foot panel starts off in a substantially horizontal orientation and ends in a substantially horizontal orientation. Such an alternative embodiment may be implemented, for example, by using one or more eccentric sprockets (or the like) in the opening control mechanism. In such an embodiment, the angular orientation of the foot panel in relation to the mid (or main) panel is nevertheless constrained so that it is a function of the angular orientation of the main panel in relation to the arm (or side).

Thus, a transmission is formed by the arrangement of sprockets and chains described above. This transmission transmits the torque created by the spring about the axis 350, shown in FIG. 24, to the axis 101. Accordingly, all forces generated by the weight of moving components of the sofa bed 1 may be counteracted and balanced by the effect of spring 331.

Figure 24:
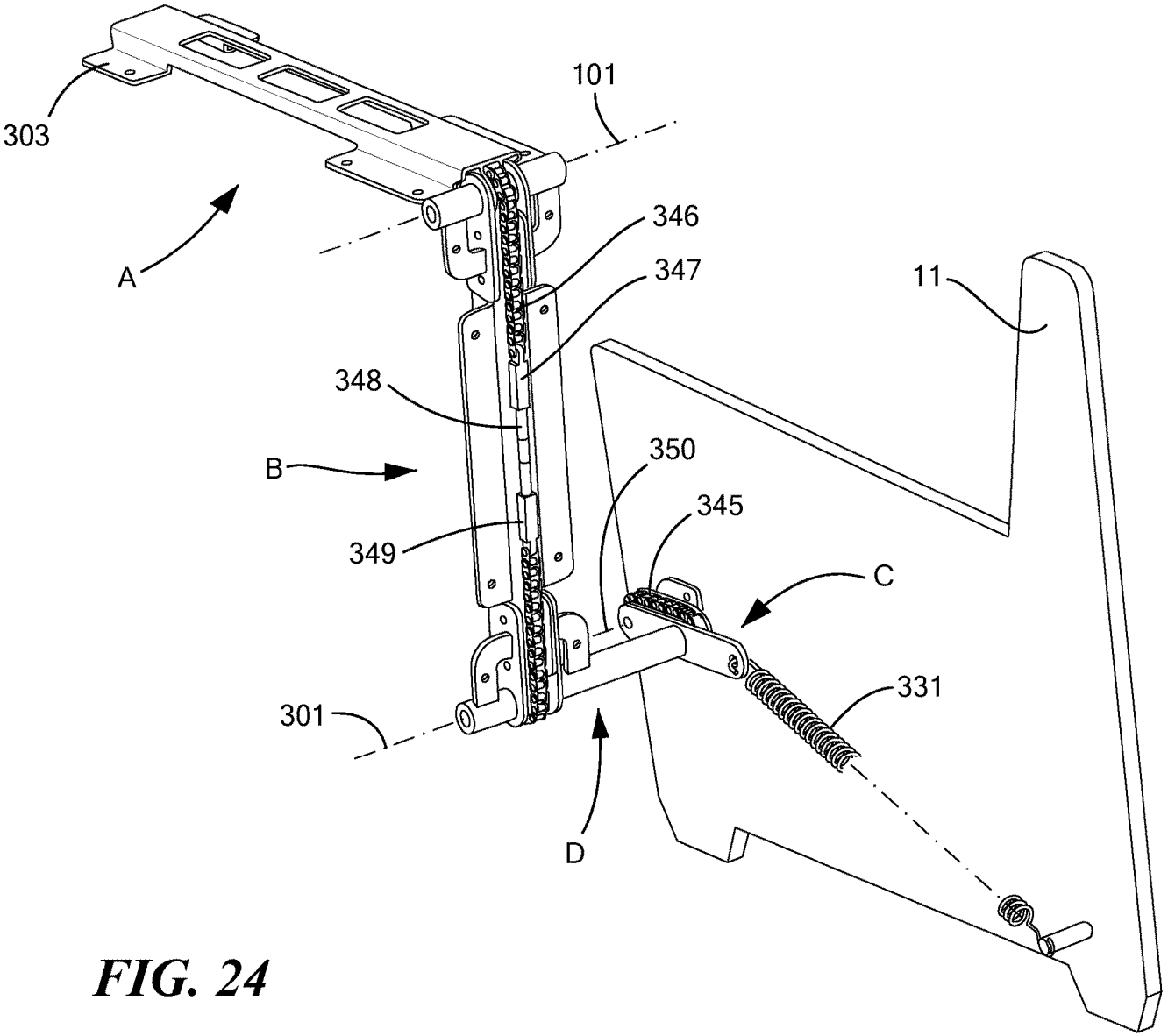

As shown in FIG. 24, the opening control mechanism includes four portions marked A, B, C and D. An arm portion C is pivotally attached to the arm panel 11 so that it pivots about axis 350. In a preferred embodiment, the arm portion C is located outside of the lateral sides of the mid panel, and it is preferably disposed within an arm. The arm portion C preferably extends from axis 350 to axis 301 and beyond so as to provide leverage for a spring 331 or the like acting thereon. A main panel portion B is directly attached to the mid (or main) panel and is disposed substantially (preferably entirely) inside the lateral sides of the mid panel. The main panel portion B extends to encompass both axis 301 and axis 101. A connecting portion D extends along axis 301, and connects the arm portion C with the main panel portion B. A foot-panel portion A is directly attached to the foot panel and encompasses axis 101. The foot panel portion A is disposed substantially (preferably entirely) inside the lateral sides of the foot panel. The spring 331 creates a torque about axis 350, and the opening control mechanism transmits torque from axis 350 to axis 101 and the foot panel portion A. In an alternative embodiment, one or both of the foot-panel and main-panel portions are attached to the lateral sides of the foot panel and main panel respectively.

Figure 24A:
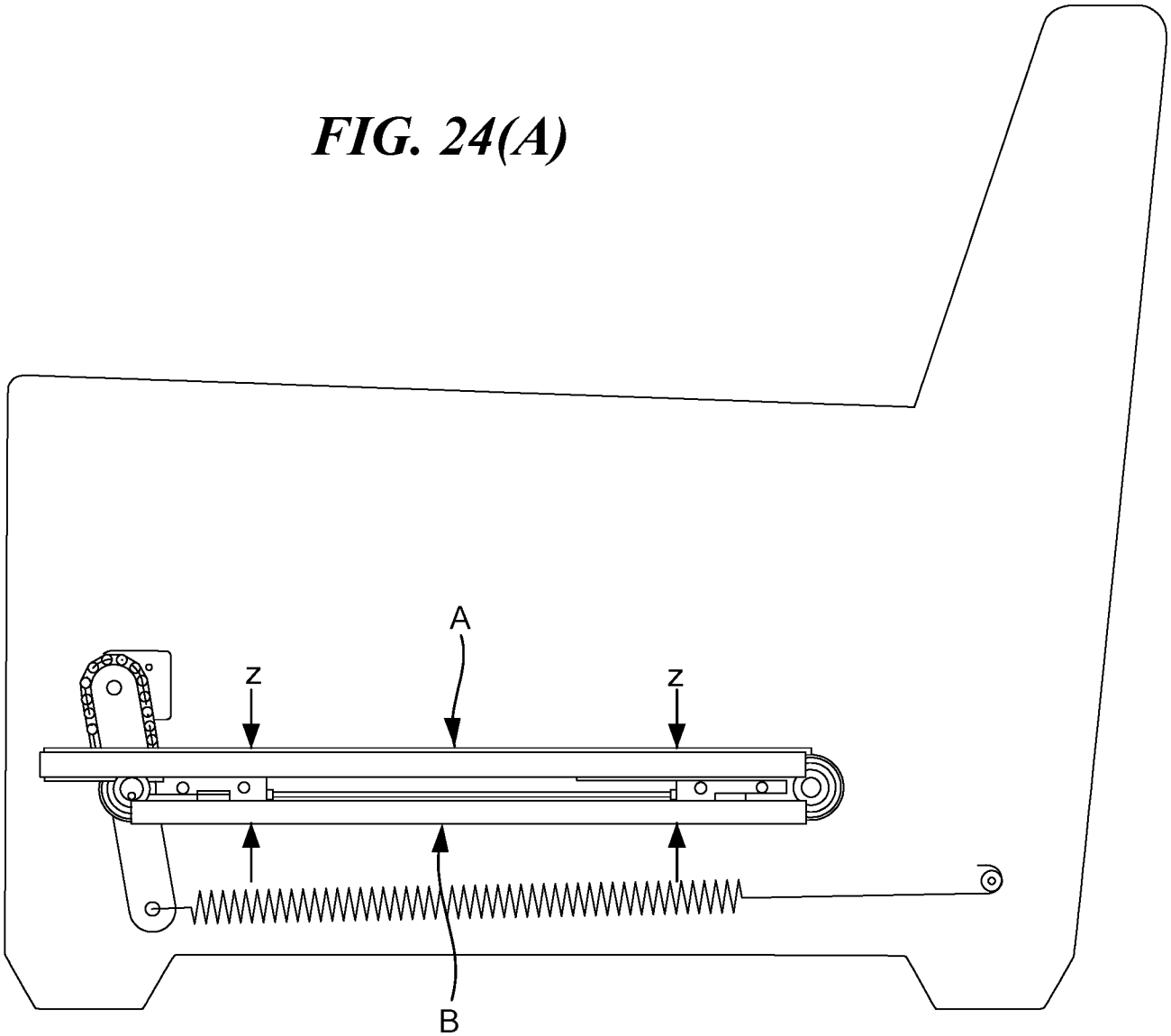
Figure 24B:
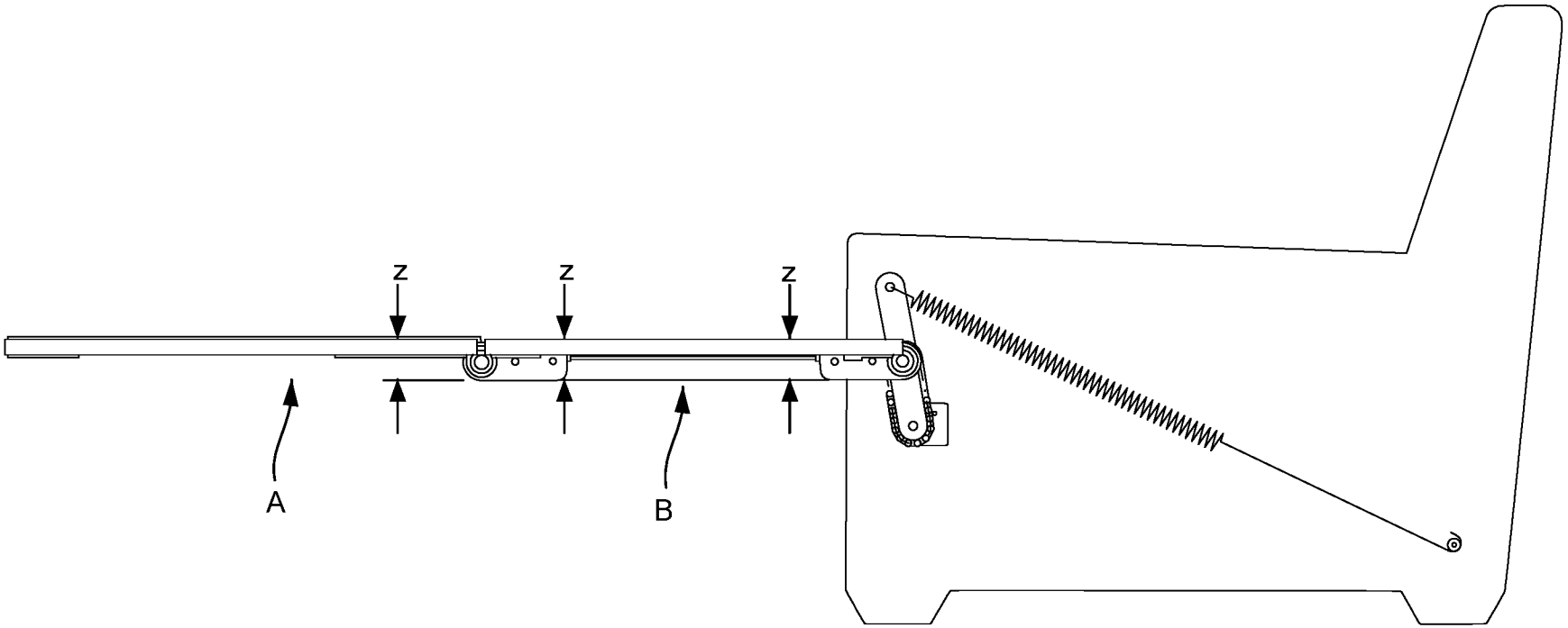

FIGS. 24(A) and 24(B) show side views of the sofa bed of FIG. 1 showing only the opening control mechanism mounted to an arm panel. FIG. 24(A) shows the opening control mechanism in the folded configuration. The arrows marked Z show the folded thickness of the foot panel portion A and main panel portion B. FIG. 24(B) shows the opening control mechanism in the unfolded position. The arrows marked Z show the thickness of the foot panel portion A and the thickness of the main panel portion B. The thickness Z of the foot panel portion A and main panel portion B in the folded configuration, is preferably no greater than what the thickness of the folded foot and main panels would be without the opening control mechanism.

As one of ordinary skill in the art will appreciate, the transmission may be constructed in numerous alternate ways, without the use of roller chains. FIGS. 29-36 show a variety of such ways to connect two parallel shafts. As in the embodiment described above, these alternative transmissions mechanically connect parallel spaced-apart shafts such that the rotation of one shaft causes the other shaft to rotate in the same direction.

Figure 29:
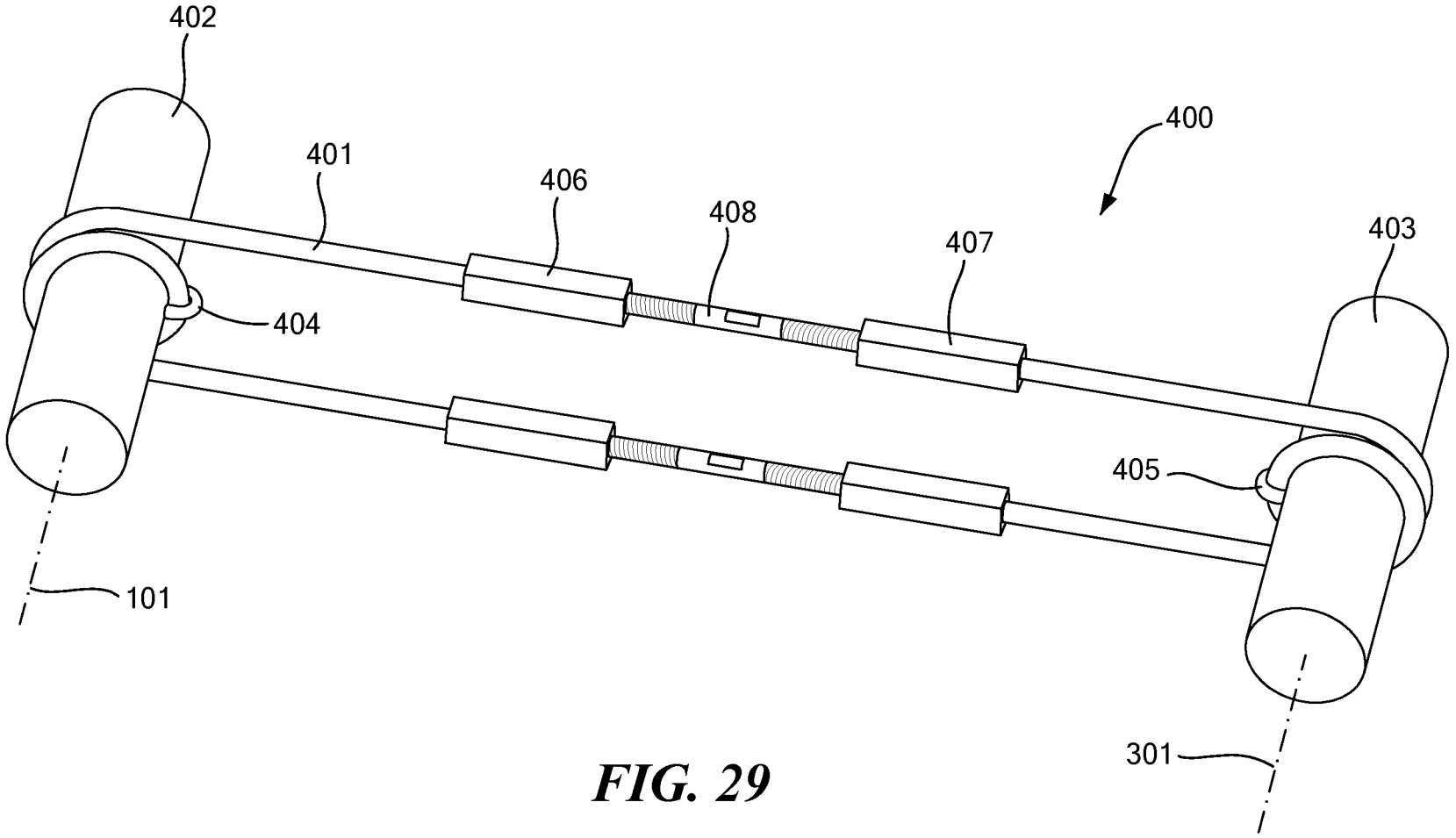
FIGS. 29-32 show alternative versions of the opening control mechanism of the sofa bed of FIG. 1.

FIG. 29 shows a simplified representation of an alternative cable assembly 400 for connecting the rotation of parallel shafts without using a roller chain. Such a cable assembly could be used to eliminate the need for sprockets and to replace the chains 345 and 346. The cable 401 is wrapped one or more revolutions around shafts 402 and 403 and is clamped to the shafts 402 and 403 with clamps 404 and 405 respectively. The shaft 403 may be located at the axis 301 and the shaft 402 at the axis 101. (In an alternative embodiment that is similar to the eccentric sprocket embodiment described above, one or more of the shafts may be provided with a cam where the cable wraps around the shaft. In such an embodiment, the angular orientation of the foot panel can vary from horizontal, but is constrained in relation to the mid panel so that it is a function of the angular orientation of the main panel in relation to the arm.) A tensioning mechanism similar to that used with the roller chain may be used including cable ends 406 and 407 and a threaded member 408.

Figure 30:
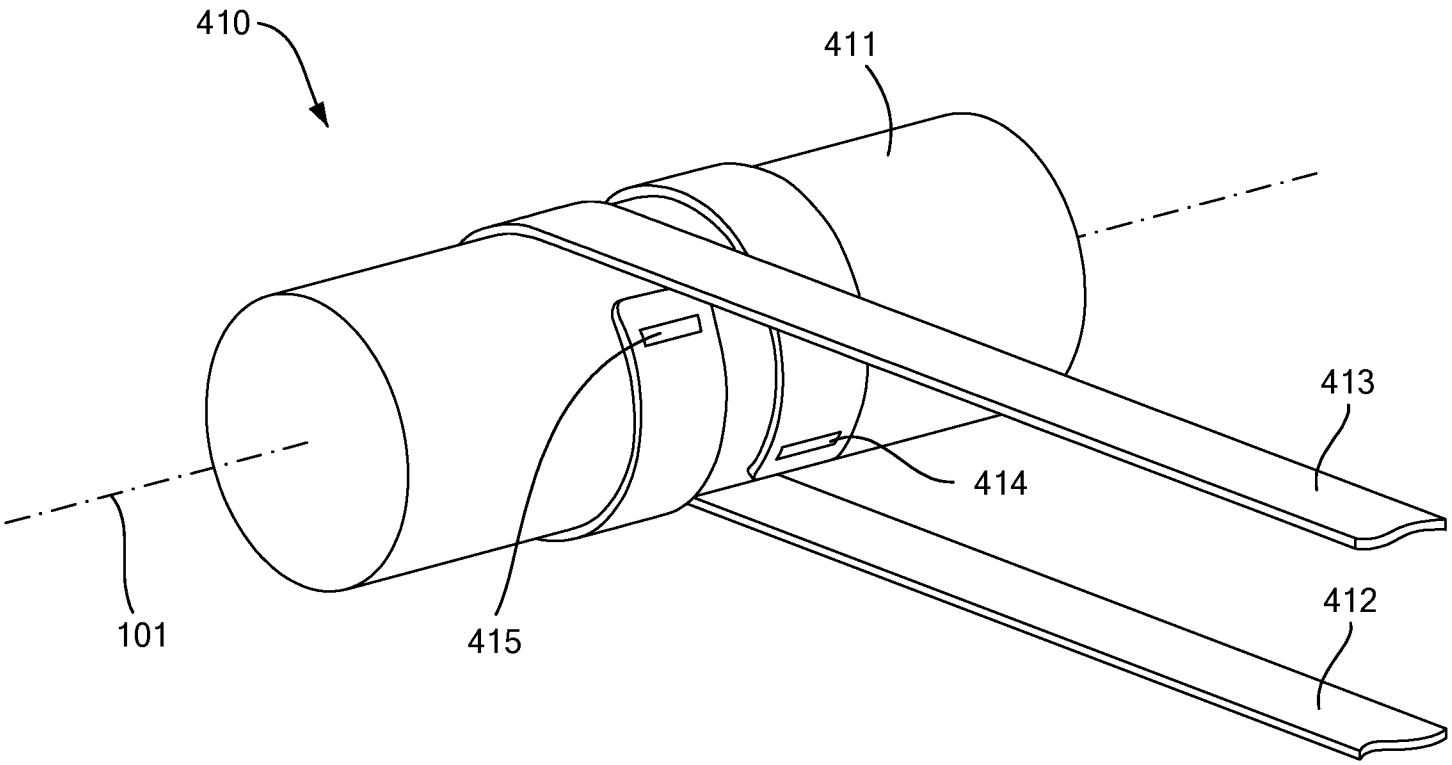

Similarly, a low-profile webbing assembly 410 as seen in FIG. 30 may be used instead of the cable assembly seen in FIG. 29. FIG. 30 shows a portion of such a webbing assembly and does not show the shaft located at the axis 301. Straps 412 and 413 are wrapped around a shaft 411 and clamped to the shaft 411 with clamps 414 and 415. The shaft 411 may be located at the axis 101. Straps 412 and 413 are also wrapped around and secured to an additional shaft located at the axis 301 (not shown). (This embodiment may also be configured so that the angular orientation of the foot panel can vary from horizontal, but is nevertheless constrained in relation to the mid panel so that it is a function of the angular orientation of the main panel in relation to the arm.)

Figure 31:
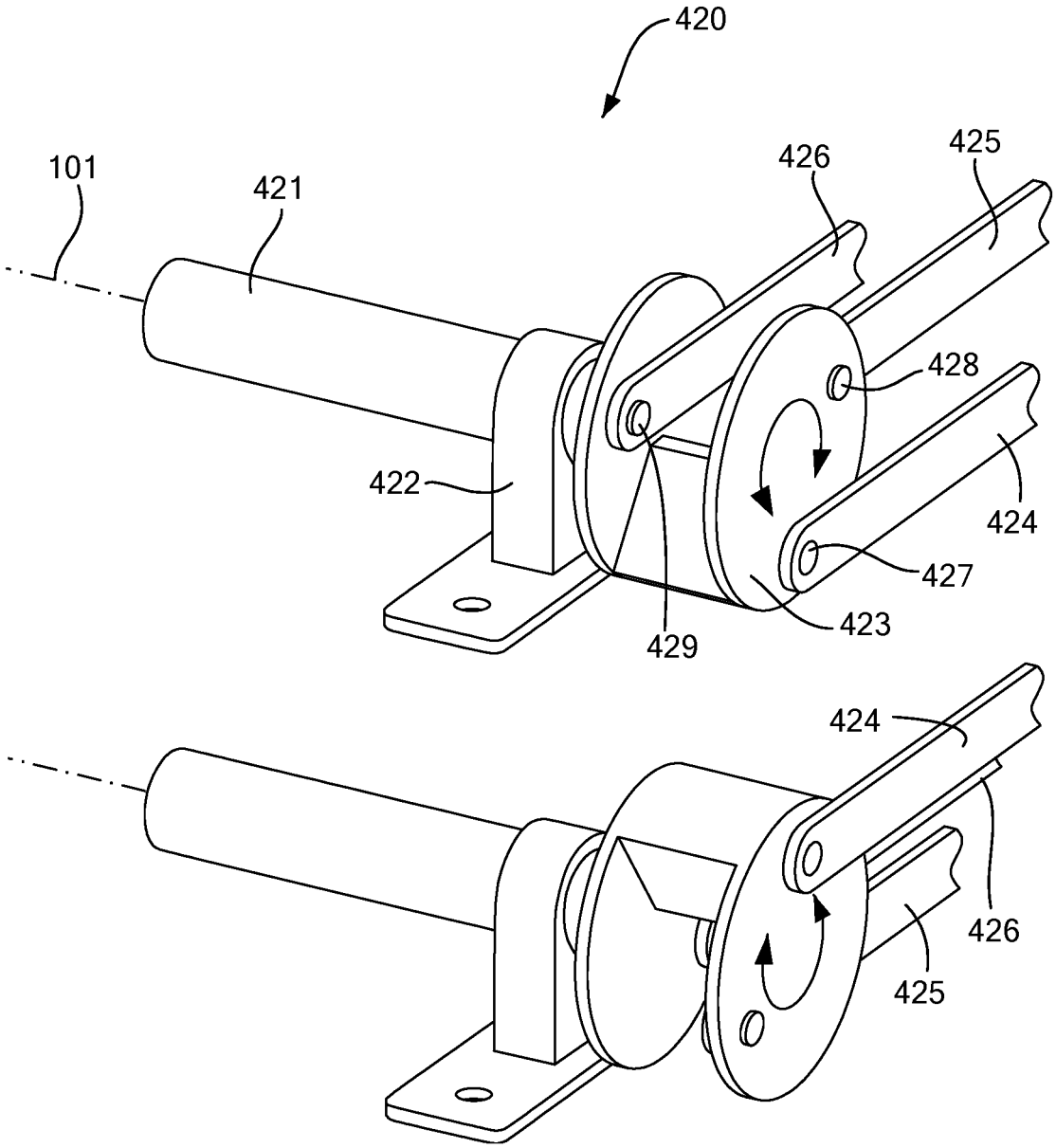

FIG. 31 shows a simplified representation of a portion of an alternative linkage assembly 420 to connect the rotation of parallel shafts. A base 422 is fixed while a shaft 421 pivots within a hole 429 in the base 422. The shaft 421 is fixed to a hub 423. The shaft 421 may be located at the axis 101. Connecting links 424, 425, and 426 are rigid and are pivotally connected at one end to the hub 423 at points 427, 428, and 429. Points 427, 428, and 429 are equidistant from the axis of shaft 421 and 120 degrees apart. The connecting links 424, 425, and 426 are pivotally connected at another end to a similar hub at the axis 301, which hub is connected is connected to a shaft that is parallel to, and spaced apart from, the shaft 421 at axis 101. (This embodiment may also be configured so that the angular orientation of the foot panel can vary from horizontal, but is nevertheless constrained in relation to the mid panel so that it is a function of the angular orientation of the main panel in relation to the arm.)

Figure 32:
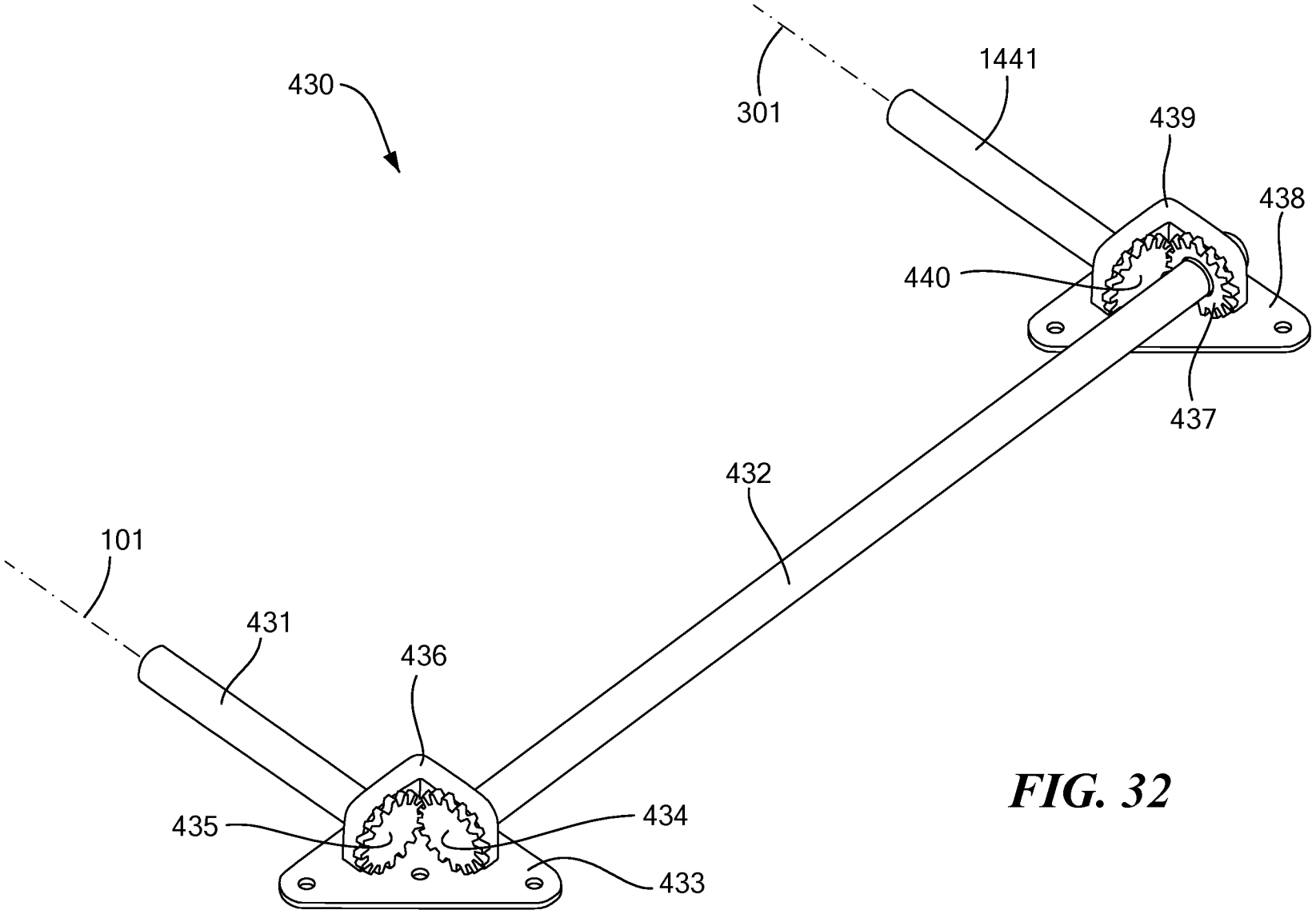

FIG. 32 shows a simplified representation of an alternative gear assembly 430, which connects the rotation of parallel shafts 431 and 1441. Such shafts may be located at axes 101 and 301 respectively. A base 433 is fixed to a main panel (such as mid panel 8) and includes a vertical flange 436. The vertical flange 436 includes holes with axes perpendicular and coplanar to each other to receive the shaft 431 and a connecting shaft 432. A base 438 is also fixed to a main panel and includes a vertical flange 439. The vertical flange 439 includes holes with axes perpendicular and coplanar to each other to receive the shaft 1441 and the connecting shaft 432. One end of the connecting shaft 432 is fixed to a gear 434 and at its other end to a gear 437. The gear 434 engages the gear 435 that is fixed to the shaft 431. The gear 437 engages a gear 440 that is fixed to the shaft 1441. The gear assembly 430 is configured to cause both spaced-apart coplanar parallel shafts to rotate in the same direction. (This embodiment may also be configured so that the angular orientation of the foot panel in relation to the mid panel is nevertheless constrained so that it is a function of the angular orientation of the main panel in relation to the arm.)

Figure 33:
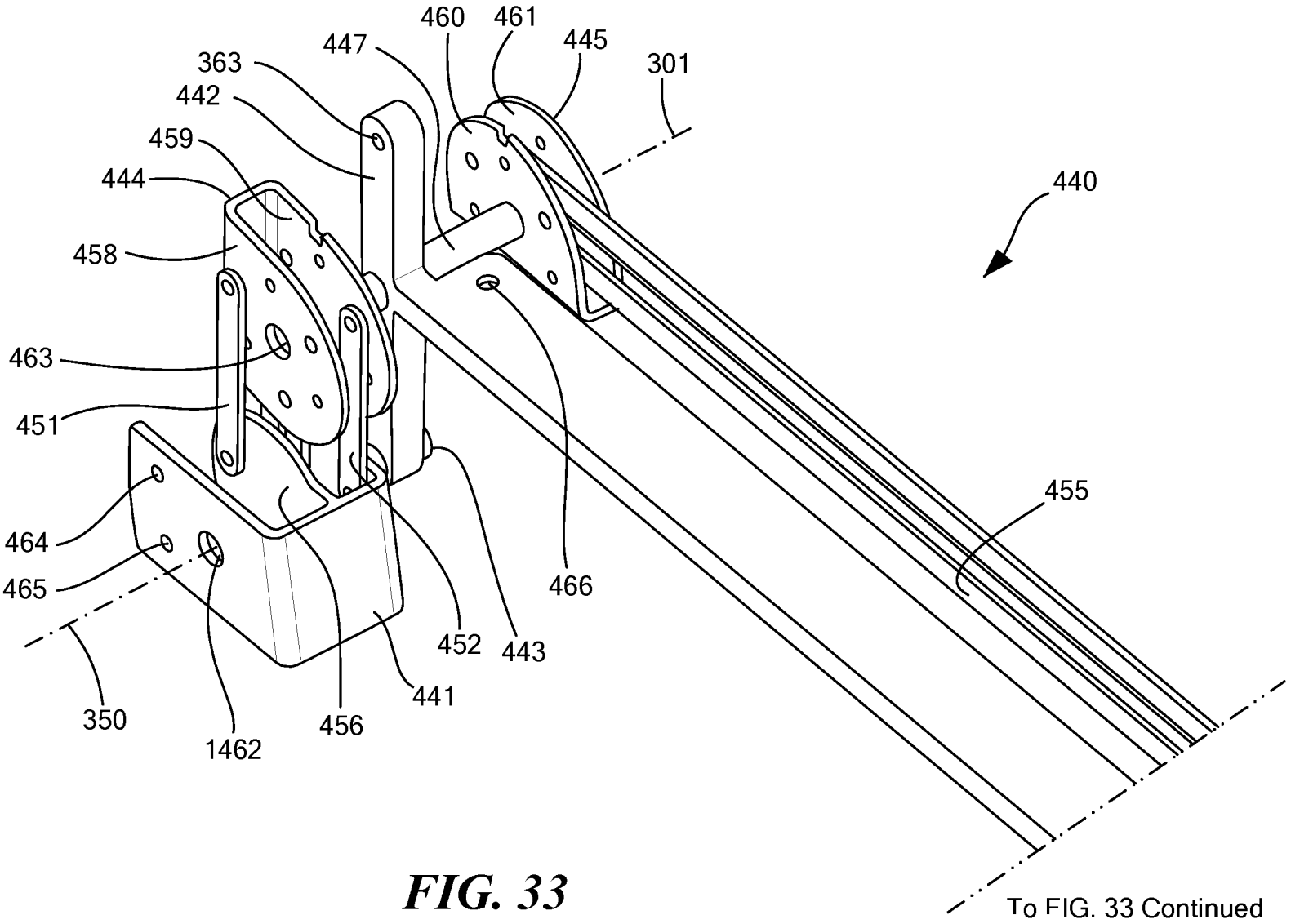
FIGS. 33-36 show various perspective views of a simplified, linkage-based version of an opening control mechanism for the sofa bed of FIG. 1.
Figure 33:
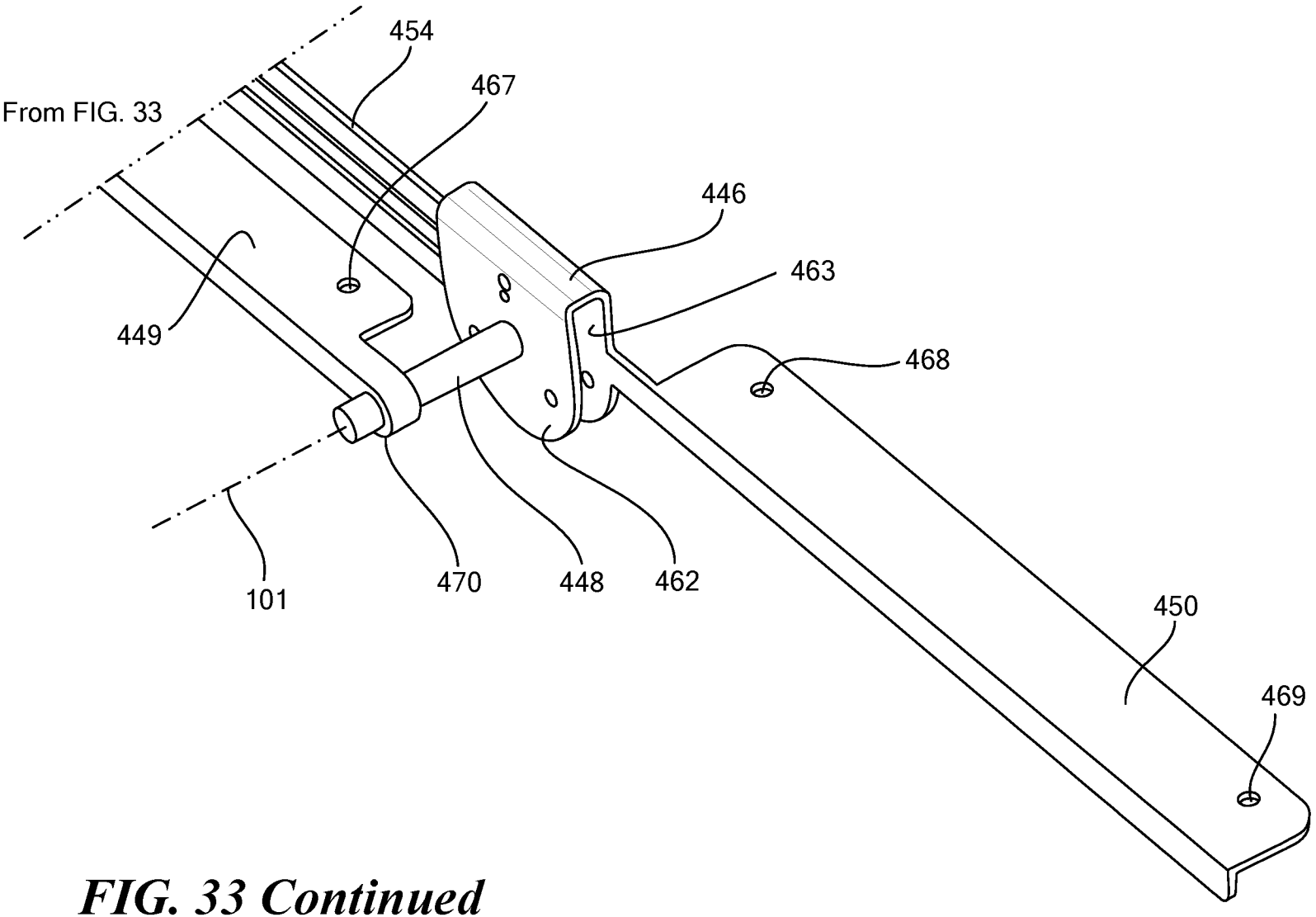
Figure 33A:
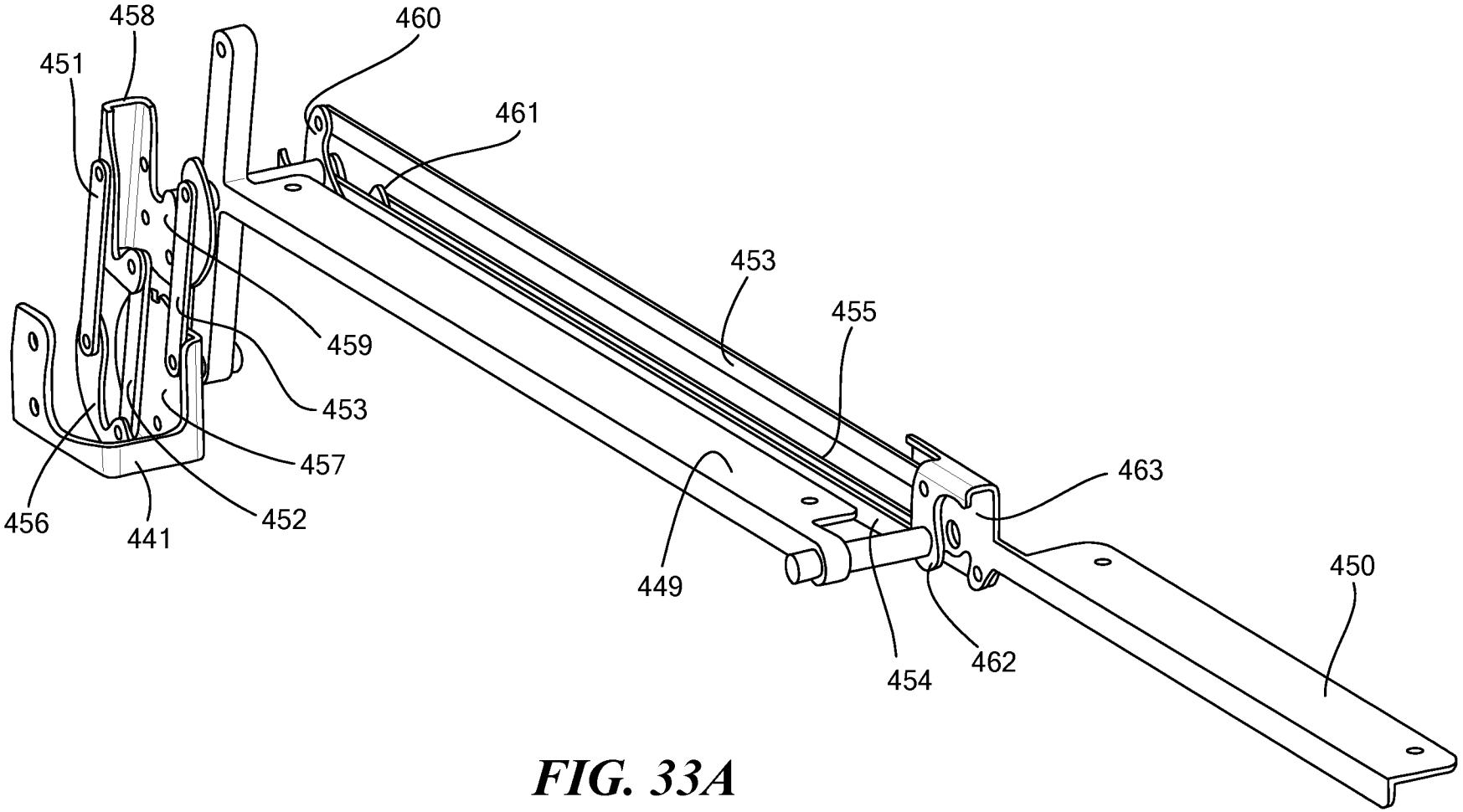
Figure 34:
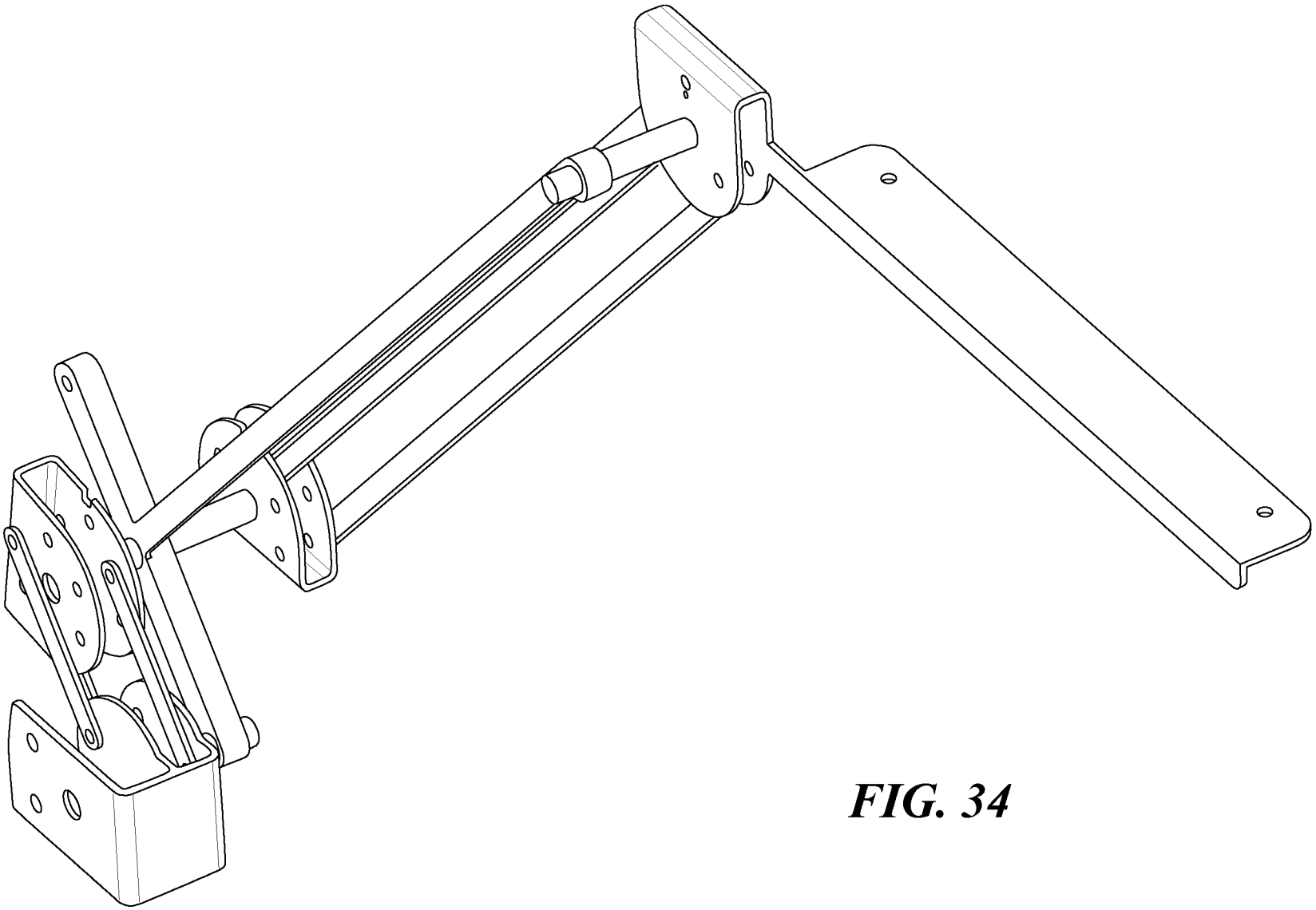
Figure 34A:
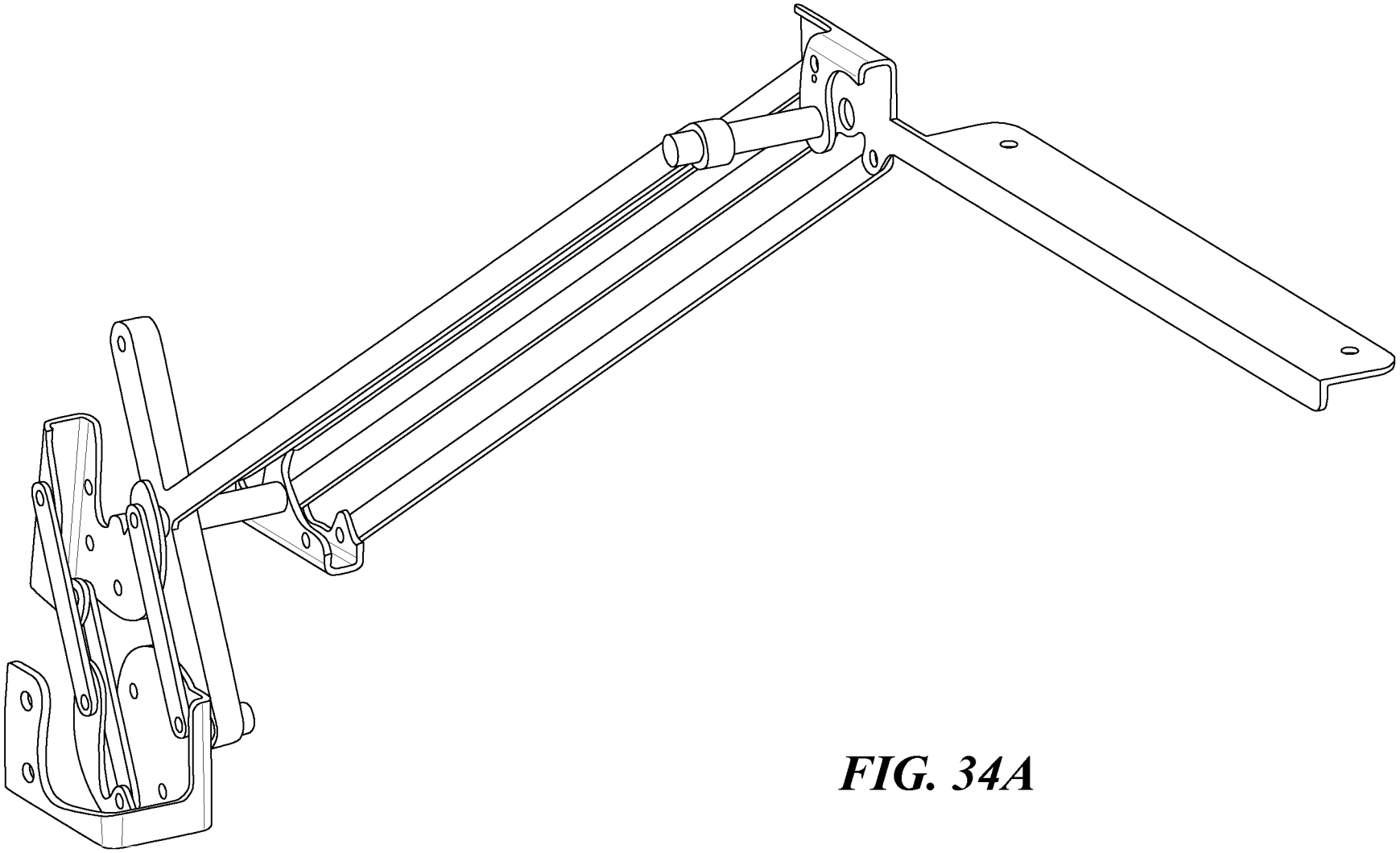
Figure 35:
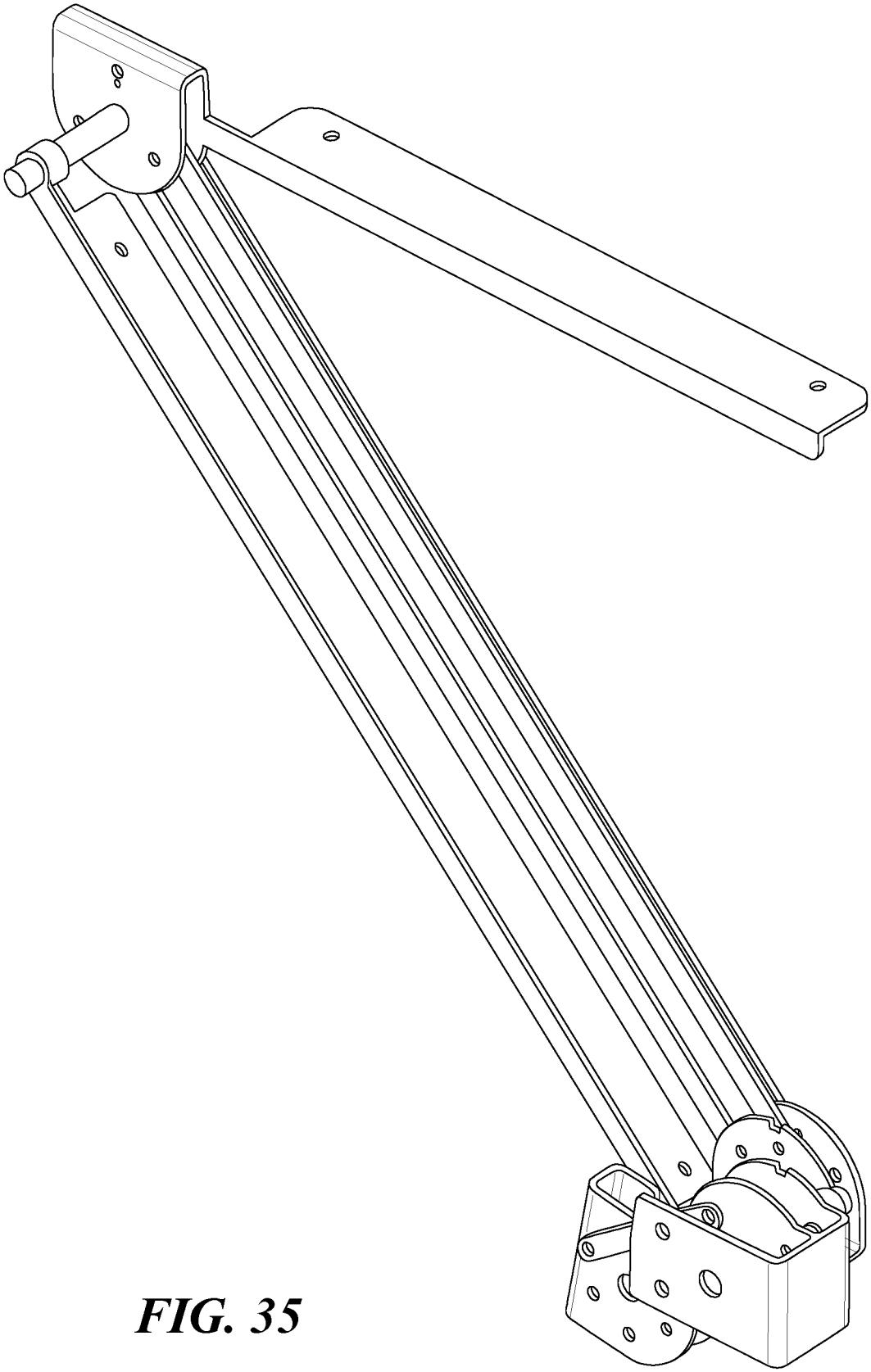
Figure 35A:
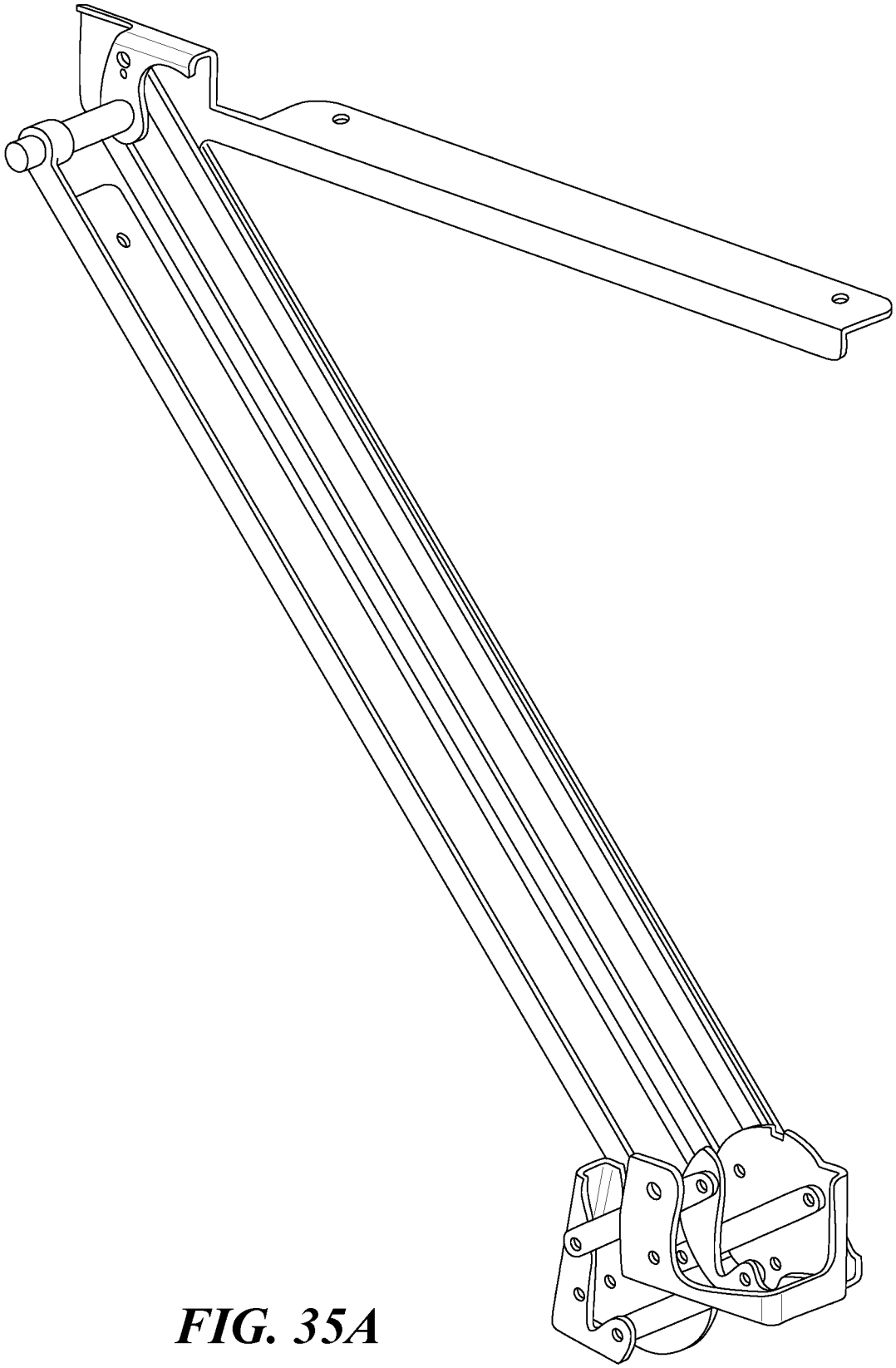
Figure 36:
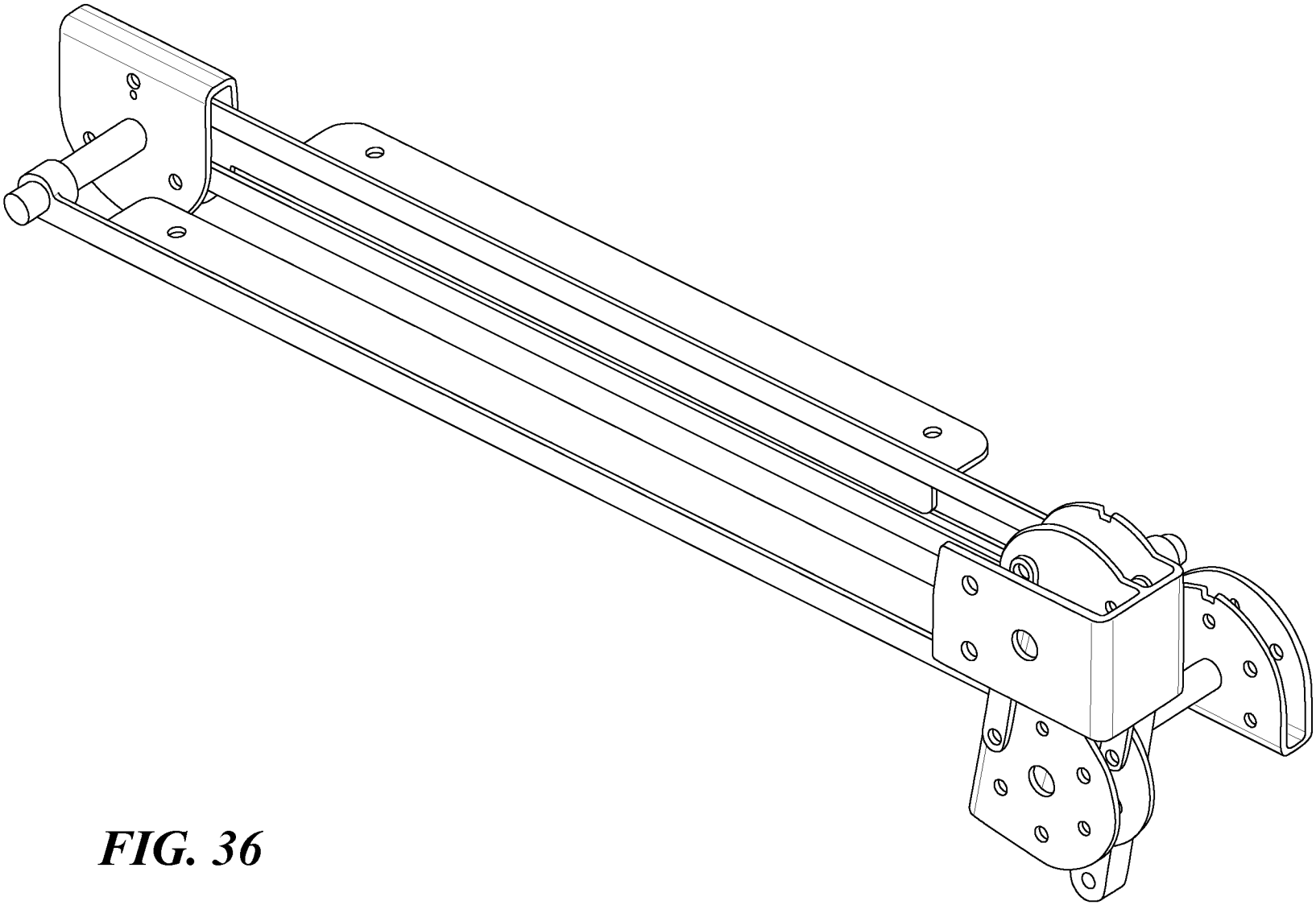
Figure 36A:
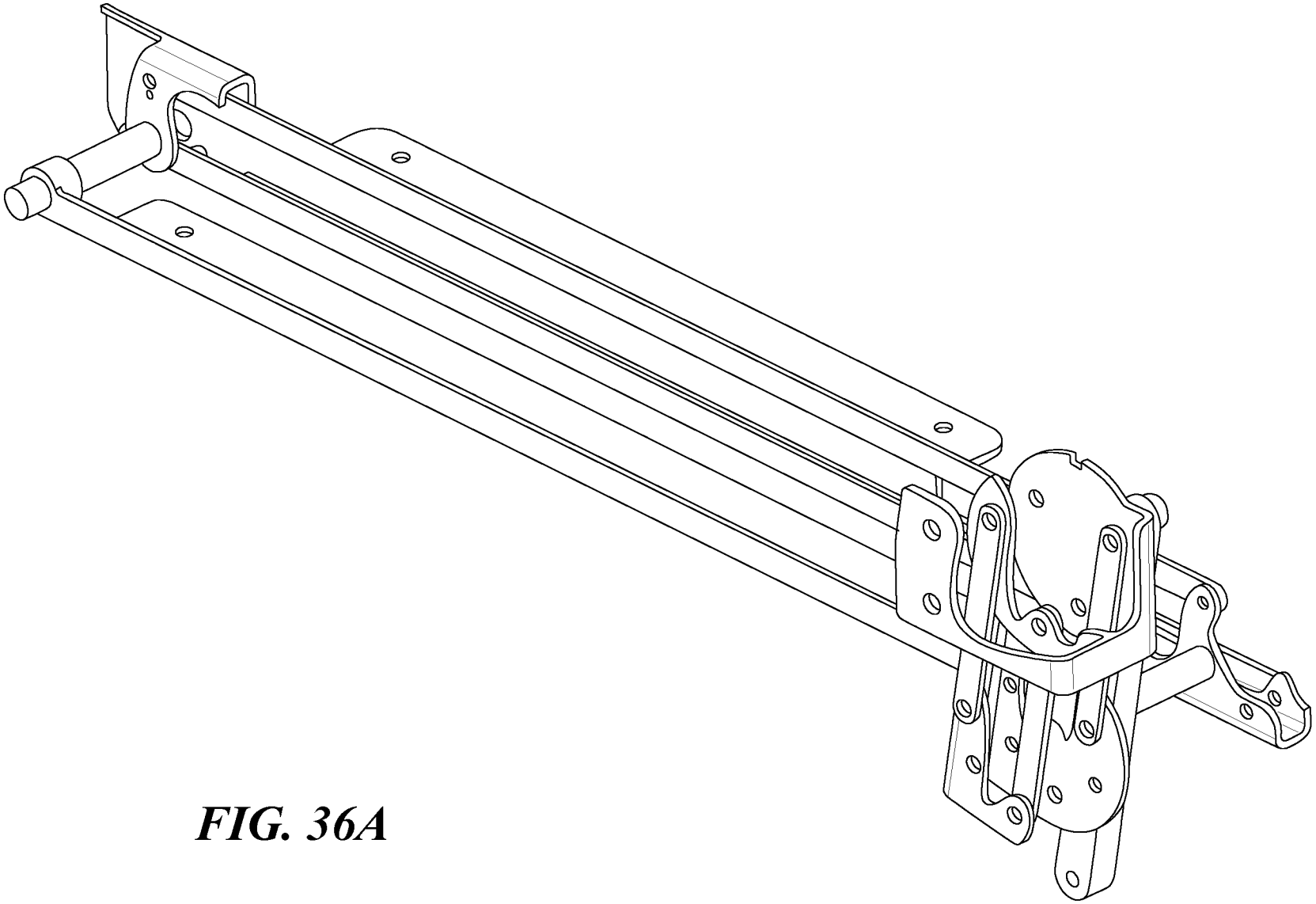

FIGS. 33, 34, 35 and 36 show a simplified representation of a linkage-driven version 440 of opening control mechanism 300 in positions ranging from the bed position to the sofa position. The chains 345 and 346 of the embodiment shown in FIGS. 19-28 are each replaced with three rigid links. FIGS. 33A, 34A, 35A, and 36A are partially cutaway versions of FIGS. 33, 34, 35, and 36 respectively. As shown in FIGS. 33 and 33A, a base member 441 is fixed to an outer arm panel (shown as item 11 in other figures) at points 464 and 465. The base member 441 includes parallel spaced-apart flanges 456 and 457. Each of such flanges includes a 3 hole pattern with the holes spaced 120 degrees apart and equidistant from an axis through the hole 1462. The hole 1462 may be located at the axis 350.

A flange member 444 includes two spaced-apart parallel flanges 458 and 459 and a 3 hole pattern with the holes spaced 120 degrees apart and equidistant from an axis through hole 463. A hole 463 may be located at the axis 301. The flange member 444 and the combination of the flanges 458 and 459 respectively replicate the effect of the sprockets 332 and 333 (of the embodiment shown in FIGS. 19-28). Equal-length links 451, 452, and 453 are pivotally connected to the flange member 444 and to the base member 441 at their respective 3-hole patterns, so as to replicate the effect of chain 345 and sprockets 332 and 333 (shown in FIGS. 24 and 26.).

A mid panel mounting plate 449 (shown in FIG. 33) replicates the effect of the assembly comprised of parts 318, 315, and 313 (shown in FIG. 26). The mid panel mounting plate 449 may be fixed to the mid panel 8 at points 466 and 467. A shaft 447 replicates the effect of shaft 323 (shown in FIG. 26) and is fixedly connected to flange members 444 and 445. A spring similar to spring 331 may be attached to a hole 363 to have the same effect as the spring 331 in counteracting opening and closing forces associated with the movement of sofa bed 1 from sofa to bed position.

A foot panel mounting plate 450 replicates the effect of the foot panel mount 303 (shown in FIG. 26), may be fixed to the foot panel 9 at points 468 and 469, and includes a flange portion 446 with spaced-apart parallel flanges 462 and 463. Each flange 462 and 463 has a 3-hole pattern with the holes spaced 120 degrees apart and equidistant from an axis through a shaft 448. The flange member 445 and the flange portion 446 respectively replicate the effect of the sprockets 334 and 304 (shown in FIG. 26). Equal-length links 453, 454, and 455 are pivotally connected to the flange member 445 and to the flange portion 446 at their respective 3-hole patterns, so as to replicate the effect of the chain 346 and the sprockets 334 and 304 (as seen in FIGS. 24 and 26). The shaft 448 is fixed to the foot panel mounting plate 450 and rotates in a hole 470 in the mid panel mounting plate 449 at axis 101.

FIGS. 37-41 show partially cut-away, lateral views of an opening sequence of the linkage-based version of the control mechanism shown in FIGS. 33-36 and 33A-36A. The closing sequence, of course, is depicted by simply viewing these figures in reverse order. The transmissions shown and described herein assist the user in both the opening and the closing of the sofa bed.

Figure 37:
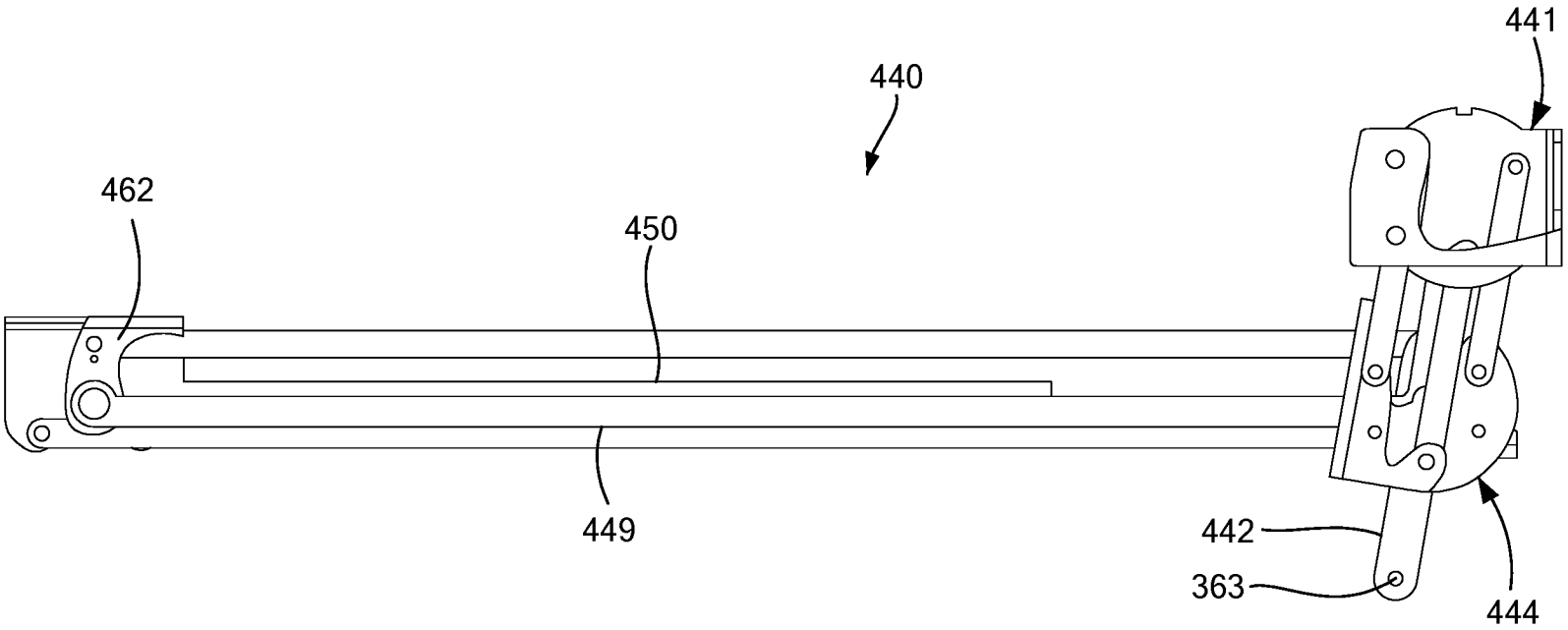
FIGS. 37-41 show partially cut-away, lateral views of an opening sequence of the linkage-based version of the control mechanism shown in FIGS. 33-36 and 33A-36A.

FIG. 37 shows the control mechanism 440 in the closed or sofa position. In this position, the foot panel mounting plate 450 is oriented so that the foot panel and the corresponding cushion attached to the foot panel mounting plate 450 face cushion-side up. The mid panel mounting plate 449, on the other hand, is oriented so that the mid (or main) panel and its corresponding cushion attached to the mid panel mounting plate 449 face cushion-side down. Both the foot panel and the mid panel are horizontal in this closed position.

As described above, the base member 441 is fixedly attached to the arm (or side) of the sofa bed. A flange 442 (similar to flange 324 in FIG. 26) is pivotally attached to the base member 441. The flange 442 includes a hole 363, to which one end of a spring, a pneumatic cylinder, or the like may be attached. The other end of the spring may be attached to the arm of the sofa bed, or to some other fixed point. The spring, pneumatic cylinder or similar device creates a torque about the pivot point of the flange 442. (This flange 442 may also be comprised of two separate traverse members extending in opposite directions from each other and traverse to the main panel unit.)

The strength and direction of this torque changes as the control mechanism transitions from the closed position to the open position, and then back again. This torque assists the user in opening and closing the sofa bed. In particular, because of the transmission being employed in the control mechanism, which transmission transmits the force from the spring to the foot panel, this torque helps the user lift the foot panel.

FIG. 37 also shows the flange member 444, which is pivotally attached to flange 442. As can be seen in FIGS. 37-41, the angular orientation of flange member 444 does not vary, or does not vary substantially, during the transition between the open and closed positions. This constancy in the angular orientation of the flange member 444 is achieved by the linkages connecting the flange member 444 to the base member 441 (which linkages are described above in connection with FIGS. 33-36).

FIG. 37 also shows the flange 462, which is pivotally attached to the mid mounting plate 449, which in turn is pivotally attached to flange member 444. As with flange member 444, FIGS. 37-41 show that the angular orientation of flange 462 does not vary, or does not vary substantially, during the transition between the open and closed positions. This constancy in the angular orientation of the flange 462 is achieved by the linkages connecting the flange 462 to the flange member 444. (Again, these linkages are described above in connection with FIGS. 33-36.)

The foot mounting panel plate 450 is rigidly attached to flange 462. Thus, as a result of the angular orientation of flange 462 not varying substantially during the transition between the open and closed positions, the foot mounting panel plate remains substantially horizontal during the entire transition.

In FIG. 37, the force applied by the spring or other force-applying device at hole 363 of flange 442 is directed to the left (i.e., towards the back of the sofa), causing a clockwise torque about the pivot point of the flange 442. When the sofa bed is being opened, the force of the spring or other force-applying device helps the user lift the foot panel up, because the force of the spring is being transmitted through the control mechanism to the foot panel. Without this transmission mechanism, the user would have to pull up the foot panel without any assistance from the spring or other force-applying device.

Figure 38:
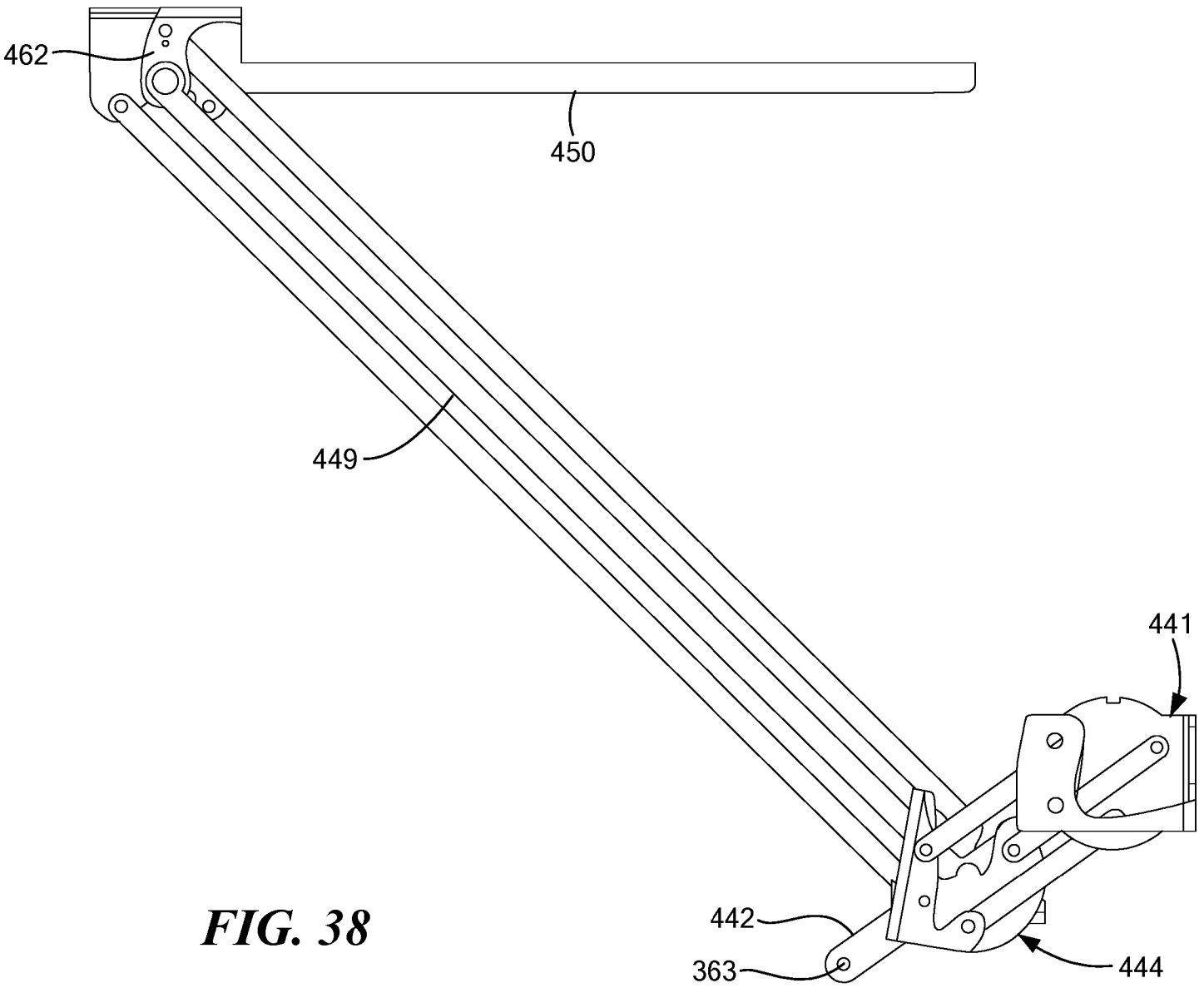
Figure 39:
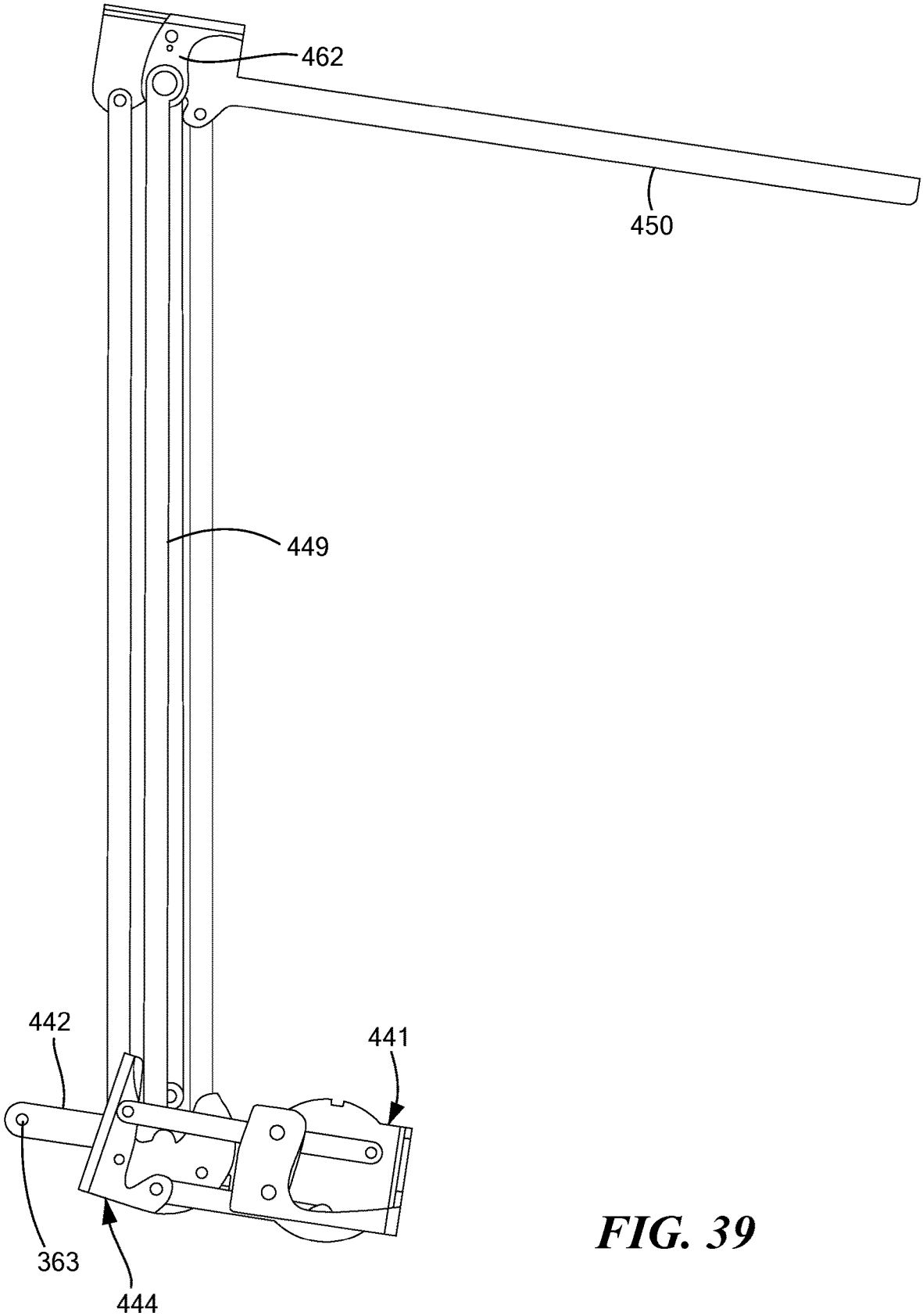

In FIG. 38, the torque being applied about the pivot point of the flange 442 is still clockwise. In FIG. 39, the spring or other force applying device is applying the force through a line that passes through or near the pivot point of the flange 442; thus, at this time during the transition of the sofa bed from opened to closed, no torque is being created. At this time during the transition from closed to open, the torque switches from clockwise to counter-clockwise.

Figure 40:
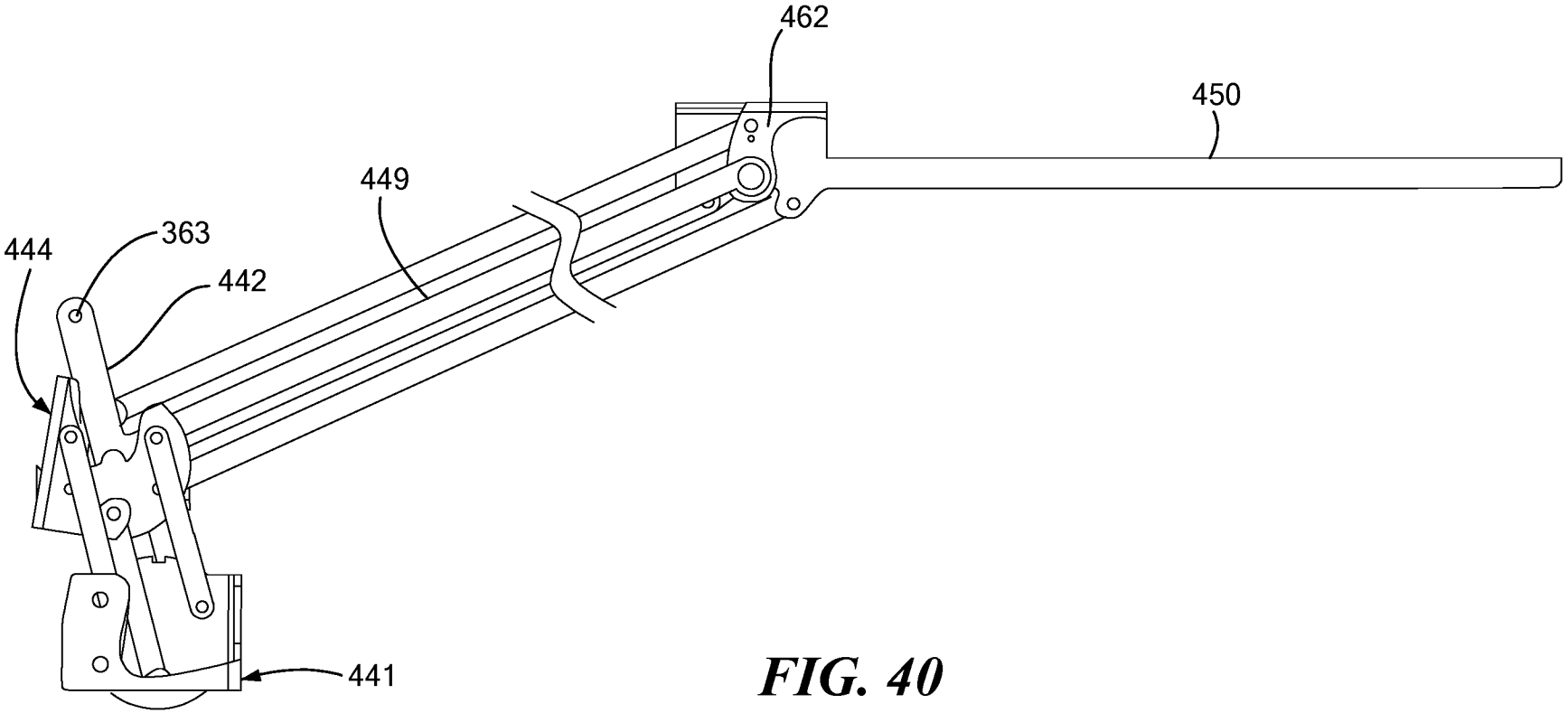

Throughout the transition from closed to opened (and back again), the force applied by the spring or other force-applying device at hole 363 of flange 442 remains directed to the left (i.e., towards the back of the sofa). In FIG. 40, this force creates a counter-clockwise torque about the pivot point of the flange 442 during the opening process.

Figure 41:
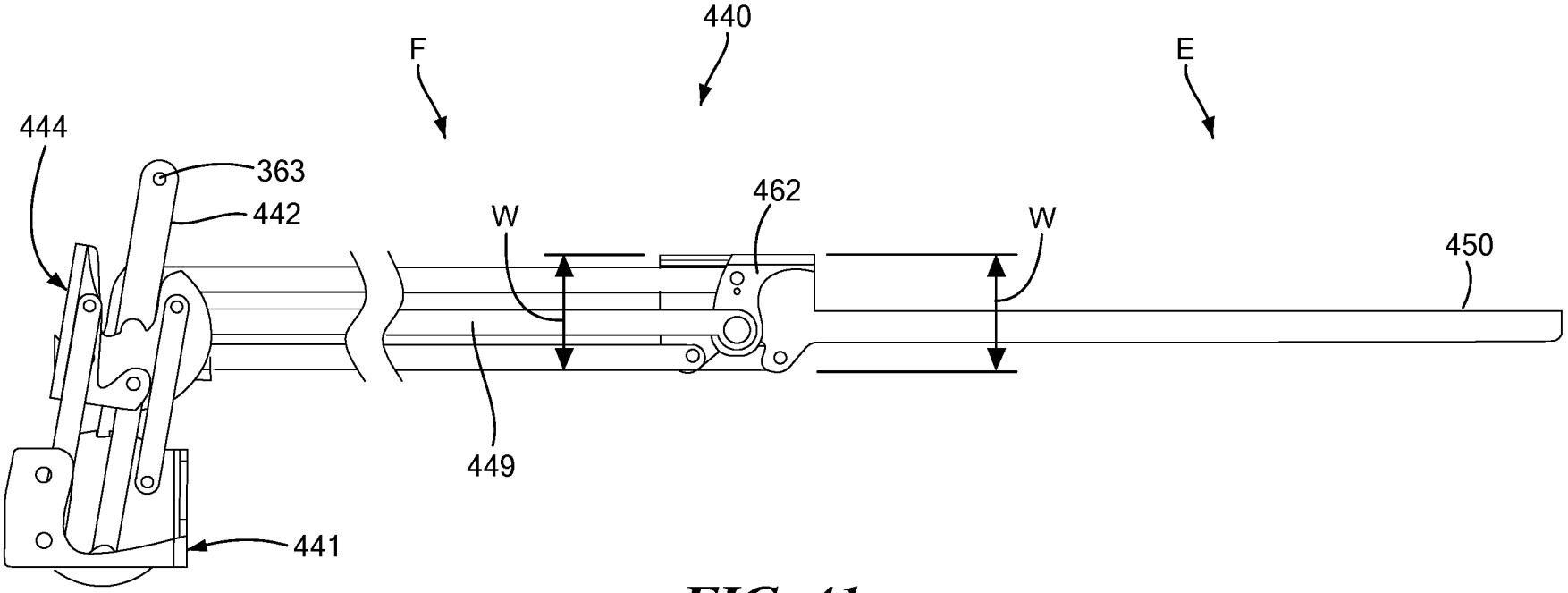

FIG. 41 shows the control mechanism 440 in its fully opened position (the bed position). When the user wants to close the sofa bed from this position, the user is assisted by the spring or other force-applying device, the force of which is transmitted by the control mechanism to the foot panel, so as to make the foot panel easier to lift throughout the transition. Depth W of the vertical space occupied by the foot panel portion E of the control mechanism 440 and by the main panel portion F of the control mechanism 440 is shown in FIG. 41.

The control mechanism 440 preferably has a relatively slender vertical profile. In other words the depth of the control mechanism (i.e., the vertical dimension when the control mechanism is in its fully open position, as shown in FIG. 41, or in its fully closed position, as shown FIG. 37) is relatively small. This depth W (i.e., this relatively small vertical profile) does not change during the movement from the sofa position to the bed position. In particular, when measuring the depth W of the main-panel and foot panel portions of the control mechanism, this depth is less than the depth of the main panel including the cushion attached thereto. In a preferred embodiment, the foot panel portion E and the main panel portion F do not extend beyond the lateral sides of the main panel and the foot panel, and instead are fully within the lateral sides of the main panel and the foot panel.

More preferably, this control mechanism depth is less than half of the depth of the main panel including the cushion attached thereto. Preferably, this control mechanism depth is less than 3 inches. More preferably, this control mechanism depth is less than 2.5 inches. Preferably, this control mechanism depth is less than 7 centimeters. In a preferred embodiment, this depth is approximately 2.25 inches, or even less.

Such a slender vertical profile allows the control mechanism to take up very little vertical space in the closed position, as shown in FIG. 37. By minimizing the amount of vertical space taken up by the control mechanism in the closed position, the seat height of the sofa bed in the sofa position may be kept to a desirable height, as shown in FIG. 1.

In a fully automated version of the sofa bed, a motor may be employed to generate the torque about the pivot point of the flange 442. In such an embodiment, the motor may cause the opening and closing of the sofa bed, while the movement of the mid panel and the foot panel are coordinated as described herein.

The embodiments of the invention described above are intended to be merely exemplary; numerous variations and modifications will be apparent to those skilled in the art. All such variations and modifications are intended to be within the scope of the present invention as defined in any appended claims.

What is claimed is:

1. A folding bed comprising:

a frame having opposed sides, a back and a front; and an assembly, located between the sides of the frame, the assembly including:

(a) a main bed section having a main panel and a main mattress section supported thereon, the main bed section having a pair of sides disposed between the sides of the frame, and having a width between the pair of sides of the main bed section;

(b) a foot bed section having a foot panel and a foot mattress section supported thereon, the foot bed section having a pair of sides, and having a width between the pair of sides of the foot bed section;

(c) a first pivotal connection connecting the main panel and the frame;

(d) a second pivotal connection connecting the foot panel and the main panel;

the panels and the pivotal connections being arranged such that:

when the assembly is in a folded position, the main panel is oriented in a generally horizontal position and faces downward, and the foot panel is stacked above the main panel in a generally horizontal orientation and faces upward, and when the assembly is in an unfolded position, the main panel and the foot panel are adjacent each other and both are oriented in a generally horizontal orientation and face upward; and (e) a transmission that (i) when the assembly is in a folded position, is located between the main mattress section and the foot mattress section, and further located within at least one of (1) the width of the pair of sides of the main bed section, and (2) the width of the pair of sides of the foot bed section, (ii) connects the first pivotal connection to the second pivotal connection, and (iii) is configured to transmit torque from the first pivotal connection to the second pivotal connection, so as to counteract forces generated by weight of moving components of the assembly and thus to help a user move the foot panel between the folded position and the unfolded position.

2. A folding bed according to claim 1, wherein, throughout transitioning between the folded and unfolded positions, the transmission has a depth that is less than a depth of the main panel and the main mattress section combined, wherein the transmission depth is a dimension perpendicular to a surface of the main panel.

3. A folding bed according to claim 2, wherein the transmission has a depth that is less than half of a depth of the main panel and the main mattress section combined.

4. A folding bed according to claim 2, wherein the transmission depth is less than 2.5 inches.

5. A folding bed according to claim 1, wherein the transmission includes a chain and a sprocket.

6. A folding bed according to claim 1, wherein the transmission includes a belt.

7. A folding bed according to claim 1, wherein the transmission includes a shaft and a gear.

8. A folding bed according to claim 1, wherein the main panel comprises a hollow and the transmission is at least partially disposed within the hollow.

9. A folding bed according to claim 1, wherein the transmission is mounted to an underside of the main panel.

10. A folding bed according to claim 1, wherein the transmission is mounted to a surface of the main panel.

11. A folding bed according to claim 1, further comprising a second transmission that (i) when the assembly is in the folded position is located within at least one of (1) the width of the pair of sides of the main bed section, and (2) the width of the pair of sides of the foot bed section, (ii) connects the first pivotal connection to the second pivotal connection, and (iii) is configured to transmit torque from the first pivotal connection to the second pivotal connection.

* * * * *